US011957956B2

(12) United States Patent
Bissonnette et al.

(10) Patent No.: US 11,957,956 B2
(45) Date of Patent: Apr. 16, 2024

(54) SYSTEM, METHOD AND APPARATUS FOR REHABILITATION AND EXERCISE

(71) Applicant: REHAB2FIT TECHNOLOGIES, INC., Longmont, CO (US)

(72) Inventors: Michael Bissonnette, Denver, CO (US); Philip Powers, Denver, CO (US); James D. Steidl, Denver, CO (US)

(73) Assignee: REHAB2FIT TECHNOLOGIES, INC., Longmont, CO (US)

( * ) Notice: Subject to any disclaimer, the term of this patent is extended or adjusted under 35 U.S.C. 154(b) by 102 days.

(21) Appl. No.: 16/869,954

(22) Filed: May 8, 2020

(65) Prior Publication Data

US 2020/0353310 A1 Nov. 12, 2020

Related U.S. Application Data

(60) Provisional application No. 62/846,434, filed on May 10, 2019, provisional application No. 62/858,244, filed on Jun. 6, 2019.

(51) Int. Cl.
*A63B 22/06* (2006.01)
*A63B 21/00* (2006.01)
(Continued)

(52) U.S. Cl.
CPC ..... *A63B 22/0605* (2013.01); *A63B 21/015* (2013.01); *A63B 21/4035* (2015.10);
(Continued)

(58) Field of Classification Search
CPC ..... A63B 22/0012; A63B 22/0046; A63B 22/0605; A63B 22/0002; A63B 22/001;
(Continued)

(56) References Cited

U.S. PATENT DOCUMENTS 1,820,372 A 8/1931 Blomquist
3,017,180 A 1/1962 Aronsohn
(Continued)

FOREIGN PATENT DOCUMENTS

CA 3193419 A1 3/2022
CN 2885238 4/2007
(Continued)

OTHER PUBLICATIONS

Malloy, Online Article "AI-enabled EKGs find difference between numerical age and biological age significantly affects health, longevity", Website: https://newsnetwork.mayoclinic.org/discussion/ai-enabled-ekgs-find-difference-between-numerical-age-and-biological-age-significantly-affects-health-longevity/, Mayo Clinic News Network, May 20, 2021, retrieved: Jan. 23, 2023, p. 1-4.
(Continued)

*Primary Examiner* — Megan Anderson
(74) *Attorney, Agent, or Firm* — Dickinson Wright PLLC; Stephen A. Mason; Jonathan H. Harder

(57) ABSTRACT

A rehabilitation and exercise system can include a base. A static device can be coupled to the base and configured to provide isometric exercise for a user by receiving static force from the user to facilitate at least one of osteogenesis or muscle hypertrophy for the user. In addition, a dynamic device can be coupled to the base and configured to provide a dynamic exercise for the user by being moved by the user to facilitate at least one of osteogenesis and muscle hypertrophy for the user.

16 Claims, 51 Drawing Sheets

(51) Int. Cl.

| | |
|---|---|
| ***A63B 21/002*** | (2006.01) |
| ***A63B 21/015*** | (2006.01) |
| ***A63B 21/04*** | (2006.01) |
| ***A63B 21/055*** | (2006.01) |
| ***A63B 22/00*** | (2006.01) |
| ***A63B 23/02*** | (2006.01) |
| ***A63B 23/035*** | (2006.01) |
| ***A63B 23/04*** | (2006.01) |
| ***A63B 71/06*** | (2006.01) |

(52) U.S. Cl.
CPC ..... *A63B 22/0005* (2015.10); *A63B 22/0012* (2013.01); *A63B 21/0023* (2013.01); *A63B 21/0421* (2013.01); *A63B 21/0442* (2013.01); *A63B 21/0552* (2013.01); *A63B 22/0089* (2013.01); *A63B 2022/0611* (2013.01); *A63B 2022/0641* (2013.01); *A63B 23/0211* (2013.01); *A63B 23/03525* (2013.01); *A63B 23/0429* (2013.01); *A63B 71/0622* (2013.01); *A63B 2071/0655* (2013.01); *A63B 2208/0204* (2013.01); *A63B 2208/0233* (2013.01); *A63B 2208/0238* (2013.01); *A63B 2220/51* (2013.01); *A63B 2225/09* (2013.01); *A63B 2225/093* (2013.01); *A63B 2225/20* (2013.01); *A63B 2225/50* (2013.01); *A63B 2230/75* (2013.01)

(58) Field of Classification Search
CPC ..... A63B 22/0087; A63B 2022/0094; A63B 2022/0611; A63B 2022/0652; A63B 2225/09; A63B 2225/093; A63B 21/0023; A63B 21/4035; A63B 23/12; A63B 2071/0658; A63B 21/4033; A63B 21/4034; A63B 21/4047; A63B 21/4049; A63B 21/4041; A63B 21/4045; A63B 21/00178; A63B 21/00181; A63B 21/00185; A63B 21/0051; A63B 21/0058; A63B 24/0087; A63B 2220/30; A63B 2220/62; A63B 2220/80; A63B 2220/833; A63B 2225/20; A63B 2225/50; A63B 2230/75; A63B 71/0622; A63B 2071/025; A63B 2208/0228; A63B 2023/003; A63B 2023/006; A63B 2023/0441; A63B 2023/0447; A63B 2023/0452; A63B 21/015; A63B 21/0421; A63B 21/0442; A63B 2/0605; A63B 2/0005; A63B 2/0012; A63B 2/0089; A61H 1/0214; A61H 1/0237; A61H 1/0255; A61H 2201/0192; A61H 2201/12; A61H 2201/1261; A61H 2201/1269; A61H 2201/1635; A61H 2201/0157; A61H 2201/0161; A61H 1/0274–0281
USPC ..... 482/62
See application file for complete search history.

(56) References Cited

U.S. PATENT DOCUMENTS 3,213,852 A 10/1965 Zent
3,572,699 A 3/1971 Nies
4,222,376 A * 9/1980 Praprotnik ..... A61H 1/0214 601/24
4,519,604 A 5/1985 Arzounian
4,538,804 A 9/1985 Zibell
4,572,501 A 2/1986 Durham et al.
4,618,141 A 10/1986 Ashworth
4,824,132 A 4/1989 Moore
4,860,763 A 8/1989 Schminke
5,139,255 A * 8/1992 Sollami ..... A63B 22/001 482/58
5,184,991 A 2/1993 Brangi
5,277,684 A * 1/1994 Harris ..... A63B 23/03533 482/121
5,318,487 A 6/1994 Golen
5,336,147 A * 8/1994 Sweeney, III ..... A63B 22/0012 74/594.1
5,338,272 A * 8/1994 Sweeney, III ..... A63B 22/0005 74/594.1
5,356,356 A 10/1994 Hildebrandt
D359,777 S 6/1995 Hildebrandt
5,447,480 A * 9/1995 Fulks ..... A63B 23/03566 482/99
5,474,083 A 12/1995 Church
5,549,533 A * 8/1996 Olson ..... A63B 21/4031 482/137
5,681,247 A * 10/1997 Webber ..... A63B 21/4047 482/137
5,810,701 A * 9/1998 Ellis ..... A63B 23/12 482/136
5,857,943 A 1/1999 Murray
5,916,065 A * 6/1999 McBride ..... A63B 22/001 482/57
5,938,570 A * 8/1999 Maresh ..... A63B 22/0664 482/57
5,980,431 A 11/1999 Miller
5,997,446 A * 12/1999 Stearns ..... A63B 21/4047 482/56
6,001,046 A 12/1999 Chang
6,004,246 A * 12/1999 Sencil ..... A63B 23/0233 482/145
6,007,459 A 12/1999 Burgess
6,013,007 A 1/2000 Root
6,015,370 A * 1/2000 Pandozy ..... A63B 23/0233 482/142
D421,075 S 2/2000 Hildebrandt
6,036,623 A 3/2000 Mitchell
6,162,189 A 12/2000 Girone et al.
6,336,891 B1 1/2002 Fedrigon
6,347,290 B1 2/2002 Bartlett
6,450,923 B1 9/2002 Vatti
6,514,085 B2 2/2003 Slattery et al.
6,601,016 B1 7/2003 Brown et al.
6,613,000 B1 9/2003 Reinkensmeyer et al.
6,626,800 B1 9/2003 Casler
6,640,122 B2 10/2003 Manoli
6,652,425 B1 * 11/2003 Martin ..... A63B 21/154 482/57
6,902,513 B1 6/2005 McClure
6,902,515 B2 6/2005 Howell et al.
6,960,155 B2 11/2005 Chien
7,022,048 B1 4/2006 Fernandez
7,058,453 B2 6/2006 Nelson et al.
7,063,643 B2 6/2006 Arai
7,270,628 B2 * 9/2007 Campanaro ..... A63B 21/0622 482/141
7,491,154 B2 2/2009 Yonehana
7,510,512 B1 3/2009 Taggett
7,628,730 B1 12/2009 Watterson
D610,635 S 2/2010 Hildebrandt
7,662,070 B1 * 2/2010 Mann ..... A61H 1/0214 482/57
7,713,176 B1 5/2010 Farney
7,736,281 B2 * 6/2010 Corbalis ..... A63B 22/0605 482/57
7,789,800 B1 9/2010 Watterson
7,815,551 B2 10/2010 Merli
7,837,472 B1 11/2010 Elsmore
7,969,315 B1 6/2011 Ross et al.
8,012,107 B2 9/2011 Einav et al.
8,021,270 B2 9/2011 D'Eredita
8,029,415 B2 10/2011 Ashby
8,038,578 B2 10/2011 Olrik et al.
8,113,991 B2 2/2012 Kutliroff
8,113,996 B1 * 2/2012 Allen ..... A63B 22/0005 482/57

(56) References Cited

U.S. PATENT DOCUMENTS 8,177,732 B2 5/2012 Einav et al.
8,298,123 B2 10/2012 Hickman
8,371,990 B2 2/2013 Shea
8,409,060 B2 4/2013 Hsu
8,444,534 B2 5/2013 Mckee
8,515,777 B1 8/2013 Rajasenan
8,607,465 B1 12/2013 Edwards
8,818,496 B2 8/2014 Dziubinski et al.
8,845,493 B2 9/2014 Watterson et al.
8,849,681 B2 9/2014 Hargrove et al.
8,893,287 B2 11/2014 Gjonej et al.
8,911,327 B1 12/2014 Boyette
9,004,598 B2 4/2015 Weber
9,028,368 B2 5/2015 Ashby
9,272,186 B2 3/2016 Reich
9,308,417 B2 4/2016 Grundy
9,474,935 B2 10/2016 Abbondanza et al.
9,486,382 B1 11/2016 Boss
9,514,277 B2 12/2016 Hassing et al.
9,530,325 B2 12/2016 Hall
9,640,057 B1 5/2017 Ross
9,707,147 B2 7/2017 Levital et al.
D794,142 S 8/2017 Zhou
9,757,612 B2 9/2017 Weber
9,802,081 B2 10/2017 Ridgel et al.
9,813,239 B2 11/2017 Chee et al.
9,827,445 B2 11/2017 Marcos et al.
9,849,337 B2 12/2017 Roman et al.
9,868,028 B2 1/2018 Shin
9,925,412 B1 * 3/2018 Lu ..... A63B 22/001
9,977,587 B2 5/2018 Mountain
9,987,188 B1 6/2018 Diao
9,993,181 B2 6/2018 Ross
10,004,946 B2 6/2018 Ross
D826,349 S 8/2018 Oblamski
10,052,518 B2 8/2018 Lagree
10,055,550 B2 8/2018 Goetz
10,058,473 B2 8/2018 Oshima et al.
10,089,443 B2 10/2018 Miller et al.
10,111,643 B2 10/2018 Shulhauser et al.
10,130,311 B1 11/2018 De Sapio et al.
10,137,328 B2 11/2018 Baudhuin
10,143,395 B2 12/2018 Chakravarthy et al.
10,173,094 B2 * 1/2019 Gomberg ..... A63B 69/16
10,173,095 B2 1/2019 Gomberg et al.
10,173,096 B2 1/2019 Gomberg et al.
10,173,097 B2 1/2019 Gomberg et al.
10,198,928 B1 2/2019 Ross et al.
10,226,663 B2 3/2019 Gomberg et al.
10,231,664 B2 3/2019 Ganesh
10,244,990 B2 4/2019 Hu et al.
10,258,823 B2 * 4/2019 Cole ..... A63B 21/0125
10,278,883 B2 5/2019 Walsh
10,369,021 B2 8/2019 Zoss et al.
10,380,866 B1 8/2019 Ross et al.
10,413,238 B1 9/2019 Cooper
D866,957 S 11/2019 Ross et al.
10,468,131 B2 11/2019 Macoviak et al.
10,475,323 B1 11/2019 Ross
10,475,537 B2 11/2019 Purdie et al.
10,492,977 B2 12/2019 Kapure et al.
10,507,358 B2 12/2019 Kinnunen et al.
10,532,000 B1 1/2020 De Sapio
10,532,785 B2 1/2020 Stillman
10,581,896 B2 3/2020 Nachenberg
10,646,746 B1 * 5/2020 Gomberg ..... A63B 23/0476
10,716,969 B2 7/2020 Hoang
D899,605 S 10/2020 Ross et al.
10,867,695 B2 12/2020 Neagle
10,881,911 B2 1/2021 Kwon et al.
10,946,239 B2 3/2021 Berry
10,987,176 B2 4/2021 Poltaretskyi et al.
10,991,463 B2 4/2021 Kutzko et al.
11,065,170 B2 7/2021 Yang et al.
11,093,904 B2 8/2021 Humble
11,179,596 B2 11/2021 Karys
D939,096 S 12/2021 Lee
D939,644 S 12/2021 Ach et al.
D940,891 S 1/2022 Lee
11,278,766 B2 3/2022 Lee
11,298,284 B2 4/2022 Bayerlein
11,311,772 B1 4/2022 Bowers et al.
11,325,005 B2 * 5/2022 Mason ..... G16H 10/60
11,376,470 B2 7/2022 Weldemariam
11,386,176 B2 7/2022 Galitsky
11,422,841 B2 8/2022 Jeong
11,433,276 B2 9/2022 Bissonnette
11,458,354 B2 10/2022 Bissonnette et al.
11,458,363 B2 10/2022 Powers et al.
11,495,355 B2 11/2022 McNutt et al.
11,508,258 B2 11/2022 Nakashima et al.
11,524,210 B2 12/2022 Kim et al.
11,527,326 B2 12/2022 McNair et al.
11,532,402 B2 12/2022 Farley et al.
11,534,654 B2 12/2022 Silcock et al.
D976,339 S 1/2023 Li
11,636,944 B2 4/2023 Hanrahan et al.
11,663,673 B2 5/2023 Pyles
11,701,548 B2 7/2023 Posnack et al.
2001/0011025 A1 8/2001 Ohki
2001/0031685 A1 * 10/2001 Maresh ..... A63B 22/0664 482/52
2001/0044573 A1 11/2001 Manoli
2002/0143279 A1 10/2002 Porter et al.
2002/0183599 A1 12/2002 Castellanos
2003/0013072 A1 1/2003 Thomas
2003/0036683 A1 2/2003 Kehr et al.
2003/0064860 A1 4/2003 Yamashita
2003/0083596 A1 5/2003 Kramer et al.
2003/0139264 A1 * 7/2003 Kuo ..... A63B 24/00 482/57
2004/0023762 A1 * 2/2004 Lull ..... A63B 23/0405 482/99
2004/0067833 A1 * 4/2004 Talish ..... A63B 22/0076 482/148
2004/0110602 A1 6/2004 Feldman
2004/0198561 A1 * 10/2004 Corbalis ..... A63B 22/0605 482/57
2004/0204959 A1 10/2004 Moreano et al.
2004/0248713 A1 * 12/2004 Campanaro ..... A63B 21/068 482/123
2004/0259693 A1 12/2004 Chien
2004/0263473 A1 12/2004 Cho
2005/0101463 A1 * 5/2005 Chen ..... A63B 21/0004 482/142
2005/0115561 A1 6/2005 Stahmann
2006/0058648 A1 3/2006 Meier
2006/0064136 A1 3/2006 Wang
2006/0079817 A1 4/2006 Dewald
2006/0122039 A1 6/2006 Lee et al.
2006/0135325 A1 * 6/2006 Holness ..... A63B 23/0494 482/7
2006/0199700 A1 * 9/2006 LaStayo ..... A63B 22/0007 482/4
2006/0229164 A1 10/2006 Einav
2006/0234834 A1 * 10/2006 Kuo ..... A63B 22/0605 482/57
2006/0252607 A1 * 11/2006 Holloway ..... A63B 21/4049 482/62
2006/0258520 A1 * 11/2006 Bowser ..... A63B 23/03541 482/121
2007/0021277 A1 1/2007 Kuo
2007/0093360 A1 4/2007 Neff
2007/0099766 A1 * 5/2007 Pyles ..... A63B 22/0605 482/57
2007/0118389 A1 5/2007 Shipon
2007/0149364 A1 6/2007 Blau
2007/0184414 A1 8/2007 Perez
2007/0194939 A1 8/2007 Alvarez et al.
2007/0219059 A1 9/2007 Schwartz
2007/0232464 A1 * 10/2007 Chu ..... A63B 21/4047 482/96

(56) References Cited

U.S. PATENT DOCUMENTS

2007/0243980 A1* 10/2007 Bowser ..... A63B 23/03516 482/129
2007/0270295 A1* 11/2007 Balis ..... A63B 26/00 482/142
2007/0271065 A1 11/2007 Gupta et al.
2008/0082356 A1 4/2008 Friedlander et al.
2008/0119333 A1* 5/2008 Bowser ..... A63B 21/156 482/62
2008/0139975 A1 6/2008 Einav
2008/0161733 A1 7/2008 Einav et al.
2008/0214971 A1* 9/2008 Talish ..... A63B 22/0012 601/23
2008/0281633 A1 11/2008 Burdea et al.
2008/0318738 A1 12/2008 Chen
2009/0070138 A1 3/2009 Langheier et al.
2009/0221407 A1* 9/2009 Hauk ..... A63B 21/0615 482/92
2009/0239714 A1* 9/2009 Sellers ..... A63B 22/0605 482/52
2009/0270227 A1 10/2009 Ashby
2009/0287503 A1 11/2009 Angell et al.
2009/0299766 A1 12/2009 Friedlander et al.
2010/0022354 A1 1/2010 Fisher
2010/0029445 A1 2/2010 Lee
2010/0035726 A1 2/2010 Fisher
2010/0035729 A1* 2/2010 Pandozy ..... A63B 21/068 482/148
2010/0076786 A1 3/2010 Dalton et al.
2010/0121160 A1 5/2010 Stark et al.
2010/0152629 A1 6/2010 Haas
2010/0216168 A1 8/2010 Heinzman et al.
2010/0216600 A1* 8/2010 Noffsinger ..... A63B 23/12 482/5
2010/0234184 A1 9/2010 Le Page et al.
2010/0234196 A1* 9/2010 Shinomiya ..... A63B 21/00178 482/142
2010/0261585 A1* 10/2010 Hauk ..... A61H 23/02 482/91
2010/0298102 A1 11/2010 Bosecker et al.
2010/0326207 A1 12/2010 Topel
2010/0331144 A1* 12/2010 Rindfleisch ..... A63B 21/00178 482/4
2011/0010188 A1 1/2011 Yoshikawa et al.
2011/0071003 A1 3/2011 Watterson
2011/0118084 A1 5/2011 Tsai et al.
2011/0118086 A1* 5/2011 Radow ..... A63B 21/00196 482/5
2011/0119212 A1 5/2011 De Bruin et al.
2011/0165995 A1* 7/2011 Paulus ..... A63B 21/153 482/5
2011/0172058 A1* 7/2011 Deaconu ..... A63B 24/0087 482/5
2011/0195819 A1* 8/2011 Shaw ..... A63B 24/0087 482/5
2011/0256983 A1 10/2011 Malack
2011/0275486 A1 11/2011 Hsu
2011/0306846 A1 12/2011 Osorio
2012/0004932 A1 1/2012 Sorkey et al.
2012/0040799 A1* 2/2012 Jaquish ..... A63B 23/0355 482/9
2012/0041771 A1 2/2012 Cosentino et al.
2012/0053028 A1* 3/2012 Campanaro ..... A63B 23/0205 482/131
2012/0190502 A1* 7/2012 Paulus ..... A63B 24/0062 482/5
2012/0220427 A1 8/2012 Ashby
2012/0232438 A1 9/2012 Cataldi et al.
2012/0238411 A1* 9/2012 McBride ..... A63B 22/0005 482/57
2012/0238413 A1* 9/2012 McBride ..... A63B 22/0605 482/62
2012/0259648 A1 10/2012 Mallon et al.
2012/0296455 A1 11/2012 Ohnemus et al.
2012/0323346 A1 12/2012 Ashby
2013/0029808 A1 1/2013 Kuo
2013/0029809 A1* 1/2013 Spevak ..... A63B 23/0211 482/63
2013/0116094 A1 5/2013 Chen
2013/0211281 A1 8/2013 Ross et al.
2013/0253943 A1 9/2013 Lee et al.
2013/0274069 A1 10/2013 Watterson et al.
2013/0324376 A1* 12/2013 Colby ..... A63B 21/4035 482/112
2013/0331741 A1* 12/2013 Kuro ..... A63B 23/03508 601/24
2013/0332616 A1 12/2013 Landwehr
2013/0338549 A1* 12/2013 Korenaga ..... A61H 99/00 601/33
2013/0345604 A1 12/2013 Nakamura
2014/0031173 A1 1/2014 Huang
2014/0089836 A1 3/2014 Damani et al.
2014/0113768 A1 4/2014 Lin et al.
2014/0113776 A1 4/2014 Jaguan
2014/0172442 A1 6/2014 Broderick
2014/0087341 A1 7/2014 Hall
2014/0195103 A1 7/2014 Nassef
2014/0228649 A1 8/2014 Rayner et al.
2014/0243160 A1 8/2014 Lim
2014/0274564 A1 9/2014 Greenbaum
2014/0303540 A1 10/2014 Baym
2014/0330186 A1 11/2014 Hyde
2014/0371816 A1 12/2014 Matos
2015/0025816 A1 1/2015 Ross
2015/0065303 A1 3/2015 Born
2015/0065305 A1 3/2015 Dalton
2015/0073814 A1 3/2015 Linebaugh
2015/0094192 A1 4/2015 Skwortsow et al.
2015/0099458 A1 4/2015 Weisner et al.
2015/0099952 A1 4/2015 Lain et al.
2015/0112230 A1 4/2015 Iglesias
2015/0130830 A1 5/2015 Nagasaki
2015/0141200 A1 5/2015 Murray et al.
2015/0149217 A1 5/2015 Kaburagi
2015/0165263 A1 6/2015 Golen
2015/0196805 A1 7/2015 Koduri
2015/0238817 A1 8/2015 Watterson
2015/0257679 A1 9/2015 Ross
2015/0258365 A1 9/2015 Neill et al.
2015/0265209 A1 9/2015 Zhang
2015/0273267 A1* 10/2015 Manzke ..... A63B 21/012 482/57
2015/0328496 A1 11/2015 Eder
2015/0351664 A1 12/2015 Ross
2015/0351665 A1 12/2015 Ross
2015/0360069 A1 12/2015 Marti et al.
2015/0379430 A1 12/2015 Dirac et al.
2016/0045170 A1 2/2016 Migita
2016/0082311 A1* 3/2016 Massaro ..... A63B 22/0002 482/63
2016/0096073 A1 4/2016 Rahman et al.
2016/0136483 A1 5/2016 Reich
2016/0140319 A1 5/2016 Stark
2016/0143593 A1 5/2016 Fu et al.
2016/0166833 A1 6/2016 Bum
2016/0166881 A1 6/2016 Ridgel et al.
2016/0184634 A1 6/2016 Yanev
2016/0193306 A1 7/2016 Rabovsky et al.
2016/0213924 A1 7/2016 Coleman
2016/0220867 A1 8/2016 Flaherty
2016/0271438 A1 9/2016 Weisz
2016/0271452 A1 9/2016 Lagree
2016/0287166 A1 10/2016 Tran
2016/0317860 A1 11/2016 Baudhuin et al.
2016/0354636 A1 12/2016 Jang
2016/0373477 A1 12/2016 Moyle
2017/0003311 A1 1/2017 Lay
2017/0004260 A1 1/2017 Moturu et al.
2017/0021827 A1 1/2017 Seagraves
2017/0036055 A1 2/2017 Fleming
2017/0065849 A1 3/2017 Konishi
2017/0065873 A1 3/2017 Hall
2017/0100628 A1* 4/2017 Wilt ..... A63B 24/0087

(56) References Cited

U.S. PATENT DOCUMENTS

2017/0100637 A1 4/2017 Princen et al.
2017/0132947 A1 5/2017 Maeda et al.
2017/0136295 A1* 5/2017 Tholkes ..... A61B 5/4566
2017/0144008 A1* 5/2017 Brown ..... A63B 3/00
2017/0147752 A1 5/2017 Toru
2017/0148297 A1 5/2017 Ross
2017/0172466 A1 6/2017 Eriksson
2017/0202724 A1 7/2017 De Rossi
2017/0220751 A1 8/2017 Davis
2017/0235882 A1 8/2017 Orlov et al.
2017/0235906 A1 8/2017 Dorris et al.
2017/0262604 A1 9/2017 Francois
2017/0270260 A1 9/2017 Shetty
2017/0283508 A1 10/2017 Demopulos et al.
2017/0286621 A1 10/2017 Cox
2017/0304024 A1 10/2017 Nobrega
2017/0323481 A1 11/2017 Tran et al.
2017/0329933 A1 11/2017 Brust
2017/0347923 A1 12/2017 Roh
2017/0361165 A1 12/2017 Miller
2018/0001181 A1 1/2018 Prellwitz et al.
2018/0036593 A1 2/2018 Ridgel et al.
2018/0060494 A1 3/2018 Dias et al.
2018/0064991 A1 3/2018 Yanev
2018/0071572 A1* 3/2018 Gomberg ..... A63B 22/0015
2018/0096111 A1 4/2018 Wells et al.
2018/0104543 A1* 4/2018 Watterson ..... A63B 21/00192
2018/0111034 A1 4/2018 Watterson
2018/0140927 A1 5/2018 Kito
2018/0146870 A1 5/2018 Shemesh
2018/0154204 A1* 6/2018 Bayerlein ..... A61H 1/0277
2018/0154240 A1 6/2018 Hall
2018/0177447 A1* 6/2018 Herrala ..... A61B 5/222
2018/0177612 A1 6/2018 Trabish et al.
2018/0177664 A1 6/2018 Choi et al.
2018/0178059 A1 6/2018 Hyungsoon et al.
2018/0228682 A1* 8/2018 Bayerlein ..... A63B 21/00181
2018/0236307 A1 8/2018 Hyde et al.
2018/0263535 A1 9/2018 Cramer
2018/0263552 A1 9/2018 Graman et al.
2018/0264312 A1 9/2018 Pompile et al.
2018/0272184 A1* 9/2018 Vassilaros ..... B62M 3/02
2018/0296143 A1 10/2018 Anderson et al.
2018/0326242 A1* 11/2018 Jaquish ..... A63B 21/00069
2018/0326243 A1 11/2018 Badi et al.
2018/0330810 A1 11/2018 Gamarnik
2018/0290017 A1 12/2018 Fung
2018/0353812 A1 12/2018 Lannon et al.
2018/0369644 A1* 12/2018 Slobodnik ..... A63B 23/1209
2019/0009135 A1 1/2019 Wu
2019/0019163 A1 1/2019 Batey et al.
2019/0019573 A1 1/2019 Lake et al.
2019/0046794 A1 2/2019 Goodall et al.
2019/0060699 A1* 2/2019 Frederick ..... A63B 23/1281
2019/0080802 A1 3/2019 Ziobro et al.
2019/0090744 A1 3/2019 Mahfouz
2019/0118038 A1 4/2019 Tana et al.
2019/0183715 A1 6/2019 Kapure et al.
2019/0192912 A1* 6/2019 Hwang ..... G16H 40/63
2019/0223797 A1 7/2019 Tran
2019/0228856 A1 7/2019 Leifer
2019/0247718 A1* 8/2019 Blevins ..... G06F 16/2379
2019/0251456 A1 8/2019 Constantin
2019/0262084 A1 8/2019 Roh
2019/0262655 A1* 8/2019 Lentine ..... A63B 22/001
2019/0275368 A1 9/2019 Maroldi
2019/0282857 A1 9/2019 Hapola
2019/0290965 A1 9/2019 Oren
2019/0308054 A1* 10/2019 Borisoff ..... A63B 21/4015
2019/0314681 A1 10/2019 Yang
2019/0336815 A1* 11/2019 Hsu ..... A63B 22/0046
2019/0344123 A1 11/2019 Rubin et al.
2019/0362242 A1 11/2019 Pillai et al.
2020/0006639 A1 1/2020 Wu et al.
2020/0038703 A1 2/2020 Cleary et al.
2020/0085300 A1 3/2020 Kwatra et al.
2020/0086163 A1 3/2020 Karys
2020/0114207 A1 4/2020 Weldemariam
2020/0151595 A1 5/2020 Jayalath et al.
2020/0237291 A1 7/2020 Raja
2020/0276470 A1* 9/2020 Howett ..... A63B 22/205
2020/0303063 A1 9/2020 Sharma et al.
2020/0365256 A1 11/2020 Hayashitani et al.
2020/0410385 A1 12/2020 Otsuki
2020/0410893 A1 12/2020 Ridington
2020/0411162 A1 12/2020 Lien et al.
2021/0005224 A1 1/2021 Rothschild et al.
2021/0005319 A1 1/2021 Otsuki et al.
2021/0035674 A1 2/2021 Volosin et al.
2021/0046373 A1 2/2021 Smith
2021/0093912 A1* 4/2021 Davis ..... A63B 21/4047
2021/0113877 A1* 4/2021 Chin ..... A63B 21/154
2021/0245003 A1 8/2021 Turner
2021/0251562 A1 8/2021 Jain
2021/0268335 A1* 9/2021 Mizukura ..... A63B 21/002
2021/0272677 A1 9/2021 Barbee
2021/0338469 A1 11/2021 Dempers
2021/0343384 A1 11/2021 Purushothaman et al.
2021/0361514 A1 11/2021 Choi et al.
2021/0398668 A1 12/2021 Chock et al.
2022/0000556 A1 1/2022 Casey et al.
2022/0001232 A1 1/2022 DeForest
2022/0016480 A1 1/2022 Bissonnette et al.
2022/0016482 A1 1/2022 Bissonnette
2022/0016485 A1 1/2022 Bissonnette et al.
2022/0016486 A1 1/2022 Bissonnette
2022/0020469 A1 1/2022 Tanner
2022/0044806 A1 2/2022 Sanders et al.
2022/0072362 A1* 3/2022 Hopson ..... A63B 21/4035
2022/0080265 A1 3/2022 Watterson
2022/0105390 A1 4/2022 Yuasa
2022/0118218 A1 4/2022 Bense et al.
2022/0133576 A1 5/2022 Choi et al.
2022/0176039 A1 6/2022 Lintereur et al.
2022/0181004 A1 6/2022 Zilca et al.
2022/0238222 A1 7/2022 Neuberg
2022/0262504 A1 8/2022 Bratty et al.
2022/0266094 A1 8/2022 Mason et al.
2022/0273985 A1 9/2022 Jeong et al.
2022/0300787 A1 9/2022 Wall et al.
2022/0304881 A1 9/2022 Choi et al.
2022/0304882 A1 9/2022 Choi
2022/0305328 A1 9/2022 Choi et al.
2022/0323826 A1 10/2022 Khurana
2022/0327714 A1 10/2022 Cook et al.
2022/0327807 A1 10/2022 Cook et al.
2022/0330823 A1 10/2022 Janssen
2022/0338761 A1 10/2022 Maddahi et al.
2022/0339052 A1 10/2022 Kim
2022/0395232 A1 12/2022 Locke
2022/0401783 A1 12/2022 Choi
2022/0415469 A1 12/2022 Mason
2022/0415471 A1 12/2022 Mason
2023/0001268 A1 1/2023 Bissonnette et al.
2023/0013530 A1 1/2023 Mason
2023/0014598 A1 1/2023 Mason et al.
2023/0029639 A1 2/2023 Roy
2023/0048040 A1 2/2023 Hacking et al.
2023/0051751 A1 2/2023 Hacking et al.
2023/0058605 A1 2/2023 Mason
2023/0060039 A1 2/2023 Mason
2023/0072368 A1 3/2023 Mason
2023/0078793 A1 3/2023 Mason
2023/0119461 A1 4/2023 Mason
2023/0190100 A1 6/2023 Stump
2023/0201656 A1 6/2023 Hacking et al.
2023/0207097 A1 6/2023 Mason
2023/0207124 A1 6/2023 Walsh et al.
2023/0215539 A1 7/2023 Rosenberg et al.
2023/0215552 A1 7/2023 Khotilovich et al.
2023/0245747 A1 8/2023 Rosenberg et al.
2023/0245748 A1 8/2023 Rosenberg et al.
2023/0245750 A1 8/2023 Rosenberg et al.
2023/0245751 A1 8/2023 Rosenberg et al.

(56) References Cited

U.S. PATENT DOCUMENTS

| | | | |
|---|---|---|---|
| 2023/0253089 | A1 | 8/2023 | Rosenberg et al. |
| 2023/0255555 | A1 | 8/2023 | Sundaram et al. |
| 2023/0263428 | A1 | 8/2023 | Hull et al. |
| 2023/0274813 | A1 | 8/2023 | Rosenberg et al. |
| 2023/0282329 | A1 | 9/2023 | Mason et al. |
| 2023/0364472 | A1 | 11/2023 | Posnack |
| 2023/0368886 | A1 | 11/2023 | Rosenberg |
| 2023/0377711 | A1 | 11/2023 | Rosenberg |
| 2023/0377712 | A1 | 11/2023 | Rosenberg |
| 2023/0386639 | A1 | 11/2023 | Rosenberg |
| 2023/0395231 | A1 | 12/2023 | Rosenberg |
| 2023/0395232 | A1 | 12/2023 | Rosenberg |
| 2024/0029856 | A1 | 1/2024 | Rosenberg |

FOREIGN PATENT DOCUMENTS

| | | | |
|---|---|---|---|
| CN | 101964151 | A | 2/2011 |
| CN | 201889024 | U | 7/2011 |
| CN | 102670381 | A | 9/2012 |
| CN | 103263336 | A | 8/2013 |
| CN | 103390357 | A | 11/2013 |
| CN | 103473631 | A | 12/2013 |
| CN | 103501328 | A | 1/2014 |
| CN | 103721343 | A | 4/2014 |
| CN | 203677851 | U | 7/2014 |
| CN | 103136447 | | 8/2016 |
| CN | 205626871 | U | 10/2016 |
| CN | 106236502 | A | 12/2016 |
| CN | 106621195 | A | 5/2017 |
| CN | 107551475 | A | 1/2018 |
| CN | 107930021 | A | 4/2018 |
| CN | 208224811 | A | 12/2018 |
| CN | 109191954 | A | 1/2019 |
| CN | 109363887 | A | 2/2019 |
| CN | 110201358 | A | 9/2019 |
| CN | 110322957 | A | 10/2019 |
| CN | 110808092 | A | 2/2020 |
| CN | 110931103 | A | 3/2020 |
| CN | 110993057 | A | 4/2020 |
| CN | 111111110 | A | 5/2020 |
| CN | 111460305 | A | 7/2020 |
| CN | 111790111 | A | 10/2020 |
| CN | 112071393 | A | 12/2020 |
| CN | 212141371 | U | 12/2020 |
| CN | 112289425 | A | 1/2021 |
| CN | 212624809 | U | 2/2021 |
| CN | 213190965 | U | 5/2021 |
| CN | 113384850 | A | 9/2021 |
| CN | 113499572 | A | 10/2021 |
| CN | 215136488 | U | 12/2021 |
| CN | 113885361 | A | 1/2022 |
| CN | 114049961 | A | 2/2022 |
| CN | 114203274 | | 3/2022 |
| CN | 114203274 | A | 3/2022 |
| CN | 216258145 | U | 4/2022 |
| CN | 114632302 | A | 6/2022 |
| CN | 114694824 | A | 7/2022 |
| CN | 114898832 | | 8/2022 |
| CN | 114898832 | A | 8/2022 |
| CN | 114983760 | A | 9/2022 |
| CN | 217472652 | U | 9/2022 |
| CN | 110270062 | | 10/2022 |
| CN | 218420859 | U | 2/2023 |
| CN | 115954081 | A | 4/2023 |
| EP | 0383137 | A2 | 8/1990 |
| EP | 1159989 | A1 | 12/2001 |
| EP | 1391179 | A1 | 2/2004 |
| EP | 1968028 | | 9/2008 |
| EP | 1909730 | B1 | 4/2014 |
| EP | 2815242 | A4 | 12/2014 |
| EP | 2869805 | A | 5/2015 |
| EP | 2997951 | A1 | 3/2016 |
| EP | 2688472 | B1 | 4/2016 |
| EP | 3671700 | A1 | 6/2020 |
| EP | 3984508 | A1 | 4/2022 |
| EP | 3984509 | A1 | 4/2022 |
| EP | 3984510 | A1 | 4/2022 |
| EP | 3984511 | A1 | 4/2022 |
| EP | 3984512 | A1 | 4/2022 |
| EP | 3984513 | A1 | 4/2022 |
| EP | 4054699 | A1 | 9/2022 |
| EP | 4112033 | A1 | 1/2023 |
| FR | 3127393 | A1 | 3/2023 |
| GB | 2512431 | A | 10/2014 |
| GB | 2591542 | B | 3/2022 |
| IN | 201811043670 | A | 7/2018 |
| JP | 2000005339 | A | 1/2000 |
| JP | 2005227928 | A | 8/2005 |
| JP | 2005227928 | A1 | 8/2005 |
| JP | 2009112336 | A | 5/2009 |
| JP | 3193662 | U | 10/2014 |
| JP | 5804063 | B2 | 11/2015 |
| JP | 2018102842 | A | 7/2018 |
| JP | 2019028647 | A | 2/2019 |
| JP | 6871379 | B2 | 5/2021 |
| JP | 2022521378 | A | 4/2022 |
| JP | 3238491 | U | 7/2022 |
| JP | 7198364 | B2 | 12/2022 |
| JP | 7202474 | B2 | 1/2023 |
| JP | 7231750 | B2 | 3/2023 |
| JP | 7231751 | B2 | 3/2023 |
| JP | 7231752 | B2 | 3/2023 |
| KR | 200276919 | Y1 | 5/2002 |
| KR | 100582596 | B1 | 5/2006 |
| KR | 101042258 | B1 | 6/2011 |
| KR | 101258250 | B1 | 4/2013 |
| KR | 101325581 | B1 | 11/2013 |
| KR | 20140128630 | A | 11/2014 |
| KR | 20150078191 | A | 7/2015 |
| KR | 101580071 | B1 | 12/2015 |
| KR | 101647620 | B1 | 8/2016 |
| KR | 20180004928 | A | 1/2018 |
| KR | 20190029175 | A | 3/2019 |
| KR | 101969392 | B1 | 8/2019 |
| KR | 102055279 | B1 | 12/2019 |
| KR | 102088333 | B1 | 3/2020 |
| KR | 20200029180 | A | 3/2020 |
| KR | 102121586 | B1 | 6/2020 |
| KR | 20200119665 | A | 10/2020 |
| KR | 102246049 | B1 | 4/2021 |
| KR | 102246050 | B1 | 4/2021 |
| KR | 102246051 | B1 | 4/2021 |
| KR | 102246052 | B1 | 4/2021 |
| KR | 20210052028 | A | 5/2021 |
| KR | 102352602 | B1 | 1/2022 |
| KR | 102352603 | B1 | 1/2022 |
| KR | 102352604 | B1 | 1/2022 |
| KR | 20220004639 | A | 1/2022 |
| KR | 102387577 | B1 | 4/2022 |
| KR | 102421437 | B1 | 7/2022 |
| KR | 20220102207 | A | 7/2022 |
| KR | 102427545 | B1 | 8/2022 |
| KR | 102467495 | B1 | 11/2022 |
| KR | 102467496 | B1 | 11/2022 |
| KR | 102469723 | B1 | 11/2022 |
| KR | 102471990 | B1 | 11/2022 |
| KR | 20220145989 | A | 11/2022 |
| KR | 20220156134 | A | 11/2022 |
| KR | 102502744 | B1 | 2/2023 |
| KR | 20230019349 | A | 2/2023 |
| KR | 20230019350 | A | 2/2023 |
| KR | 20230026556 | A | 2/2023 |
| KR | 20230026668 | A | 2/2023 |
| KR | 20230040526 | | 3/2023 |
| KR | 20230050506 | A | 4/2023 |
| KR | 20230056118 | A | 4/2023 |
| KR | 102528503 | B1 | 5/2023 |
| KR | 102531930 | B1 | 5/2023 |
| KR | 102532766 | B1 | 5/2023 |
| KR | 102539190 | B1 | 6/2023 |
| RU | 2014131288 | A | 2/2016 |
| RU | 2607953 | C2 | 1/2017 |
| TW | 200910231 | A | 3/2009 |
| TW | M474545 | U | 3/2014 |

(56) References Cited

FOREIGN PATENT DOCUMENTS

| | | | |
|---|---|---|---|
| TW | 201531278 | A | 8/2015 |
| TW | M638437 | U | 3/2023 |
| WO | 2001056465 | A1 | 8/2001 |
| WO | 02062211 | A2 | 8/2002 |
| WO | 02093312 | A2 | 11/2002 |
| WO | 2005018453 | A1 | 3/2005 |
| WO | 2007102709 | A1 | 9/2007 |
| WO | 2009008968 | A1 | 1/2009 |
| WO | 2011025322 | A2 | 3/2011 |
| WO | 2012128801 | A1 | 9/2012 |
| WO | 2013002568 | A2 | 1/2013 |
| WO | 2023164292 | A1 | 3/2013 |
| WO | 2013122839 | A1 | 8/2013 |
| WO | 2014011447 | A1 | 1/2014 |
| WO | 2014163976 | A1 | 10/2014 |
| WO | WO 2015112945 | A1 * | 1/2015 |
| WO | 2015026744 | A1 | 2/2015 |
| WO | 2015065298 | A1 | 5/2015 |
| WO | 2015082555 | A1 | 6/2015 |
| WO | 2015112945 | A1 | 7/2015 |
| WO | 2017030781 | A1 | 2/2017 |
| WO | 2017166074 | A1 | 5/2017 |
| WO | 2017091691 | A1 | 6/2017 |
| WO | 2017165238 | A1 | 9/2017 |
| WO | 2018081795 | A1 | 5/2018 |
| WO | 2019075185 | | 4/2019 |
| WO | 2019143940 | A1 | 7/2019 |
| WO | 2020229705 | A1 | 11/2020 |
| WO | 2021022003 | A1 | 2/2021 |
| WO | 2021090267 | A1 | 5/2021 |
| WO | 2022047006 | A1 | 3/2022 |
| WO | 2022092493 | A1 | 5/2022 |
| WO | 2022092494 | A1 | 5/2022 |
| WO | 2022212883 | A1 | 10/2022 |
| WO | 2022212921 | A1 | 10/2022 |
| WO | 2023008680 | A1 | 2/2023 |
| WO | 2023008681 | A1 | 2/2023 |
| WO | 2023022319 | A1 | 2/2023 |
| WO | 2023022320 | A1 | 2/2023 |
| WO | 2023052695 | A1 | 4/2023 |
| WO | 2023091496 | A1 | 5/2023 |
| WO | 2023215155 | A1 | 11/2023 |
| WO | 2023230075 | A1 | 11/2023 |

OTHER PUBLICATIONS

Jeong et al., "Computer-assisted upper extremity training using interactive biking exercise (iBikE) platform," Sep. 2012, pp. 1-5, 34th Annual International Conference of the IEEE EMBS.

U.S. Appl. No. 16/812,462, filed Mar. 9, 2020, and titled "System, Method and Apparatus for Adjustable Pedal Crank", by Peter Arn, et al.

U.S. Appl. No. 16/813,158, filed Mar. 9, 2020, and titled "System, Method and Apparatus for a Rehabilitation Machine With a Simulated Flywheel", by S. Adam Hacking, et al.

U.S. Appl. No. 16/813,303, filed Mar. 9, 2020, and titled "Control System for a Rehabilitation and Exercise Electromechanical Device", by S. Adam Hacking, et al.

U.S. Appl. No. 16/813,224, filed Mar. 9, 2020, and titled "System, Method and Apparatus for Electrically Actuated Pedal for an Exercise or Rehabilitation Machine", by S. Adam Hacking, et al.

International Search Report and Written Opinion for PCT/US2023/014137, dated Jun. 9, 2023, 13 pages.

Website for "Esino 2022 Physical Therapy Equipments Arm Fitness Indoor Trainer Leg Spin Cycle Machine Exercise Bike for Elderly," https://www.made-in-china.com/showroom/esinogroup/product-detailYdZtwGhCMKVR/China-Esino-2022-Physical-Therapy-Equipments-Arm-Fitness-Indoor-Trainer-Leg-Spin-Cycle-Machine-Exercise-Bike-for-Elderly.html, retrieved on Aug. 29, 2023, 5 pages.

Abedtash, "An Interoperable Electronic Medical Record-Based Platform For Personalized Predictive Analytics", ProQuest LLC, Jul. 2017, 185 pages.

Alcaraz et al., "Machine Learning as Digital Therapy Assessment for Mobile Gait Rehabilitation," 2018 IEEE 28th International Workshop on Machine Learning for Signal Processing (MLSP), Aalborg, Denmark, 2018, 6 pages.

Androutsou et al., "A Smartphone Application Designed to Engage the Elderly in Home-Based Rehabilitation," Frontiers in Digital Health, Sep. 2020, vol. 2, Article 15, 13 pages.

Silva et al., "SapoFitness: A mobile health application for dietary evaluation," 2011 IEEE 13th International Conference on U e-Health Networking, Applications and Services, Columbia, MO, USA, 2011, 6 pages.

Wang et al., "Interactive wearable systems for upper body rehabilitation: a systematic review," Journal of NeuroEngineering and Rehabilitation, 2017, 21 pages.

Marzolini et al., "Eligibility, Enrollment, and Completion of Exercise-Based Cardiac Rehabilitation Following Stroke Rehabilitation: What Are the Barriers?," Physical Therapy, vol. 100, No. 1, 2019, 13 pages.

Nijjar et al., "Randomized Trial of Mindfulness-Based Stress Reduction in Cardiac Patients Eligible for Cardiac Rehabilitation," Scientific Reports, 2019, 12 pages.

Lara et al., "Human-Robot Sensor Interface for Cardiac Rehabilitation," IEEE International Conference on Rehabilitation Robotics, Jul. 2017, 8 pages.

Ishraque et al., "Artificial Intelligence-Based Rehabilitation Therapy Exercise Recommendation System," 2018 IEEE MIT Undergraduate Research Technology Conference (URTC), Cambridge, MA, USA, 2018, 5 pages.

Zakari et al., "Are There Limitations to Exercise Benefits in Peripheral Arterial Disease?," Frontiers in Cardiovascular Medicine, Nov. 2018, vol. 5, Article 173, 12 pages.

You et al., "Including Blood Vasculature into a Game-Theoretic Model of Cancer Dynamics," Games 2019, 10, 13, 22 pages.

Jeong et al., "Computer-assisted upper extremity training using interactive biking exercise (iBikE) platform," Sep. 2012, 34th Annual International Conference of the IEEE EMBS, 5 pages.

Gerbild et al., "Physical Activity to Improve Erectile Dysfunction: A Systematic Review of Intervention Studies," Sexual Medicine, 2018, 15 pages.

Chrif et al., "Control design for a lower-limb paediatric therapy device using linear motor technology," Article, 2017, pp. 119-127, Science Direct, Switzerland.

Robben et al., "Delta Features From Ambient Sensor Data are Good Predictors of Change in Functional Health," Article, 2016, pp. 2168-2194, vol. 21, No. 4, IEEE Journal of Biomedical and Health Informatics.

Kantoch et al., "Recognition of Sedentary Behavior by Machine Learning Analysis of Wearable Sensors during Activities of Daily Living for Telemedical Assessment of Cardiovascular Risk," Article, 2018, 17 pages, Sensors, Poland.

Warburton et al., "International Launch of the PAR-•Q+ and ePARmed-•X+ Validation of the PAR-•Q+ and ePARmed••X+," Health & Fitness Journal of Canada, 2011, 9 pages, vol. 4, No. 2.

* cited by examiner

SYSTEM, METHOD AND APPARATUS FOR REHABILITATION AND EXERCISE

This application claims priority to and the benefit of U.S. Prov. Pat. App. No. 62/846,434, filed May 10, 2019, and U.S. Prov. Pat. App. No. 62/858,244, filed Jun. 6, 2019, each of which is incorporated herein by reference in its entirety.

BACKGROUND

Technical Field

This disclosure generally relates to exercise and, in particular, to a system, method and apparatus for a rehabilitation and exercise device.

Description of the Related Art

Devices rehabilitating and exercising a user can be used to facilitate osteogenesis and muscle hypertrophy. Such machines typically provide for one type of static or dynamic activity for a user to facilitate osteogenesis and muscle hypertrophy. For users with limited mobility, moving between different machines that facilitate only one type of activity can present challenges that limit the ability of the user to rehabilitate and exercise.

With osteogenic activity a user may perform an exercise (e.g., bench press, pull down, arm curl, etc.) using equipment to improve osteogenesis, bone growth, bone density, muscular hypertrophy, or some combination thereof. Such equipment may include non-movable portions to which the user exerts a load. For example, to perform some exercises, the user may position themselves on or adjacent the machine, and apply force to the machine while the body of the user remains in the same position. Although conventional solutions are workable, improvements continue to be of interest.

SUMMARY

Embodiments of a rehabilitation and exercise system can include a base. A static device can be coupled to the base and configured to provide isometric exercise for a user by receiving static force from the user to facilitate at least one of osteogenesis or muscle hypertrophy for the user. In addition, a dynamic device can be coupled to the base and configured to provide a dynamic exercise for the user by being moved by the user to facilitate at least one of osteogenesis and muscle hypertrophy for the user.

Other areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations. The drawings are not intended to limit the scope of the present disclosure. For a detailed description of example embodiments, reference will now be made to the accompanying drawings, in which.

NOTATION AND NOMENCLATURE

Figure 1:
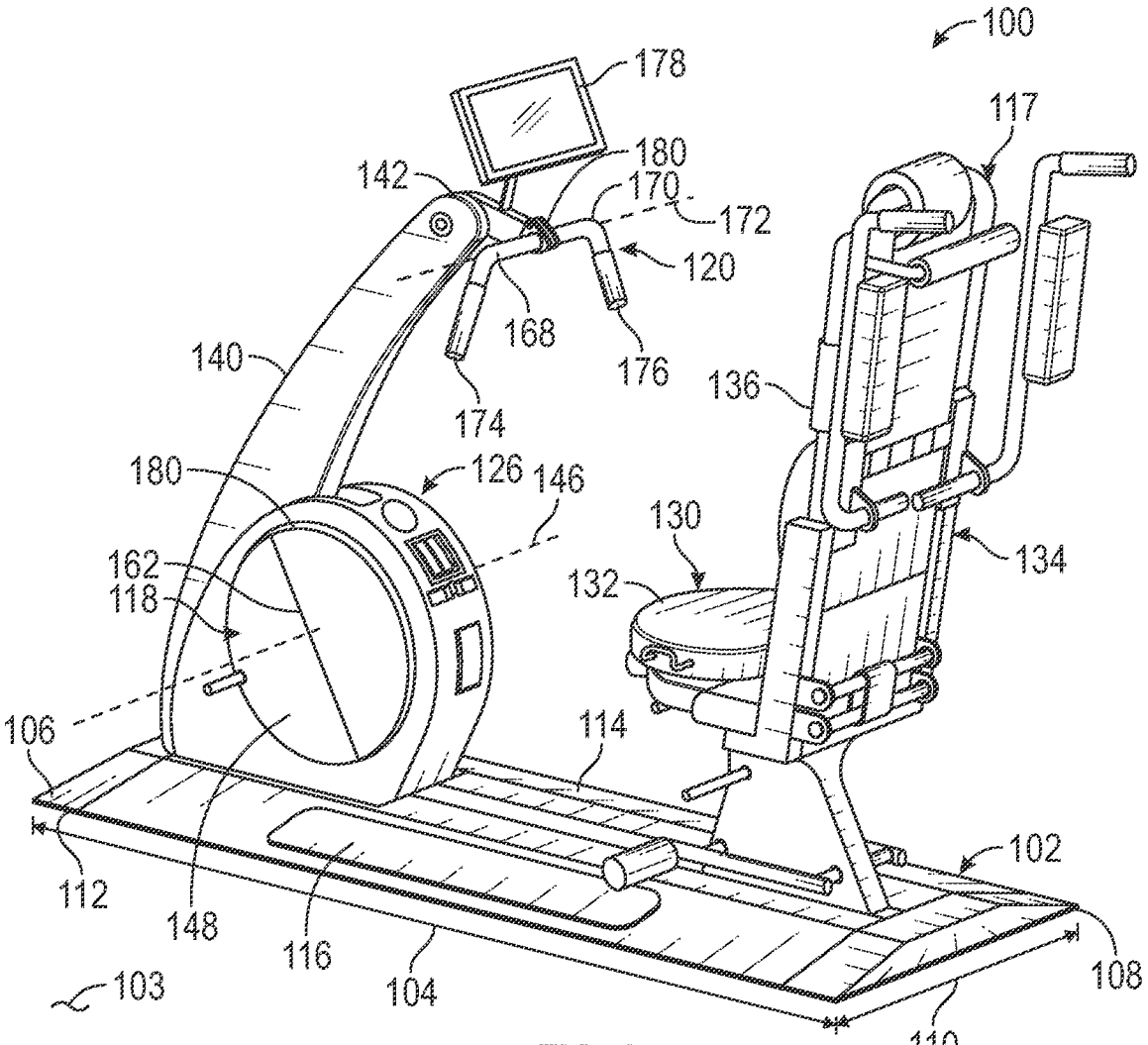
FIGS. 1-4 illustrate a first exemplary embodiment of an exercise machine, according to aspects of the disclosure.
Figure 2:
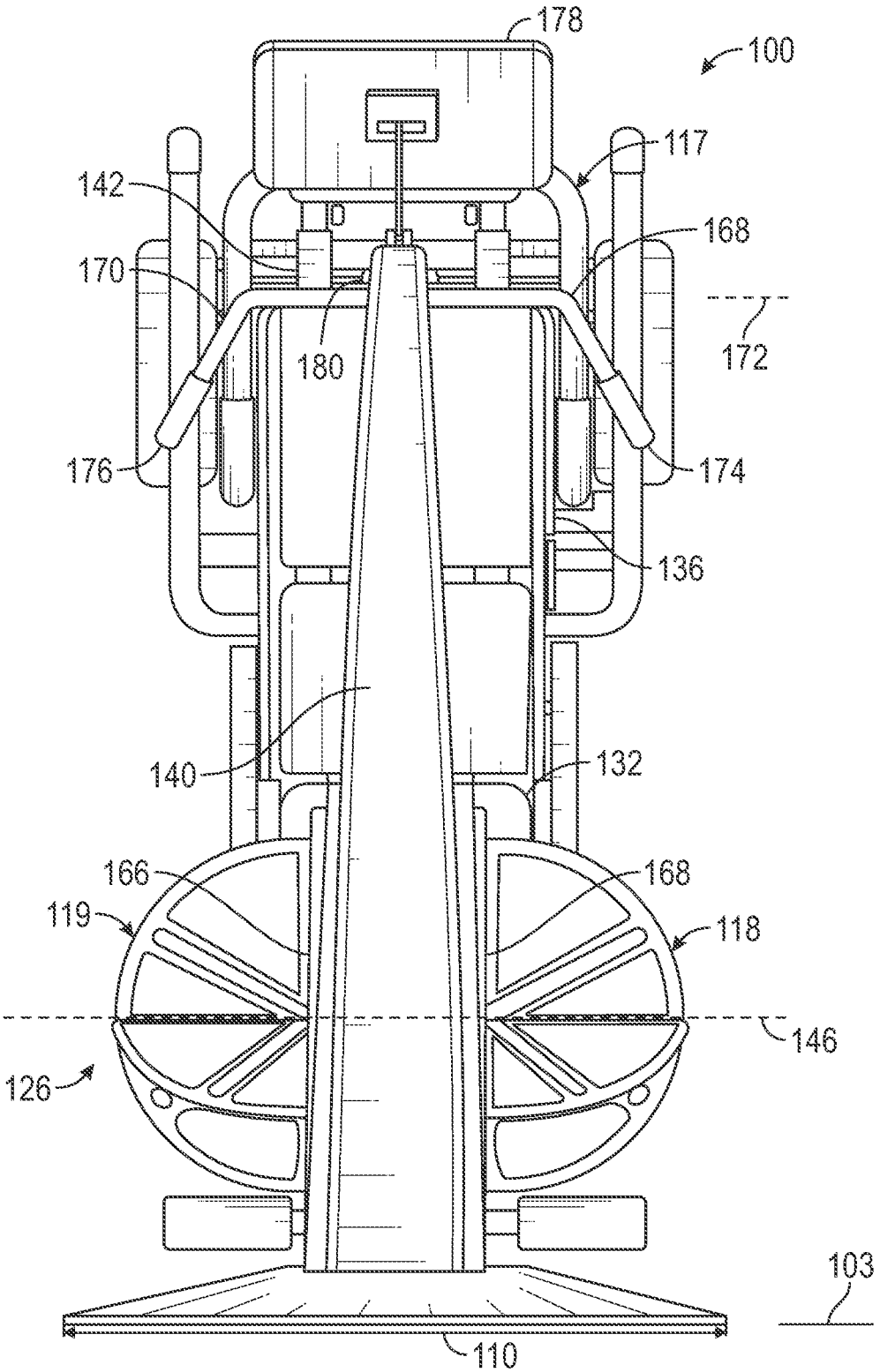
Figure 3:
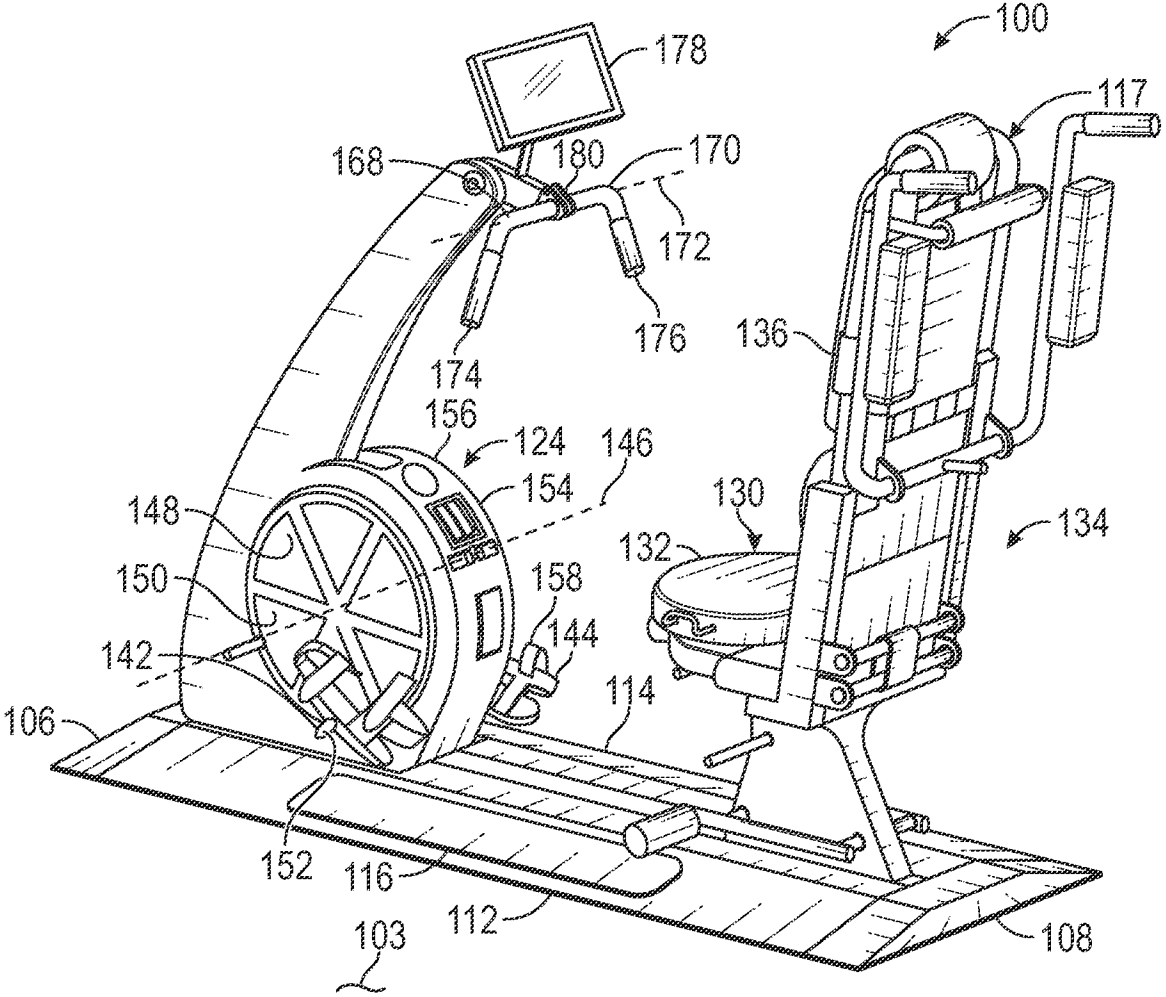
Figure 4:
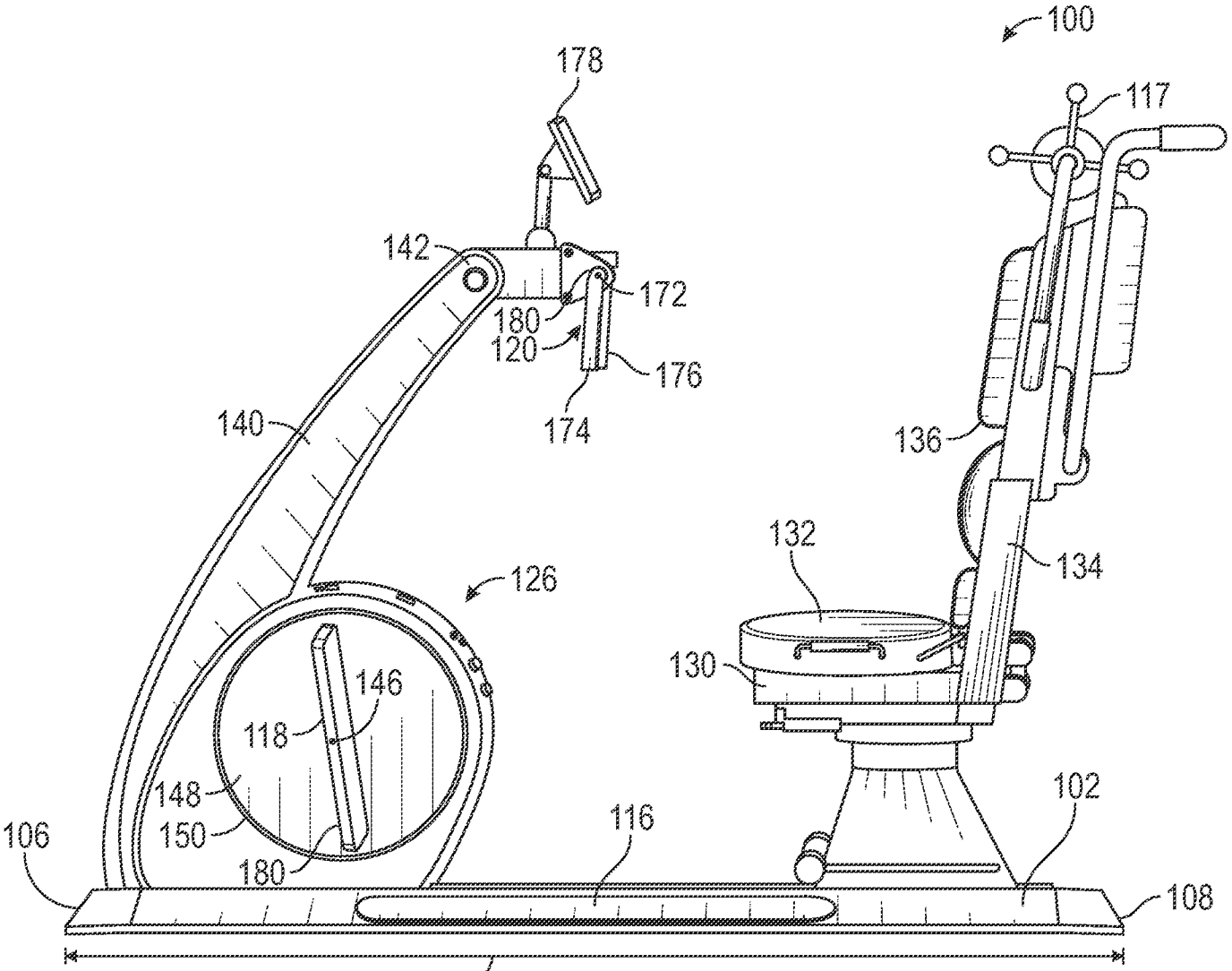

Various terms are used to refer to particular system components. Different entities may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

DETAILED DESCRIPTION

The subject matter of each of U.S. Pat. No. 10,226,663, issued Mar. 12, 2019; U.S. Pat. No. 10,173,094, issued Jan. 8, 2019; U.S. Pat. No. 10,173,095, issued Jan. 8, 2019; U.S. Pat. No. 10,173,096, issued Jan. 8, 2019; and U.S. Pat. No. 10,173,097, issued Jan. 8, 2019; and U.S. pending patent application Ser. No. 16/241,167 filed Jan. 7, 2019; Ser. No. 16/812,462 filed Mar. 9, 2020; Ser. No. 16/813,158 filed Mar. 9, 2020; Ser. No. 16/813,158 filed Mar. 9, 2020; and Ser. No. 16/813,303 filed Mar. 9, 2020, is incorporated herein by reference.

Osteogenesis

As typically healthy people grow from infants to children to adults, they experience bone growth. Such, growth, however, typically stops at approximately age 30. After that point, without interventions as described herein, bone loss (called osteoporosis), can start to occur. This does not mean that the body stops creating new bone. Rather, it means that the rate at which it creates new bone tends to slow, while the rate at which bone loss occurs tends to increase.

In addition, as people age and/or become less active than they once were, they may experience muscle loss. For example, muscles that are not used often may reduce in muscle mass. As a result, the muscles become weaker. In some instances, people may be affected by a disease, such as muscular dystrophy, that causes the muscles to become progressively weaker and to have reduced muscle mass. To increase the muscle mass and/or reduce the rate of muscle loss, people may exercise a muscle to cause muscular hypertrophy, thereby strengthening the muscle as the muscle grows. Muscular hypertrophy may refer to an increase in a size of skeletal muscle through a growth in size of its component cells. There are two factors that contribute to muscular hypertrophy, (i) sarcoplasmic hypertrophy (increase in muscle glycogen storage), and (ii) myofibrillar hypertrophy (increase in myofibril size). The growth in the cells may be caused by an adaptive response that serves to increase an ability to generate force or resist fatigue.

The rate at which such bone or muscle loss occurs generally accelerates as people age. A net growth in bone can ultimately become a net loss in bone, longitudinally across time. In an average case, but noting that significant individual variations in age do occur, by the time women are over 50 and men are over 70, net bone loss can reach a point where brittleness of the bones is so great that an increased risk of life-altering fractures can occur. Examples of such fractures include fractures of the hip and femur. Of course, fractures can also occur due to participation in athletics or due to accidents. In such cases, it is just as relevant to have a need for bone growth which heals or speeds the healing of the fracture.

To understand why such fractures occur, it is useful to recognize that bone is itself porous, with a somewhat-honeycomb like structure. This structure may be dense and therefore stronger or it may be variegated, spread out and/or sparse, such latter structure being incapable of continuously or continually supporting the weight (load) stresses experienced in everyday living. When such loads exceed the support capability of the structure at a stressor point or points, a fracture occurs. This is true whether the individual had a fragile bone structure or a strong one: it is a matter of physics, of the literal "breaking point."

It is therefore preferable to have a means of mitigating or ameliorating bone loss and of healing fractures; and, further, of encouraging new bone growth, thus increasing the density of the structure described hereinabove, thus increasing the load-bearing capacities of same, thus making first or subsequent fractures less likely to occur, and thus improving the individual's quality of life. The process of bone growth itself is referred to as osteogenesis, literally the creation of bone.

It is also preferable to have a means for mitigating or ameliorating muscle mass loss and weakening of the muscles. Further, it is preferable to encourage muscle growth by increasing the muscle mass through exercise. The increased muscle mass may enable a person to exert more force with the muscle and/or to resist fatigue in the muscle for a longer period of time.

In order to create new bone, at least three factors are necessary. First, the individual must have a sufficient intake of calcium, but second, in order to absorb that calcium, the individual must have a sufficient intake and absorption of Vitamin D, a matter problematic for those who have cystic fibrosis, who have undergone gastric bypass surgery or have other absorption disorders or conditions which limit absorption. Separately, supplemental estrogen for women and supplemental testosterone for men can further ameliorate bone loss. On the other hand, abuse of alcohol and smoking can harm one's bone structure. Medical conditions such as, without limitation, rheumatoid arthritis, renal disease, overactive parathyroid glands, diabetes or organ transplants can also exacerbate osteoporosis. Ethical pharmaceuticals such as, without limitation, hormone blockers, seizure medications and glucocorticoids are also capable of inducing such exacerbations. But even in the absence of medical conditions as described hereinabove, Vitamin D and calcium taken together may not create osteogenesis to the degree necessary or possible; or ameliorate bone loss to the degree necessary or possible.

To achieve such a degree of osteogenesis, therefore, one must add in the third factor: exercise. Specifically, one must subject one's bones to a force at least equal to certain multiple of body weight, such multiples varying depending on the individual and the specific bone in question. As used herein, "MOB" means Multiples of Body Weight. It has been determined through research that subjecting a given bone to a certain threshold MOB (this may also be known as a "weight-bearing exercise"), even for an extremely short period of time, one simply sufficient to exceed the threshold MOB, encourages and fosters osteogenesis in that bone.

Further, a person can achieve muscular hypertrophy by exercising the muscles for which increased muscle mass is desired. Strength training and/or resistance exercise may cause muscle tissue to increase. For example, pushing against or pulling on a stationary object with a certain amount of force may trigger the cells in the associated muscle to change and cause the muscle mass to increase.

The subject matter disclosed herein relates to a machine and methods and apparatuses appurtenant thereto, not only capable of enabling an individual, preferably an older, less mobile individual or preferably an individual recovering from a fracture, to engage easily in osteogenic exercises, but capable of using predetermined thresholds or dynamically calculating them, such that the person using the machine can be immediately informed through visual and/or other sensorial feedback, that the osteogenic threshold has been exceeded, thus triggering osteogenesis for the subject bone (or bones) and further indicating that the then-present exercise may be terminated, enabling the person to move to a next machine-enabled exercise to enable osteogenesis in a preferably different bone or bones. In some embodiments, the thresholds may pertain to measurements of grip strength that are obtained while the user is performing a grip-strengthening-style exercise.

For those with any or all of the osteoporosis-exacerbating medical conditions described herein, such a machine can slow the rate of net bone loss by enabling osteogenesis to occur without exertions which would not be possible for someone whose health is fragile, not robust. Another benefit of the disclosed techniques, therefore, is enhancing a rate of healing of fractures in athletically robust individuals.

Last, while this discussion has focused purely on osteogenesis, an additional benefit is that partaking in exercises which focus on osteogenesis may, in certain embodiments, also increase muscle strength and, as a physiological system, musculoskeletal strength.

Hypertrophy

Hypertrophy is defined as an increase in volume or bulk of a tissue or organ produced entirely by enlargement of existing cells. Hypertrophy as described herein specifically refers to muscle hypertrophy. The exercises performed using the disclosed apparatus may involve the following types of muscle contractions: concentric contractions (shorten), eccentric contractions (lengthen), and isometric contractions (remain the same).

Bone Exercises and their Benefits

The following exercises achieve bone strengthening results by exposing relevant parts of a user to static or isometric forces which are selected multiples of body weight (MOB) of the user, a threshold level above which bone mineral density increases. The specific MOB-multiple threshold necessary to effect such increases will naturally vary from individual to individual and may be more or less for any given individual. "Bone-strengthening," as used herein, specifically includes, without limitation, a process of osteogenesis, whether due to the creation of new bone as a result of an increase in the bone mineral density; or proximately to the introduction or causation of microfractures in the underlying bone. The exercises referred to are as follows.

Leg Press

An isometric leg-press-style exercise to improve muscular strength in the following key muscle groups: gluteals, hamstrings, quadriceps, spinal extensors and grip muscles, as well as to increase resistance to skeletal fractures in leg bones such as the femur. In one example, the leg-press-style exercise can be performed at approximately 4.2 MOB or more of the user.

Chest Press

An isometric chest-press-style exercise to improve muscular strength in the following key muscle groups: pectorals, deltoids, and tricep and grip muscles, as well as to increase resistance to skeletal fractures in the humerus, clavicle, radial, ulnar and rib pectoral regions. In one example, the chest-press-style exercise can be performed at approximately 2.5 MOB or more of the user.

Suitcase Lift

An isometric suitcase-lift-style exercise to improve muscular strength in the following key muscle groups: gluteals, hamstrings, quadriceps, spinal extensors, abdominals, and upper back and grip muscles, as well as to increase resistance to skeletal fractures in the femur and spine. In one example, the suitcase-lift-style exercise can be performed at approximately 2.5 MOB or more of the user.

Arm Curl

An isometric arm-curl-style exercise to improve muscular strength in the following key muscle groups: biceps, brachialis, brachioradialis, grip muscles and trunk, as well as to increase resistance to skeletal fractures in the humerus, ribs and spine. In one example, the arm-curl-style exercise can be performed at approximately 1.5 MOB or more of the user.

Core Pull

An isometric core-pull-style exercise to improve muscular strength in the following key muscle groups: elbow flexors, grip muscles, latissimus dorsi, hip flexors and trunk, as well as to increase resistance to skeletal fractures in the ribs and spine. In one example, the core-pull-style exercise can be performed at approximately 1.5 MOB or more of the user.

Grip Strength

A grip-strengthening-style exercise which may preferably be situated around, or integrated with, a station in an exercise machine, in order to improve strength in the muscles of the hand, forearm, or other gripping extremity. Moreover, measurement of grip strength can be taken prior to, during, and/or after the grip-strengthening-style exercise is performed. Grip strength is medically salient because it has been positively correlated with a better state of health. Accordingly, measurements of grip strength can be used to in conjunction with and/or to guide, assist, or enhance the exercise and rehabilitation of a user. Furthermore, a measurement of grip strength during the grip-strengthening-style exercise can be used to provide real-time-feedback to the user. Such real-time-feedback during the grip-strengthening-style exercise can be used to challenge the user to increase a grip strength to further strengthen the muscles of the hand, forearm, or other gripping extremity.

In the following description, details are set forth to facilitate an understanding of the present disclosure. In some instances, certain structures and techniques have not been described or shown in detail in order not to obscure the disclosure.

The following discussion is directed to various embodiments of the present disclosure. Although these embodiments are given as examples, the embodiments disclosed should not be interpreted, or otherwise used, as limiting the scope of the disclosure, including the claims. In addition, one of ordinary skill in the art will understand that the following description has broad application. The discussion of any embodiment is meant only to be exemplary of that embodiment. Thus, the discussion is not intended to intimate that the scope of the disclosure, including the claims, is limited to that embodiment.

Exercise machines can provide isometric exercises to facilitate osteogenesis and muscle hypertrophy. Such exercise machines can include equipment in which there are no moving parts while the user is performing an isometric exercise. While there may be some flexing: (i) under load, (ii) incidental movement resulting from the tolerances of interlocking parts, and (iii) parts that can move while a user performs adjustments on the exercise machines, these flexions and movements can comprise, without limitation, exercise machines capable of isometric exercise and rehabilitation. In addition, such exercise machines may also include equipment or devices including moving parts to provide dynamic exercises to facilitate osteogenesis and muscle hypertrophy. A dynamic exercise can be, but is not limited to, an exercise where a user participates in an activity where the user moves and some resistance or load is provided against the movement of the user.

Referring to the FIGS. 1-28, wherein like numerals indicate corresponding parts throughout the views, an exercise machine is shown. More specifically, and with reference to FIGS. 1-4, a first exemplary embodiment of an exercise machine 100 for exercising at least one body part of a user. The exercise machine 100 can include a base 102 that can support the exercise machine 100, and the base 102 may be configured to rest on a ground surface 103. The base 102 may extend longitudinally and can define a base length 104 from a first base end 106 to a second base end 108. The base 102 may also extend laterally and can define a base width 110 from a first base side 112 to a second base side 114. The base 102 may also define at least one base foot area 116 disposed centrally between the base ends 106, 108 and adjacent one of the first and second base sides 112, 114. The at least one foot area 116 is textured to prevent a user from slipping when standing on the at least one foot area 116. As shown, the at least one base foot area 116 can include a pair of base foot areas 116. Each of the pair of base foot areas 116 may extend longitudinally a foot area distance along each of the first base side 112 and the second base side 114. The pair of base foot areas 116 can also each extend laterally toward an opposite one of the first base side 112 and the second base side 114.

In addition, the exercise machine 100 may include at least one osteogenic or isometric device (hereinafter referred to as an "isometric device"). Hereafter, the isometric device may refer to any one of the isometric devices 117, 118, 119, 120, 221, 222, 323, 324, 423, 424, 425, 521, 525. The isometric device can be coupled to the base 102. The isometric device can be configured to receive an application of force by the user during an isometric exercise sufficient to facilitate osteogenesis and/or muscle hypertrophy. It should be appreciated that the terms "apply force" or "application of force" can include a single force, more than one force, or a range of forces.

The exercise machine 100 can also include at least one dynamic device 126 that can be coupled to the base 102. It should be appreciated that a dynamic device can be further defined, but is not limited to, a device that that has moving parts and is configured to facilitate at least one dynamic exercise of a user. The at least one dynamic device 126 may be configured to be movable in response to selective engagement by the user to provide a dynamic exercise for the user and to facilitate osteogenesis and/or muscle hypertrophy.

The exercise machine 100 may additionally include a seat 130 having a seating platform 132 that can be coupled to the base 102. The seating platform 132 can, for example, extend outwardly from the base 102 away from the ground surface 103. Thus, the seating platform 132 can define a seating surface for supporting the user in a seating position, the seating surface extending longitudinally, laterally and parallel to the base 102. A back portion 134 may also extend in a back rest direction from the seating platform 132 away from the ground surface 103. The back portion 134 can also define a back rest portion 136 in a seated position, the back rest portion extending from the seat 130 to support the back of the user. A position of the seating platform 132 and/or back rest portion 136 may additionally be adjustable in a horizontal and/or vertical dimension. In some embodiments, the angle of the seat 130 is adjustable. According to other aspects, the angle of the back rest portion 136 is adjustable. Examples of how adjustments to the seat 130 and back rest portion 136 can be implemented include, but are not limited to, using telescoping tubes and pins, hydraulic pistons, electric motors, etc. The seating platform 132 may further include a fastening system (not shown), such as a seat belt, for securing the user to the seat 130. The fastening system could additionally or alternatively include a passive bar under which the user can secure their knees or thighs.

In some embodiments, a pair of upper seat handles 117 can be adjustably coupled to the back rest portion 136. The pair of upper seat handles 117 can be configured to rotate about respective upper seat handle axes 138. Specifically, such upper seat handle axes 138 can extend laterally relative to and may be spaced from the ground surface 103. A position of the pair of upper seat handles 117 may also be adjustable. Consequently, each of the upper seat handles 117 may be configured to be gripped by the user to facilitate at least one of osteogenesis and muscle hypertrophy.

The exercise machine 100 can further include a main post 140 that may be coupled to the base 102. The main post 140 can be in a spaced relationship relative to the seating platform 132 at the first base end 106. In addition, the main post 140 can extend outwardly from the base 102 and away from the ground surface 130 to a distal post end 142.

According to an aspect, the at least one dynamic device 126 can be a cycle mechanism 126. The cycle mechanism 126 can be attached to the base 102 adjacent to the main post 140. In more detail, the cycle mechanism 126 may include at least one pedal 142, 144 that can be configured to allow the user to engage and move the cycle mechanism 126. The at least one pedal 142, 144 of the cycle mechanism 126 can include a first pedal 142 and a second pedal 144. Each pedal 142, 144 may be offset from and rotatable about a cycle axis 146 centrally located in the cycle mechanism 126. Specifically, the cycle axis 146 can extend laterally relative to and can be spaced from the ground surface 103. The cycle axis 146 may also be transverse to a post direction in which the main post 140 extends.

In one example, the cycle mechanism 126 can also include a first disc 148 that may extend radially from the cycle axis 146 to a first disc perimeter 150. A first pedal axle 152 can extend from the first disc 148. The first pedal axle 152 may extend along and be offset from the cycle axis 146. Therefore, the first pedal axle 152 can be configured to rotatably support the first pedal 142. Similarly, the cycle mechanism 126 can also include a second disc 154 that may extend radially from the cycle axis 146 to a second disc perimeter 156. The second disc 154 can be spaced axially from the first disc 148. A second pedal axle 158 can extend from the second disc 154. The second pedal axle 158 may extend along and be offset from the cycle axis 146. Thus, the second pedal axle 158 can be configured to rotatably support the second pedal 144. As an alternative to the first disc 148 and the second disc 154, the cycle mechanism 126 may include a shaft that rotates in a circle, along which the pedals 142, 144 may transition to different positions.

In an alternative embodiment, the first disc 148 may also include a first semicircular panel 118 that can be hinged from and rotatable about a first centerline 162 of the first disc 148. The first centerline 162 can be centrally located and can extend laterally relative to and can be spaced from the ground surface 103. Therefore, the first semicircular panel 118 can be movable to a first panel extended position. To facilitate osteogenesis in the user, the user may place their foot on the first semicircular panel 118 in such a position. Likewise, the second disc 154 may also include a second semicircular panel 119 that can be hinged from, and rotatable about a second centerline 166 of the second disc 154. As with the first centerline 162 of the first disc 148, the second centerline 166 can be centrally located and can extend laterally relative to and can be spaced from the ground surface 103. Thus, the second semicircular panel 119 can be movable to a second panel extended position. While the second semicircular panel 119 is in the second panel extended position, the user may place their foot thereon for facilitating osteogenesis.

In some embodiments, the exercise machine 100 can also include a lateral bar 120 that may be coupled to the distal post end 142 of the main post 140. The lateral bar 120 can extend laterally relative to and be spaced from the ground surface 103. The lateral bar 120 can extend from a first lateral bar end 168 to a second lateral bar end 170 to define a lateral bar axis 172. The lateral bar axis 172 may be orthogonal to the post direction of the main post 140. The lateral bar 120 may include a first bar handle 174 that can extend from the first lateral bar end 168. As a result, the first bar handle 174 can be transverse to the lateral bar axis 172. The lateral bar 120 may also include a second bar handle 176 that may extend from the second lateral bar end 170. Thus, the second bar handle 176 can be transverse to the lateral bar axis 172. To facilitate osteogenesis, the first bar handle 174 and second bar handle 176 can be configured for the user to place their respective hands thereon.

According to an aspect, the exercise machine 100 can further include a control console 178. The control console 178 can provide information to and instruct the user regarding use of the exercise machine 100. Such information and instructions may be provided to the user prior to, during, and/or after an exercise. This could include information on how to perform the exercise, feedback regarding how much force is being applied, a target force to be applied, historical information for the user about how much force they applied at prior sessions, comparisons to averages, etc. The control console 178 may have any combination of memory storage such as random-access memory (RAM) or read-only memory (ROM). The control console 178 may also include processing resources or a microcontroller or central processing unit (CPU) or hardware or software control logic to provide information to and instruct the user regarding use of the exercise machine 100. However, it is to be appreciated that the processing resources, microcontroller, or CPU may be located anywhere in the exercise machine 100. For example, the processing resources, microcontroller, or CPU may be located in a control box. Additionally, the control console 178 may include one or more wireless, wired or any combination thereof of communications ports. Such communication ports can enable communication with external resources as well as with various input and output (I/O) devices, such as a keyboard, a mouse, pointers, touch controllers, cell phone, personal electronic device and display devices. The control console 178 may also include one or more buses operable to transmit communication of management information between the various hardware components. Finally, the control console 178 can communicate using wire-line communication data buses, wireless network communication, or any combination thereof.

A plurality of load cells 180 can be electrically coupled (e.g., wired or wireless) to the control console 178. The plurality of load cells 180 may be mechanically coupled to the at least one dynamic device 126 and/or the at least one isometric device. The plurality of load cells 180 can sense at least one load during the isometric exercise and the dynamic exercise and may output a signal corresponding to the at least one load. Based on the output signals from the load cells 180, the control counsel 178 can display the output from the load cells 180, and the user, or other person (e.g., a trainer, a nurse, a technician, a rehabilitation specialist, a physician, etc.) may interact with the counsel 178 to select a program or exercise routine to be executed.

Figure 5:
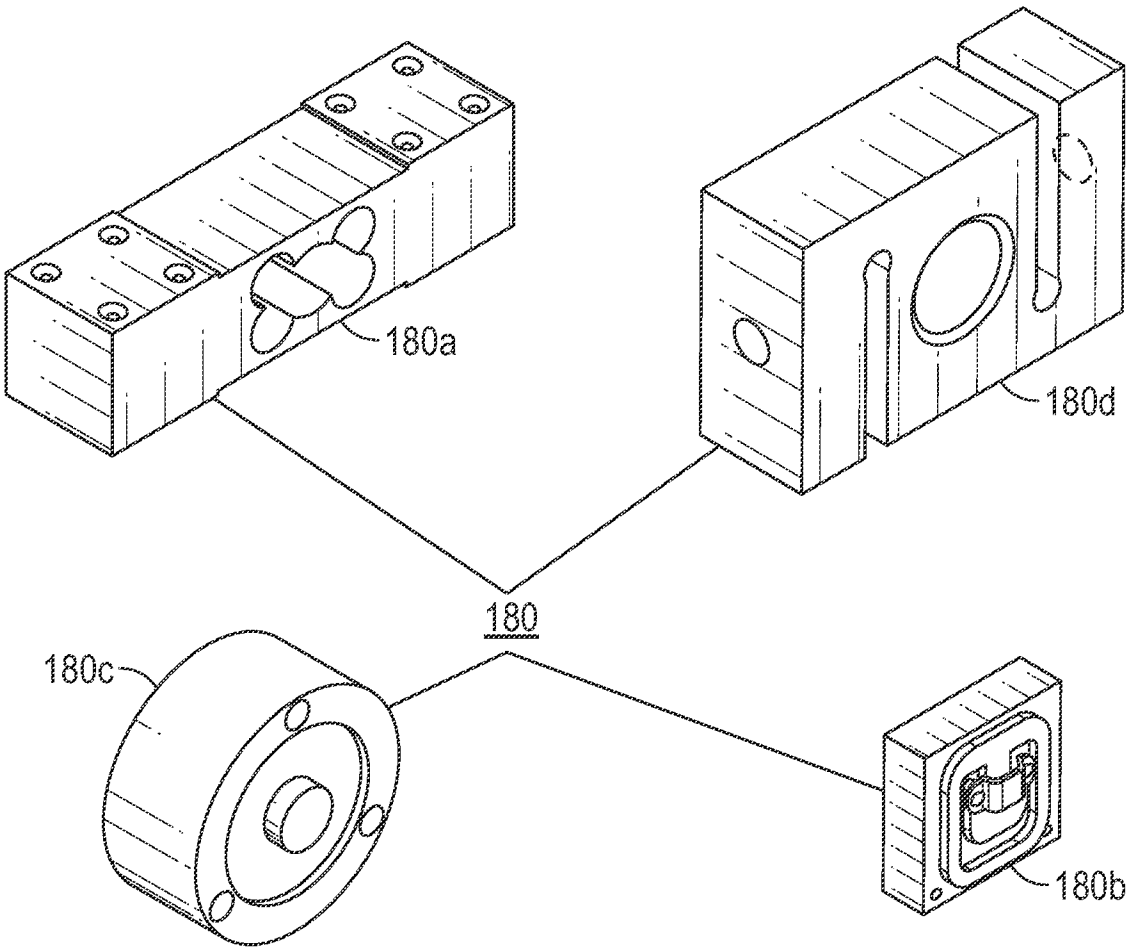
FIG. 5 shows examples of a plurality of load cells that can be used in the exercise machine, according to aspects of the disclosure.

FIG. 5 depicts several options for the plurality of load cells 180. In some embodiments, the load cells 180 can be piezoelectric load cells, such as PACEline CLP Piezoelectric Subminiature Load Washers. In other embodiments, the load cells can be hydraulic load cells, such as Noshok hydraulic load cells. In some versions, the plurality of load cells 180 can include a plurality of strain gauges. Embodiments of the load cells can be bending-type load cells, such as Omega SGN-4/20-PN 4 mm grid, 20 ohm nickel foil resistors. Other examples of the plurality of load cells can be double-beam-type load cells 180*a*, such as Rudera Sensor RSL 642 strain gauges. Still other embodiments of the plurality of load cells can be half-bridge-type load cells 180*b*, such as Onyehn 4pcs 50 kg Human Scale Load Cell Resistance Half-bridge/Amplifier Strain Weight Sensors with 1pcs HX711 AD Weight Modules for Arduino DIY Electronic Scale strain gauges. In some embodiments, the load cells can be S-type load cells 180*c*, such as Sensortronics S-type load cell 60001 load cells. Additionally, the load cells can be button-type load cells 180*d*, such as Omega LCGB-250, 250 lb capacity load cells. Naturally, the plurality of load cells 180 can comprise combinations of these various examples. The embodiments described herein are not limited to these examples.

Figure 6:
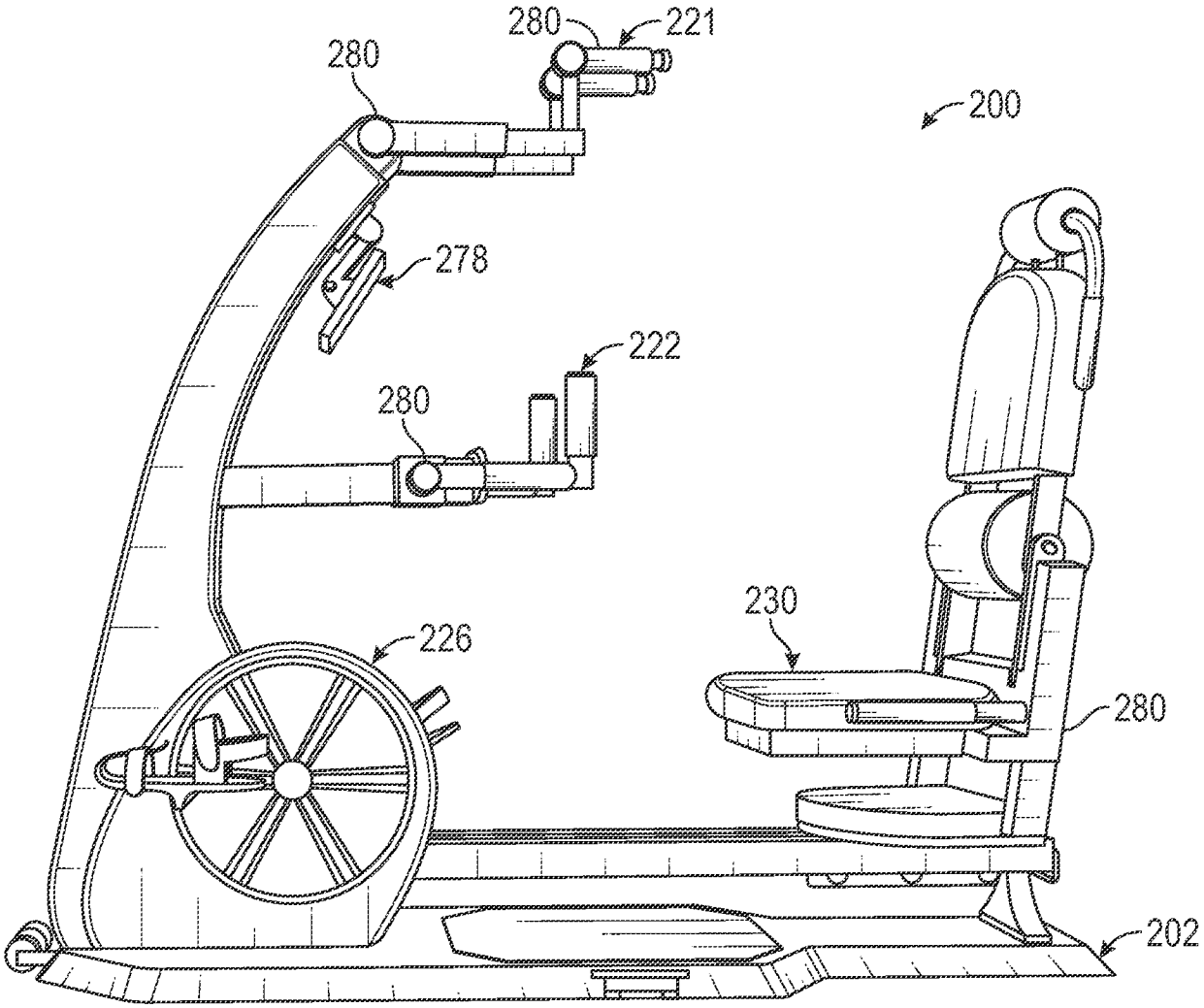
FIGS. 6-7 illustrate a second exemplary embodiment of an exercise machine, according to aspects of the disclosure
Figure 7:
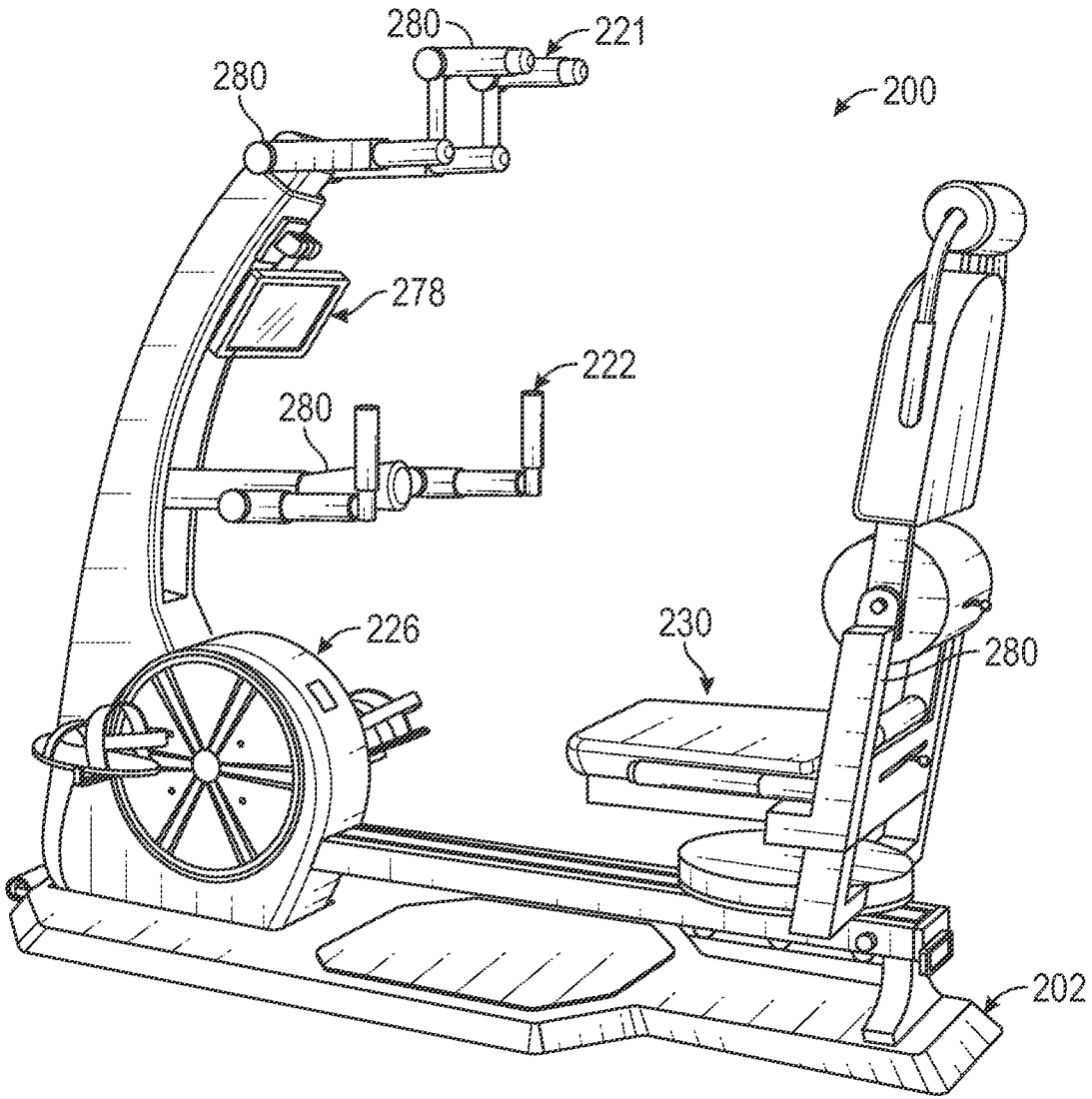
Figure 8:
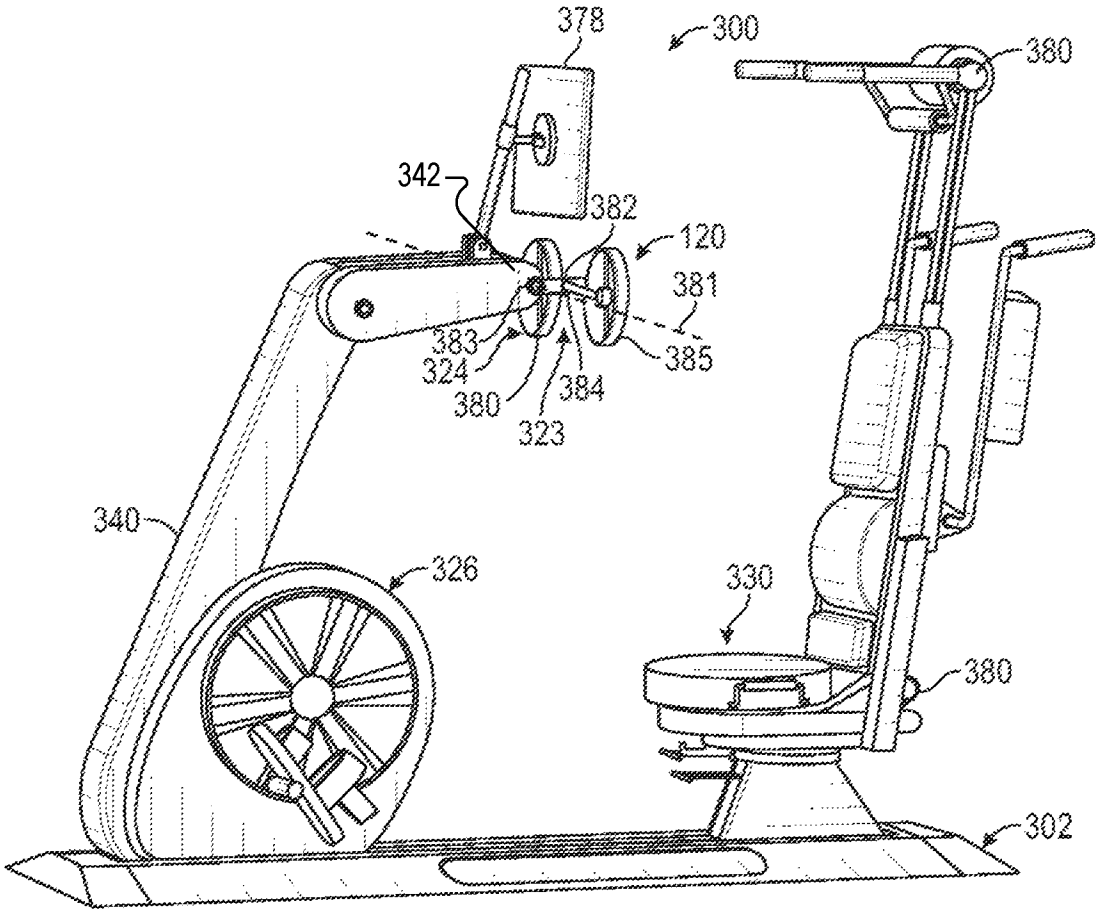
FIGS. 8-13 illustrate a third exemplary embodiment of an exercise machine, according to aspects of the disclosure.

FIGS. 6-7 show a second exemplary embodiment of an exercise machine 200. The exercise machine 200 may share similar aspects to that of the exercise machine 100 discussed above. In addition, the exercise machine 200 may include at least one isometric device 221, 222 and can additionally include at least one dynamic device 226, 228. More specifically, a pair of upper load handles 221 can be located above and in front of the seat 230. In a core-pull-style exercise, the user can apply force to the upper load handles 221, while being constrained in the seat 230 by the fastening system (not shown). In such an exercise, while the lower body of the user is restrained from upward movement by the fastening system, the user can sit in the seat 230, apply the fastening system, hold the pair of upper load handles 221, and pull on the pair of upper load handles 221 with their arms.

According to an aspect, adjustments can be made to the position of the pair of upper load handles 221. For example, these adjustments can include the height of the pair of upper load handles 221, the distance between the pair of upper load handles 221 and the seat 230. The adjustments may also include the distance between each handle of the pair of upper load handles 221, the angle of the upper load handles 221 relative to the user, etc. In some embodiments, to account for natural differences in limb length or injuries, each handle of the pair of upper load handles 221 can be adjusted separately.

The exercise machine 200 may also include a pair of middle load handles 222 that can be spaced apart from and in the front of the seat 230. In a chest-press-style exercise, while seated, the user can apply force to the pair of middle load handles 222. In such an exercise, the user can sit in the seat 230, hold the pair of middle load handles 222, and push against the pair of middle load handles 222 with their arms.

According to an aspect, adjustments can be made to the position of the pair of middle load handles 222. These adjustments can include the height of the pair of middle load handles 222, the distance between the pair of middle load handles 222 and the seat 230. The adjustments can also include the distance between each handle of the pair of middle load handles 222, the angle of the pair of middle load handles 222 relative to the user, etc. In some embodiments, to account for natural differences in limb length or injuries, each handle of the pair of middle load handles 222 can be adjusted separately. Feedback and instructions can be provided to the user with the control console 278 based on one or more signals from the plurality of load cells 280.

FIGS. 8-13 show a third exemplary embodiment of an exercise machine 300. The exercise machine 300 can include a first pivoting assembly 323 that may be coupled to and pivotable about a lateral pivoting axis 381 at the distal post end 342 of a main post 340. The first pivoting assembly 323 can have a first pivoting arm 382 that may extend therefrom, and the first pivoting arm 383 can have a proximal first arm end 383 and a distal first arm end 384. A first pivoting handle 385 can be pivotally attached to the distal first arm end 384. The exercise machine 300 may also include a second pivoting assembly 324 that can be coupled to and pivotable about the lateral pivoting axis 381 at the distal post end 342. The second pivoting assembly 324 can have a second pivoting arm 386 that may extend from the lateral pivoting axis 381, and the second pivoting arm 386 can have a proximal second arm end 387 and a distal second arm end 388. A second pivoting handle 389 can be pivotally attached at the distal second arm end 388. The first pivoting handle 385 and the second pivoting handle 389 can be configured to be engaged by gripping by the user to facilitate at least one of osteogenesis and muscle hypertrophy. The exercise machine 300 can further include a control console 378 and a plurality of load cells 380.

Figure 9:
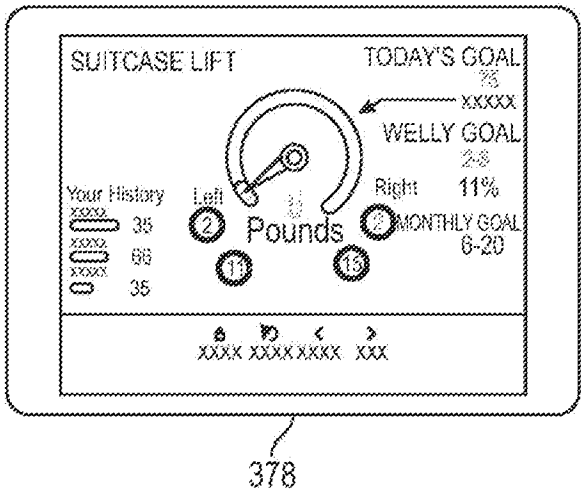
Figure 9:
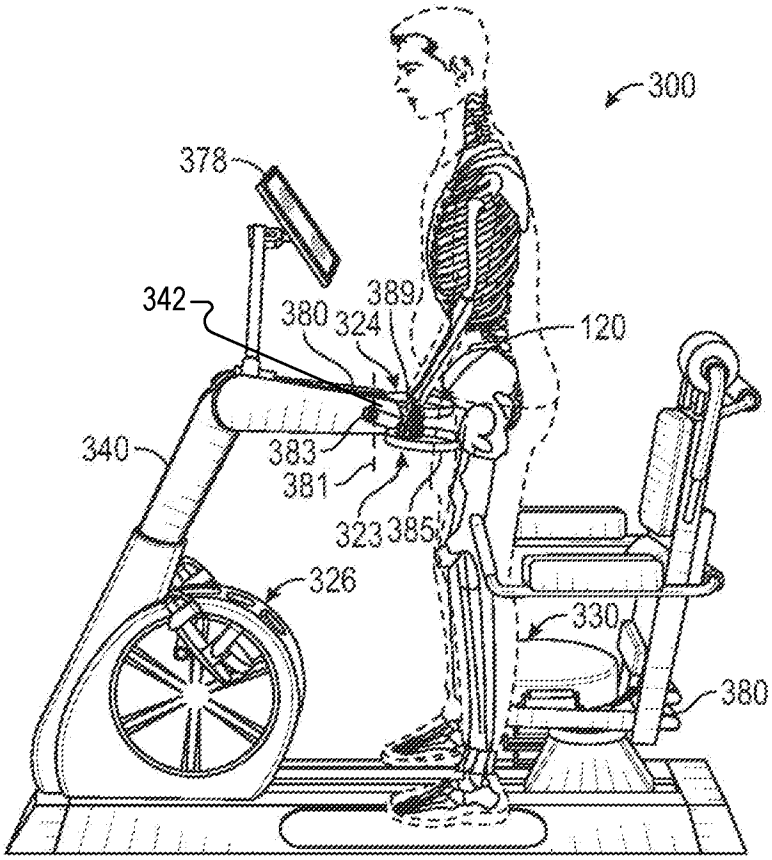
Figure 10:
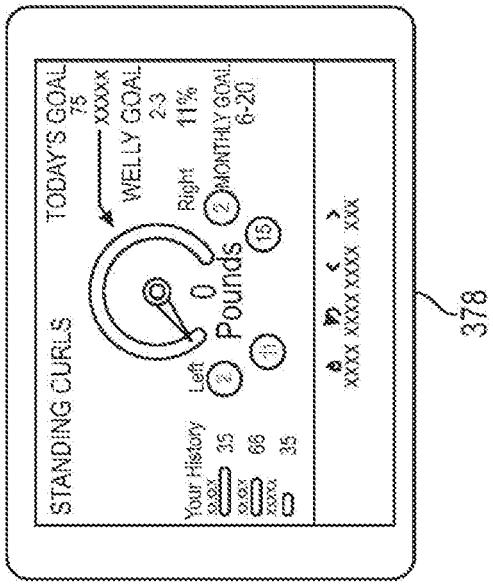
Figure 10:
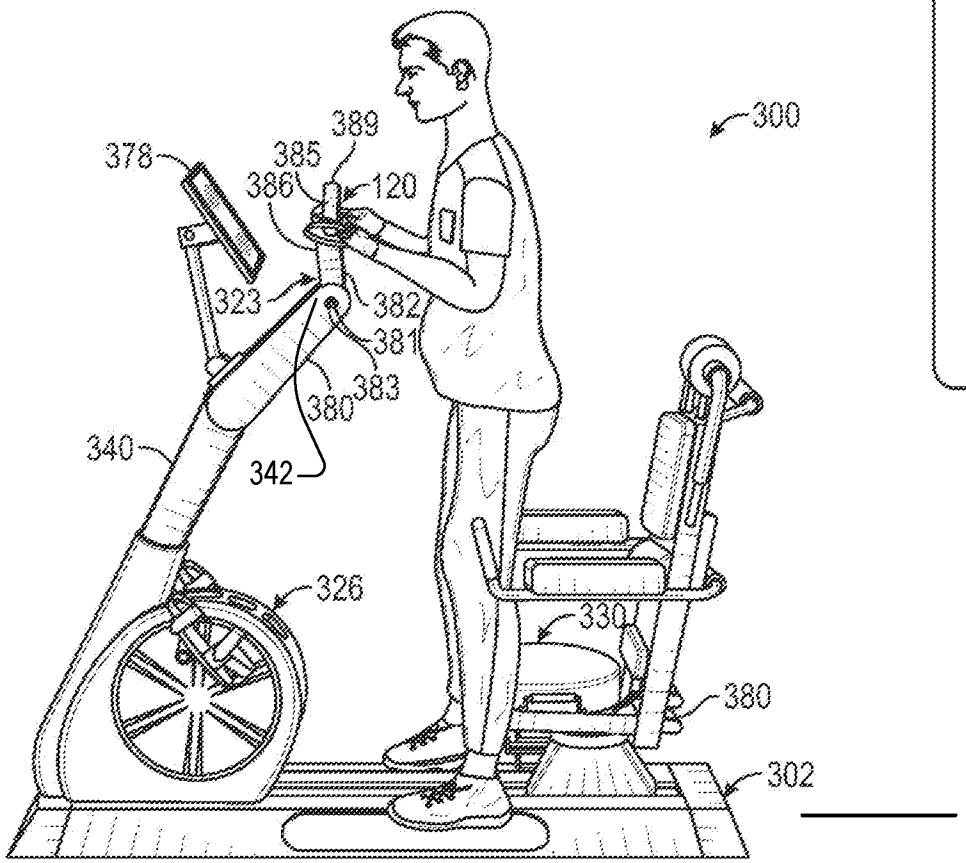
Figure 11:
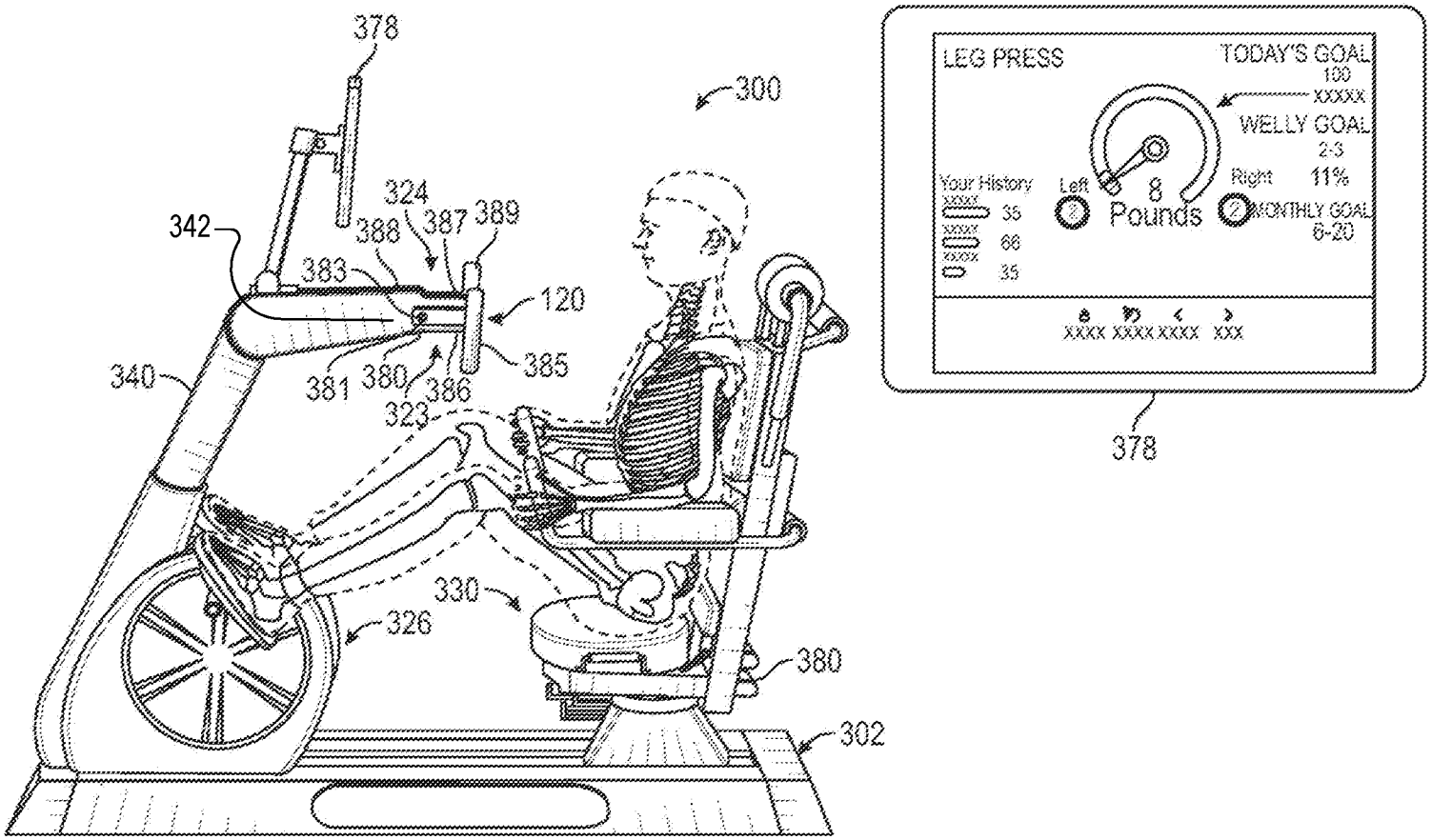
Figure 12:
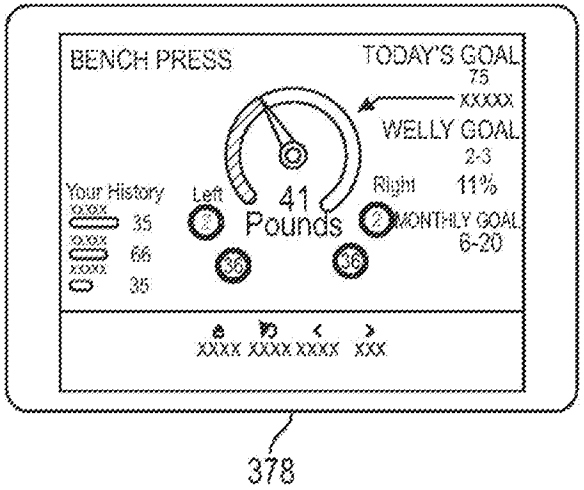
Figure 12:
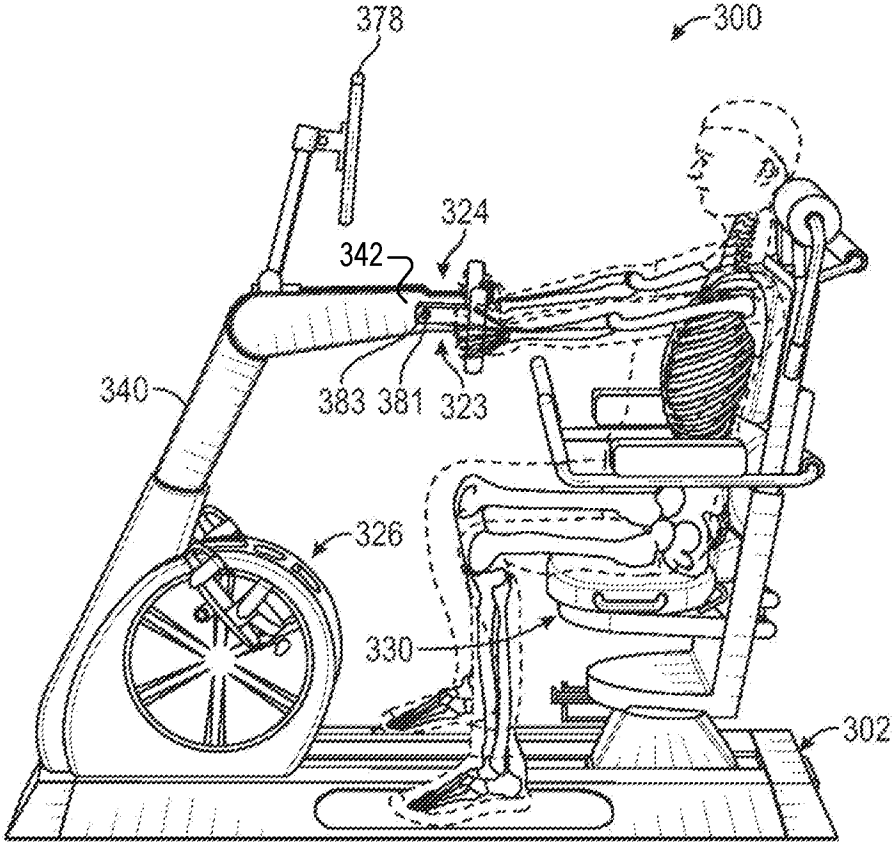
Figure 13:
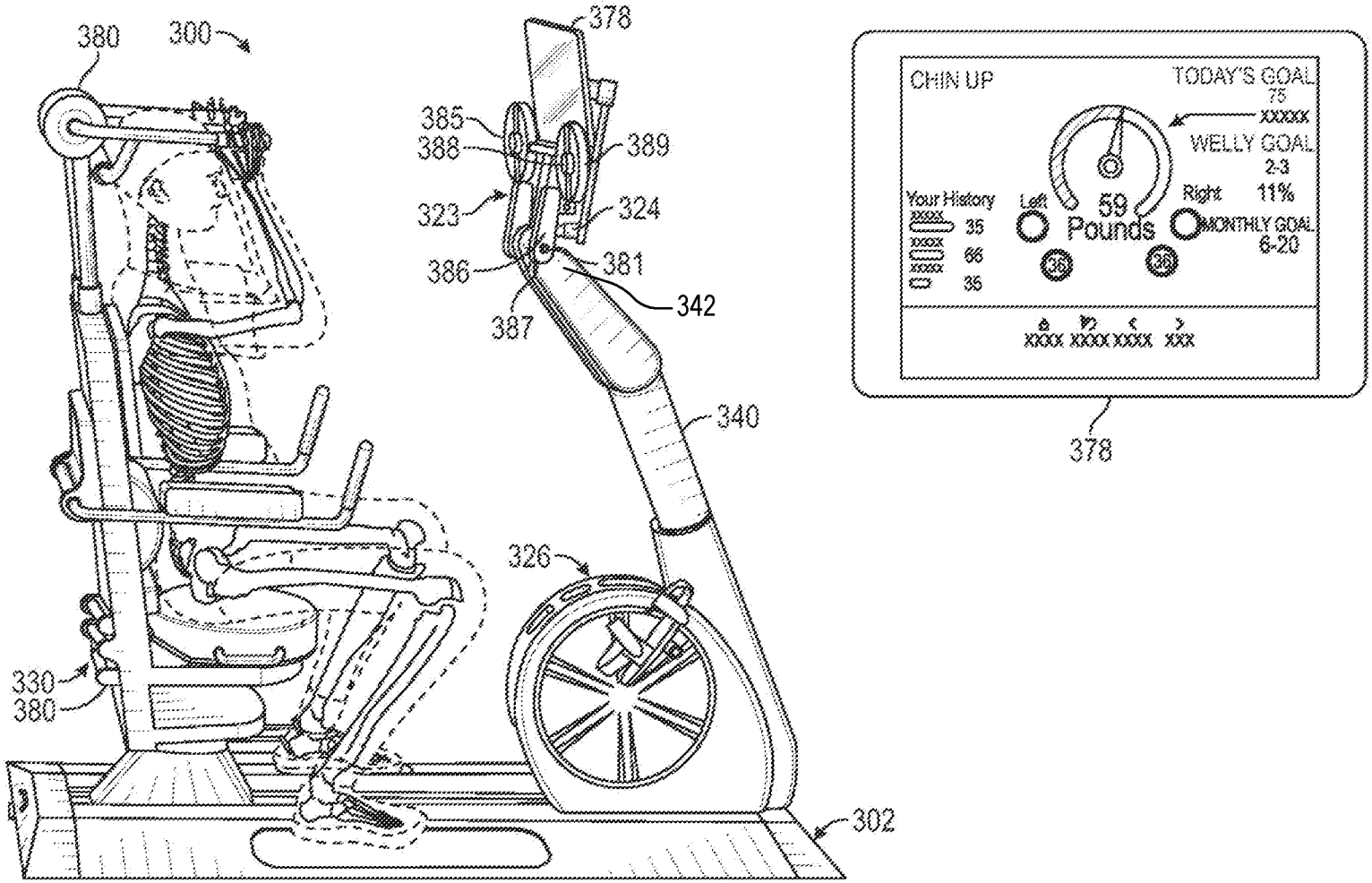

As best shown in FIG. 9, in a suitcase-lift-style exercise, the first pivoting handle 385 and the second pivoting handle 389 can be positioned adjacent to the seat 330. In such a position, the user can engage the first and second pivoting handles 385, 389 and pull upwardly to apply a force to the first and second pivoting handles 385, 289 to facilitate at least one of osteogenesis and muscle hypertrophy. It should be appreciated that the first and second pivoting assemblies 323, 327 can be pivoted between a plurality of positions to allow for the user to perform various other exercises. Such exercise can include, but is not limited to standing curls (FIG. 10), leg presses (FIG. 11), bench presses (FIG. 12), and pull downs (FIG. 13). A cycle mechanism 326 may also be provided to enable the user to perform a cycling exercise.

Figure 14:
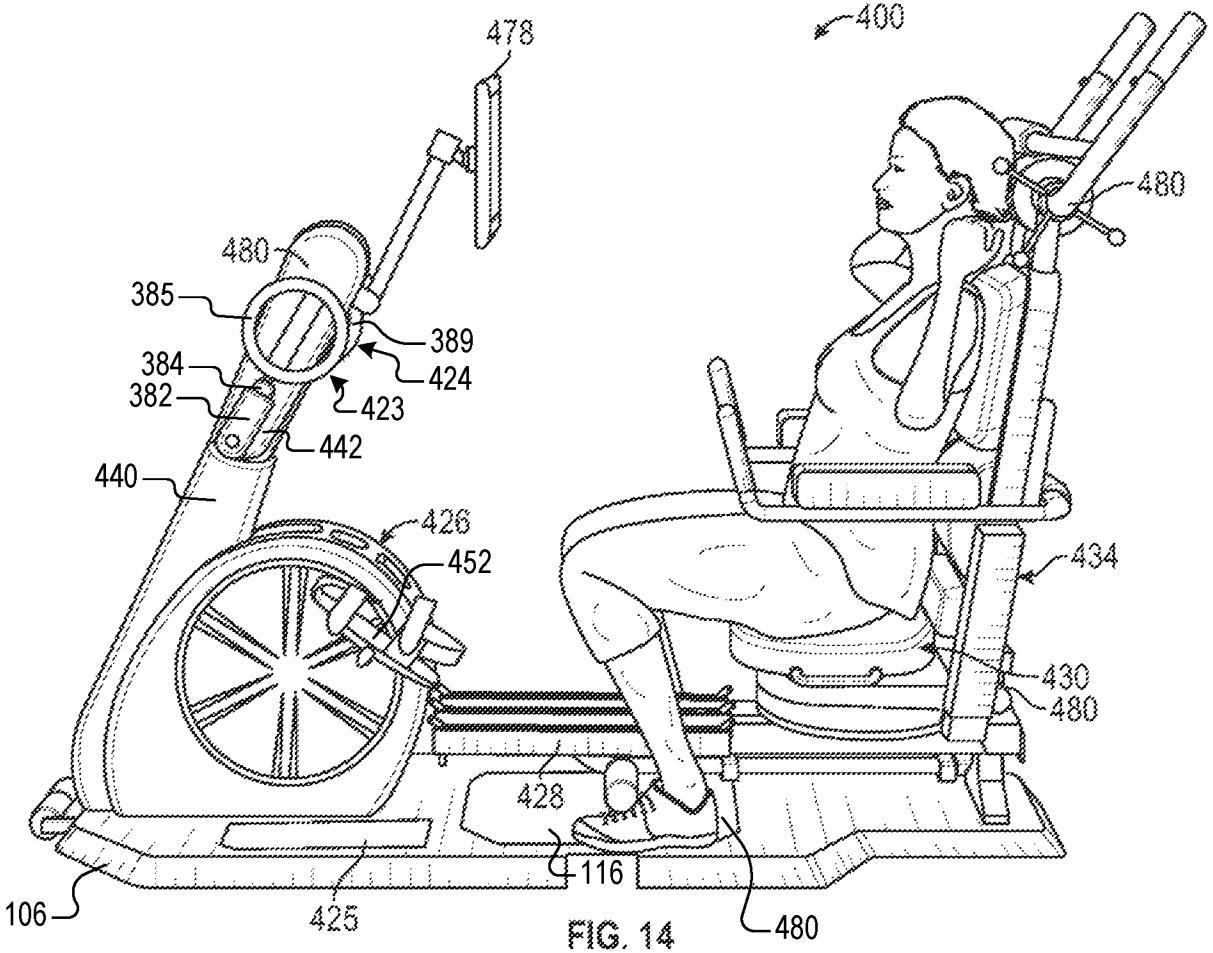
FIGS. 14-20 illustrate a fourth exemplary embodiment of an exercise machine, according to aspects of the disclosure.
Figure 15:
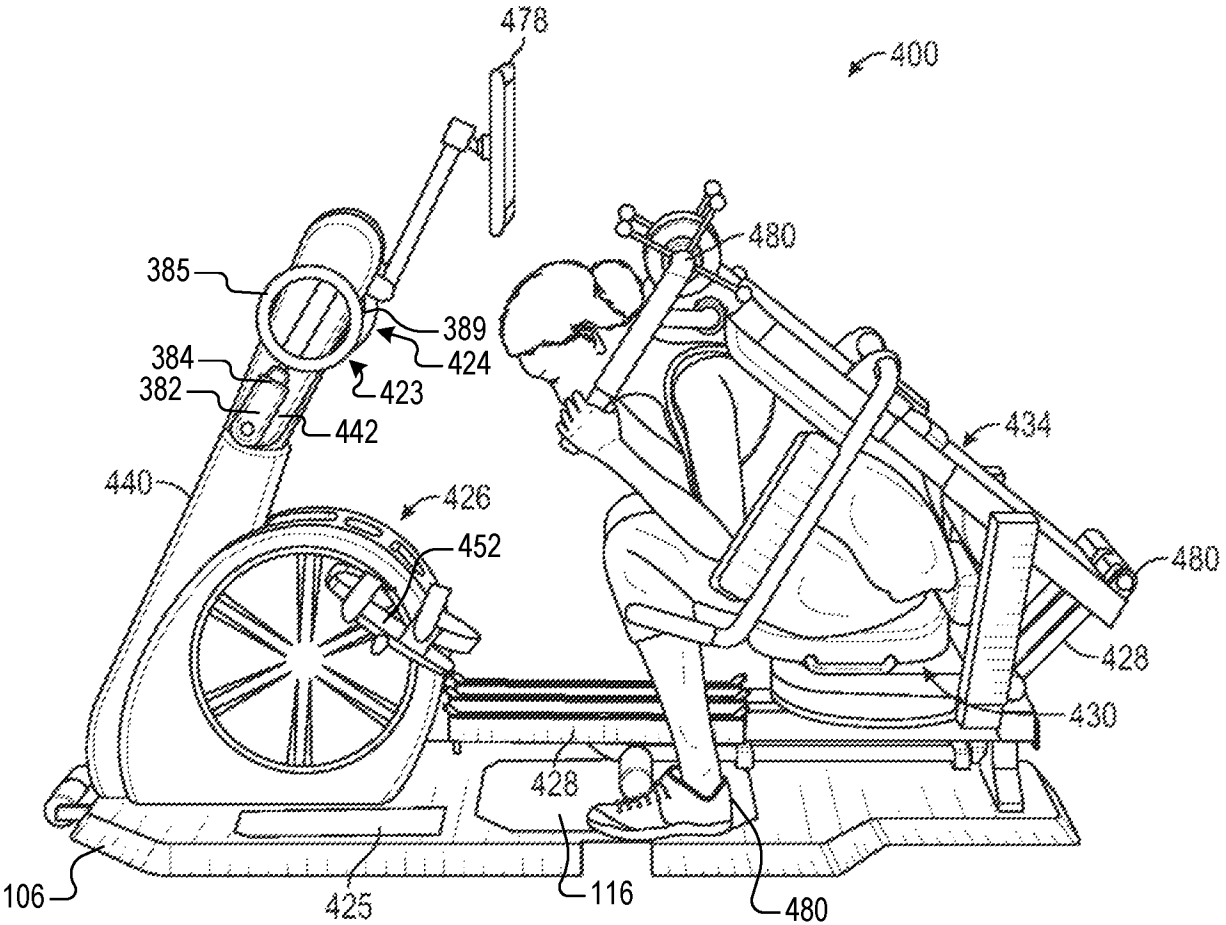
Figure 16:
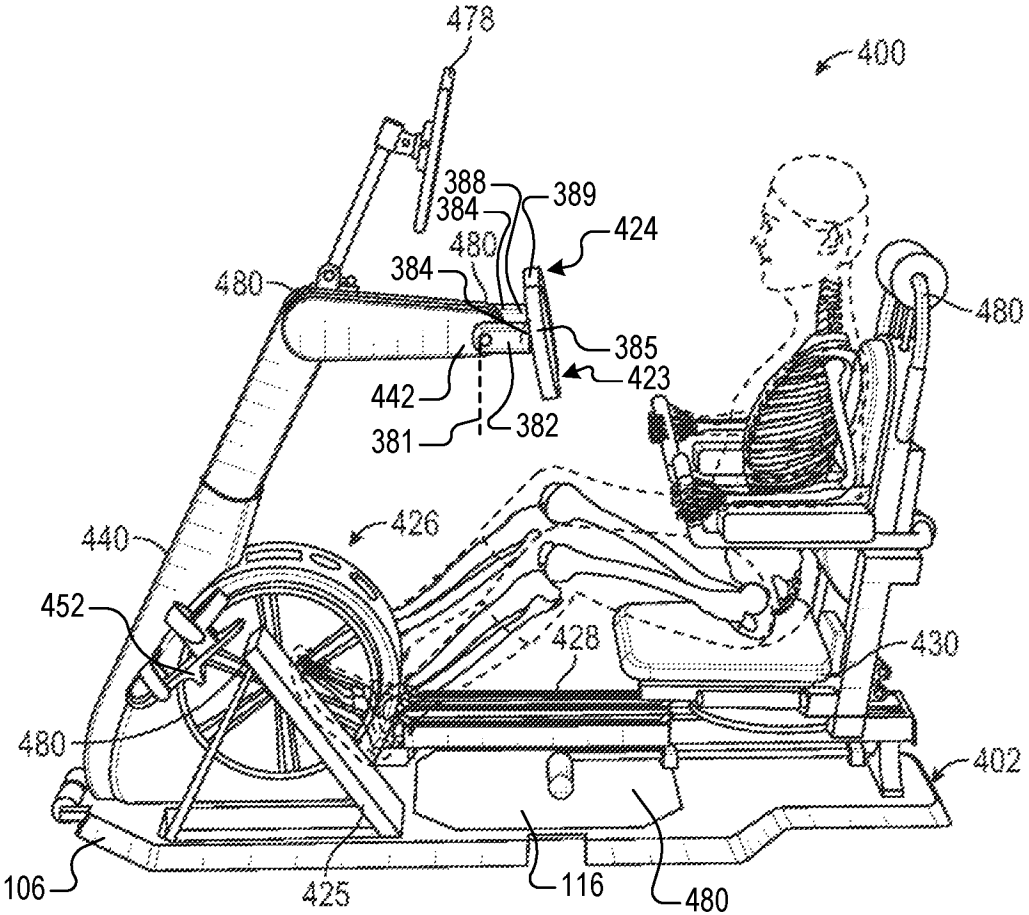

FIGS. 14-20 show a fourth exemplary embodiment of an exercise machine 400. The exercise machine 400 may include at least one dynamic device 426 and at least one static or isometric device 423, 424, 425 (corresponding to pivoting assemblies 423, 424 and one or more foot plates 425). Specifically, the at least one dynamic device 426 of the exercise machine 400 can include a cycling mechanism 426 (including pedals 452) and at least one flexible band 428. The at least one flexible band 428 may be configured to be selectively engaged and provide resistance to the user. The at least one flexible band 428 can, for example, stretch between the cycling mechanism 426 and the seat 430. It is also contemplated that the at least one flexible band 428 can provide resistance to a sliding movement of the seat 430. As best shown in FIGS. 14 and 15, the at least one flexible band 428 can also be attached between the seat 430 and the back portion 434 to provide resistance for crunch-type dynamic exercises. Alternatively, or in addition to the at least one flexible band 428, the at least one dynamic device 426, 428 may include an active resistance device to selectively engage and provide resistance to the user. The exercise machine 400 can further include a control console 478.

Figure 17:
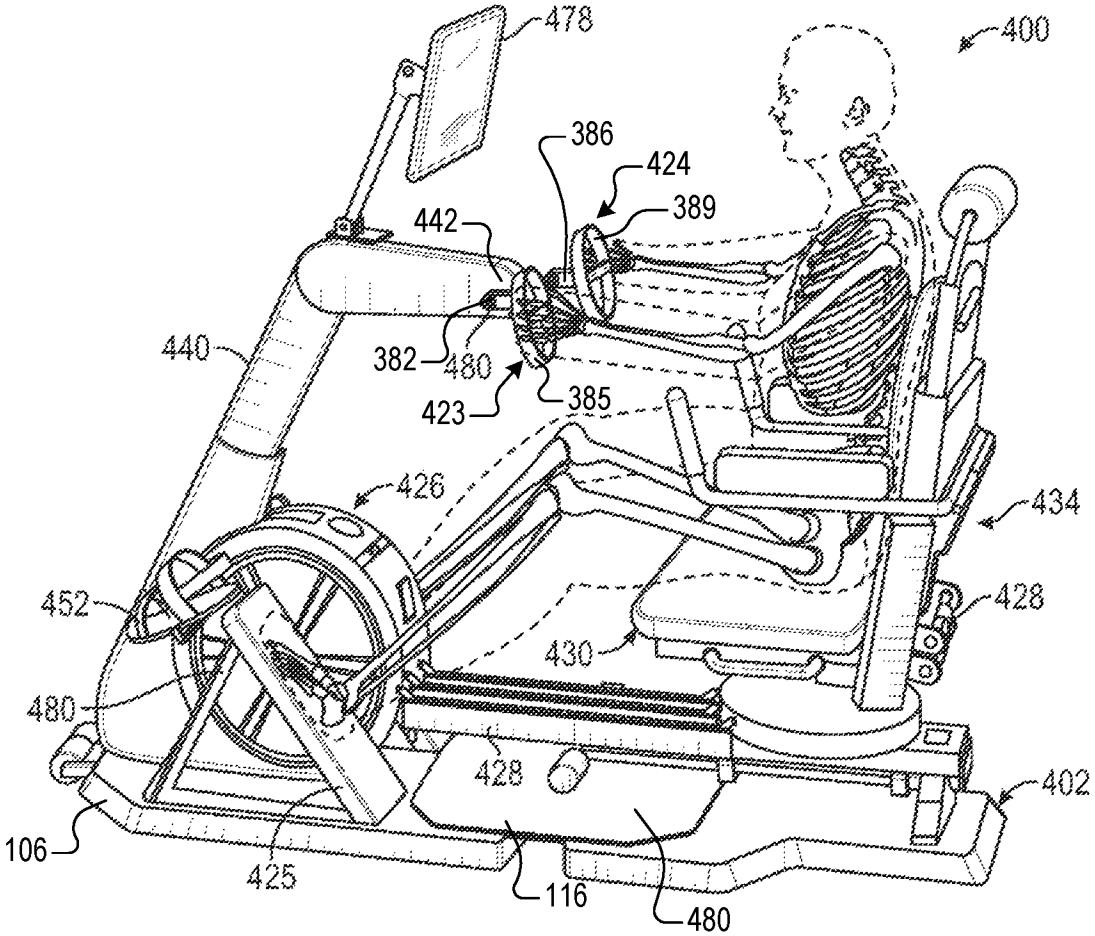
Figure 18:
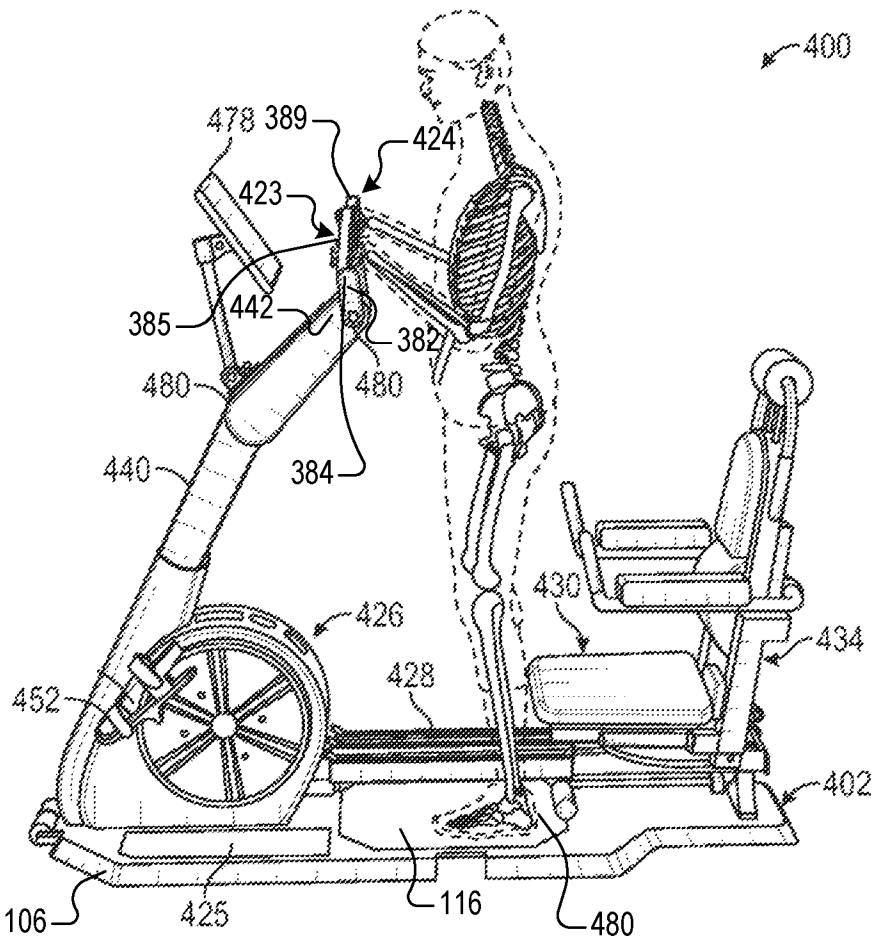
Figure 19:
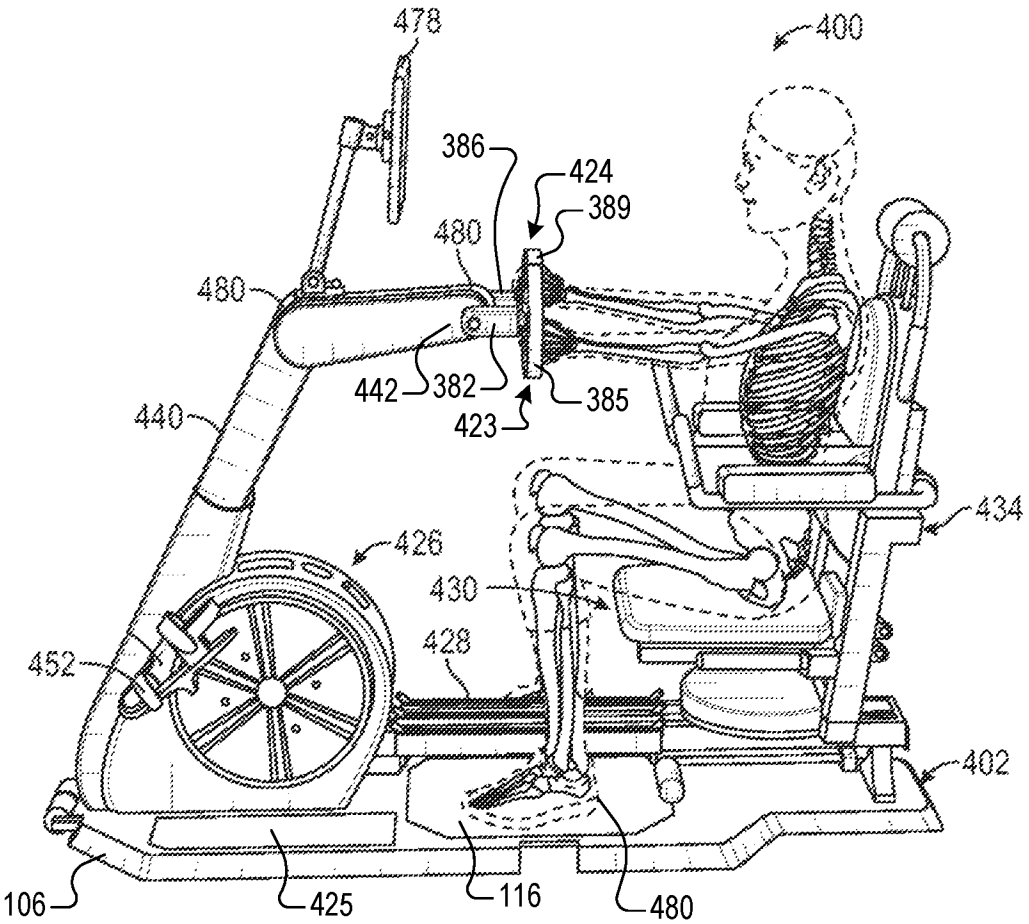
Figure 20:
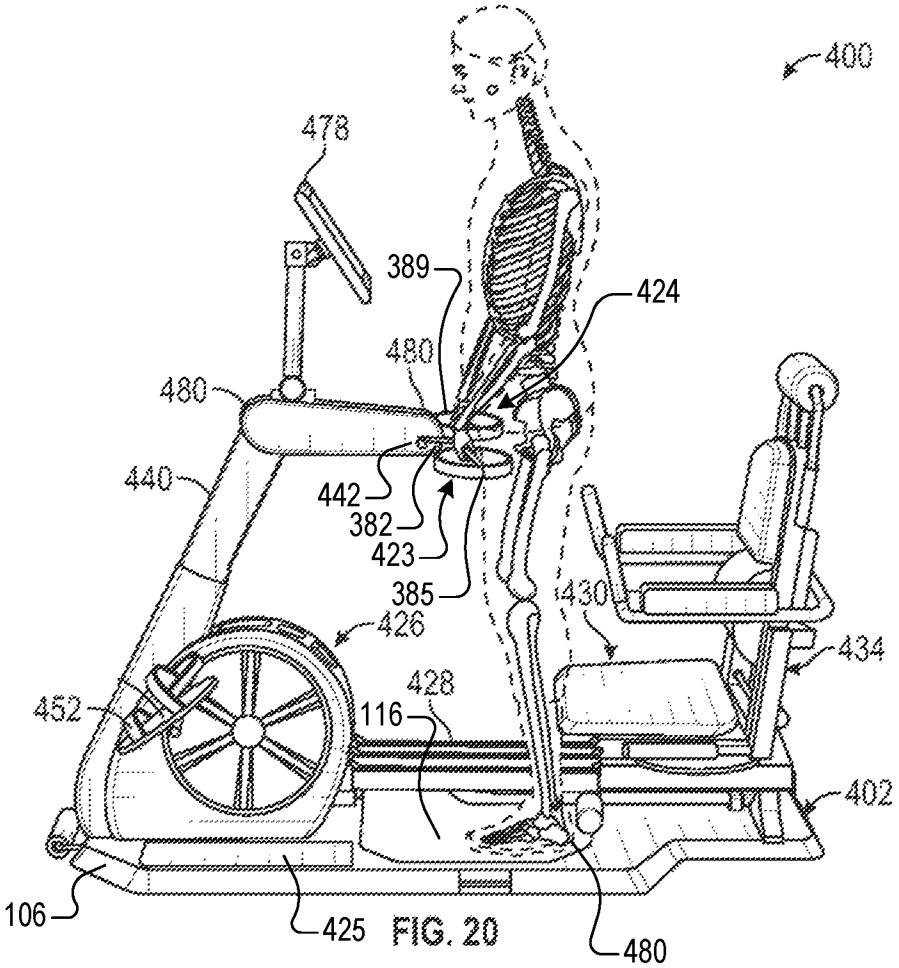
Figure 21:
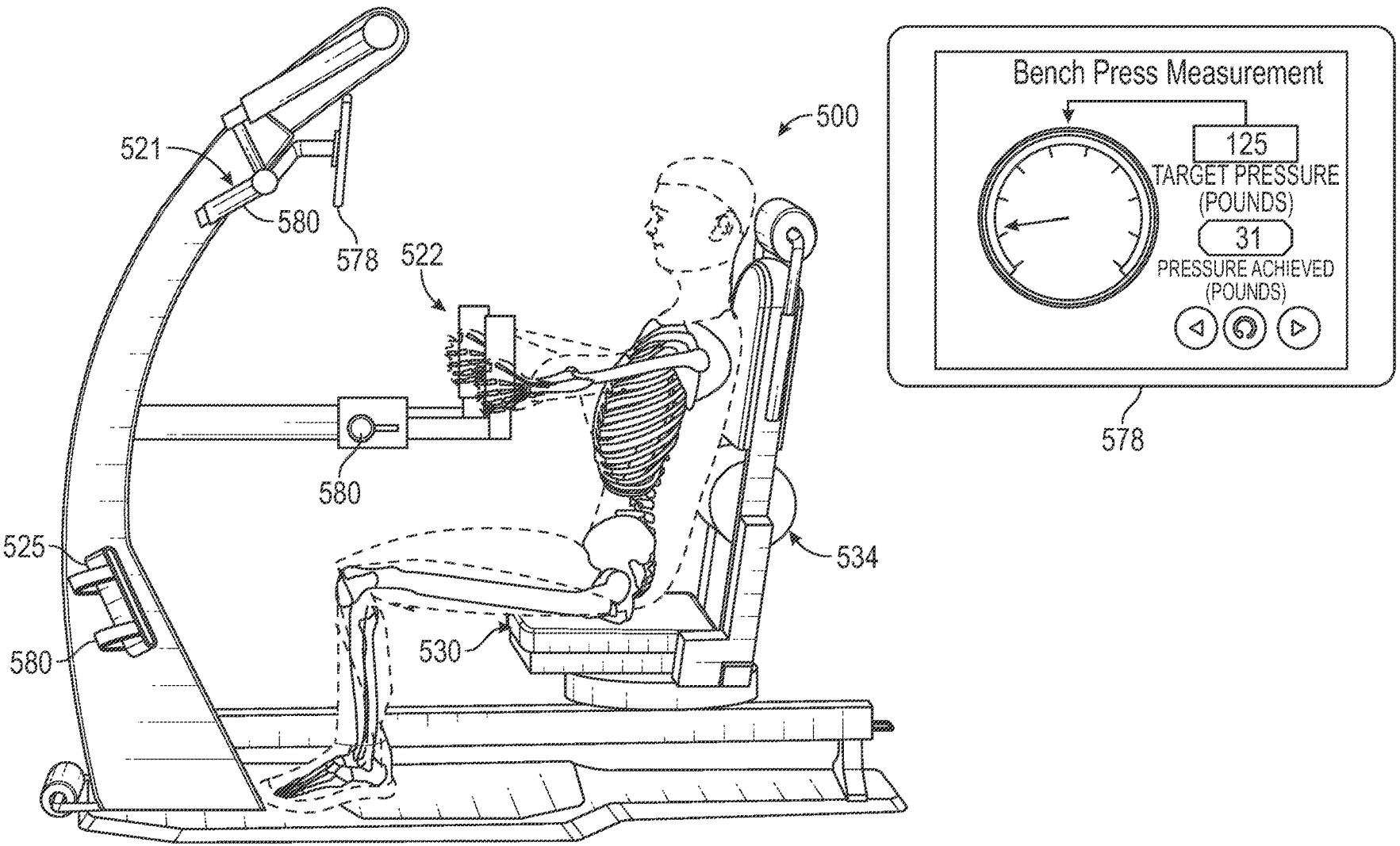
FIGS. 21-26 illustrate a fifth exemplary embodiment of an exercise machine, according to aspects of the disclosure.

The isometric device 423, 424, 425 includes the pivoting assemblies 423, 424 coupled to a distal post end 442 of a main post 440. The exercise machine 400 can further include one or more foot plates 425 (e.g., two shown) coupled to the base 402, and each foot plate 425 is configured to be selectively engaged by the user. Each foot plate 425 can be coupled to at least one load cell 480 (e.g., four per foot plate). Accordingly, and with reference to FIG. 16, when the user engages each foot plate 425, each foot plate 425 can be used for a separate and independent measurement of left and right leg forces to facilitate osteogenesis and/or hypertrophy. The foot plates 425 may be used for difference type of exercises, including but not limited to, a leg-press-type exercise (FIG. 16) and a rowing-type exercise (FIG. 17).

It is to be appreciated that adjustments can be made to the positions of the foot plates 425. The position of the foot plates 425 can be adjustable in a horizontal and/or vertical dimension. Also, the angle of the foot plates 425 relative to the seat or back portion 434 may be adjustable. Examples of how adjustments to the foot plates 425 can be implemented include, but are not limited to, using telescoping tubes and pins, hydraulic pistons, and electric motors. In some embodiments, the foot plates are additionally retractable. Accordingly, the foot plates 425 can fold from an engaged position (FIGS. 16 and 17) to a stored position (FIGS. 14-15, 19, and 20).

Figure 22:
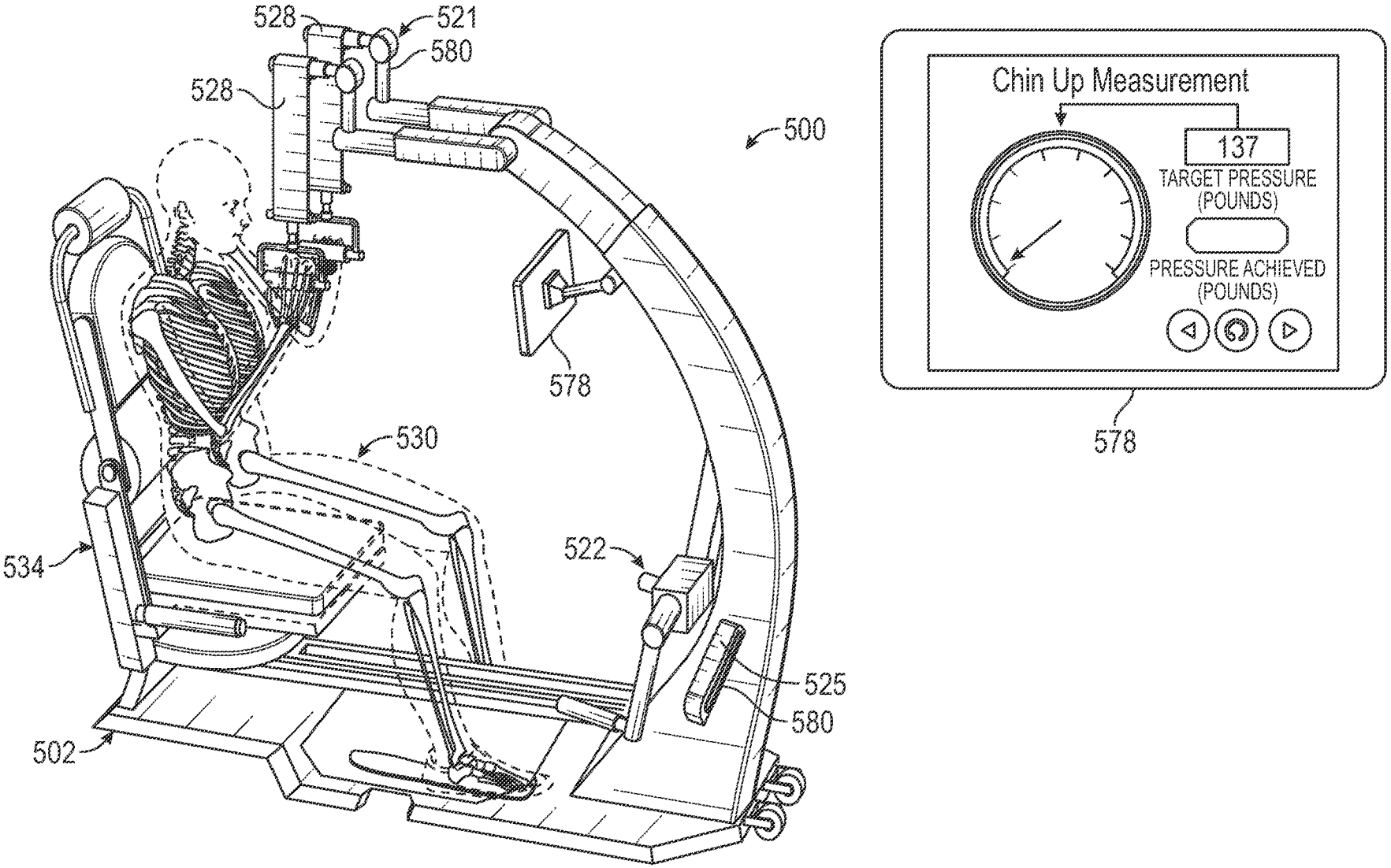
Figure 23:
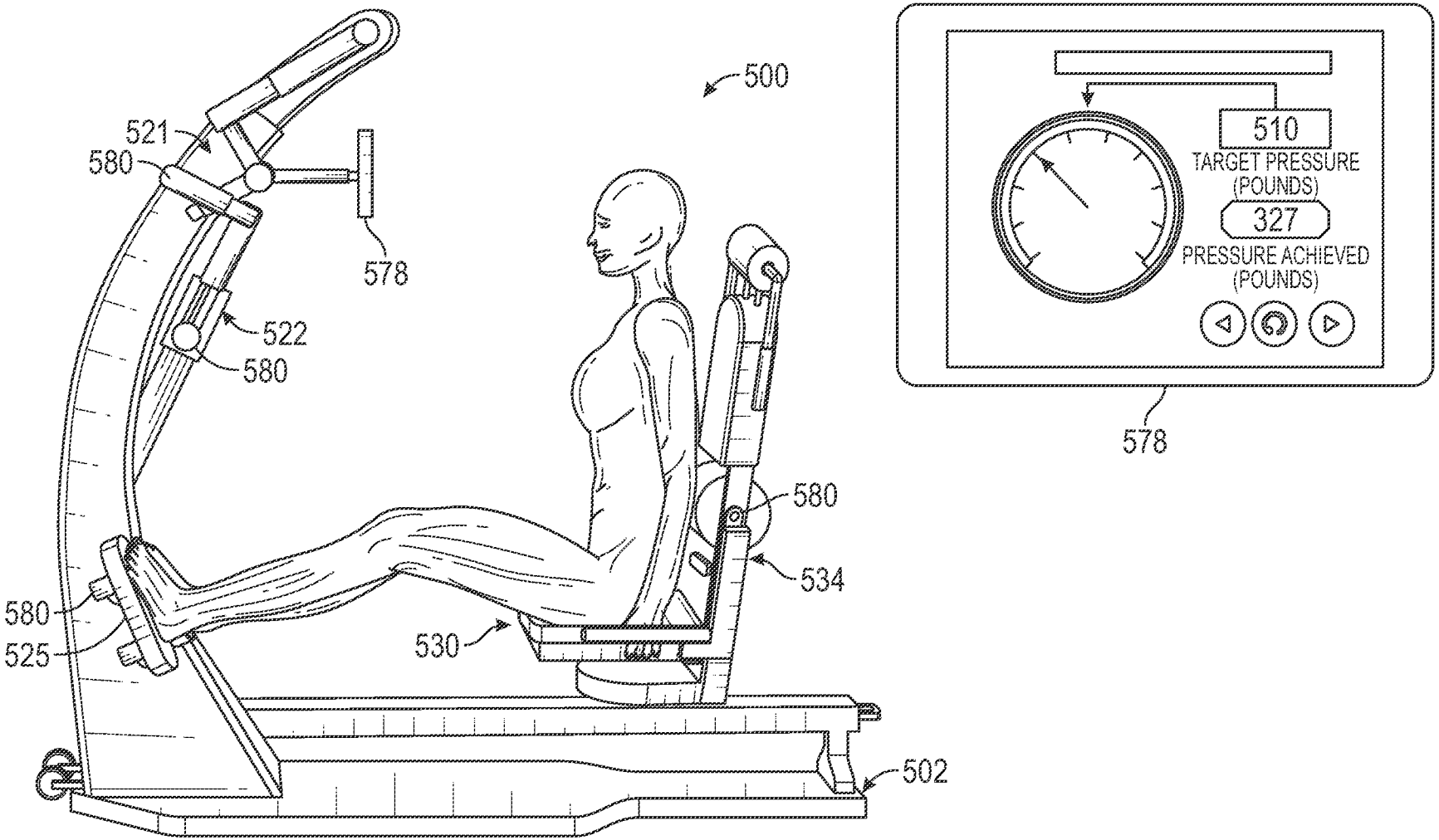
Figure 24:
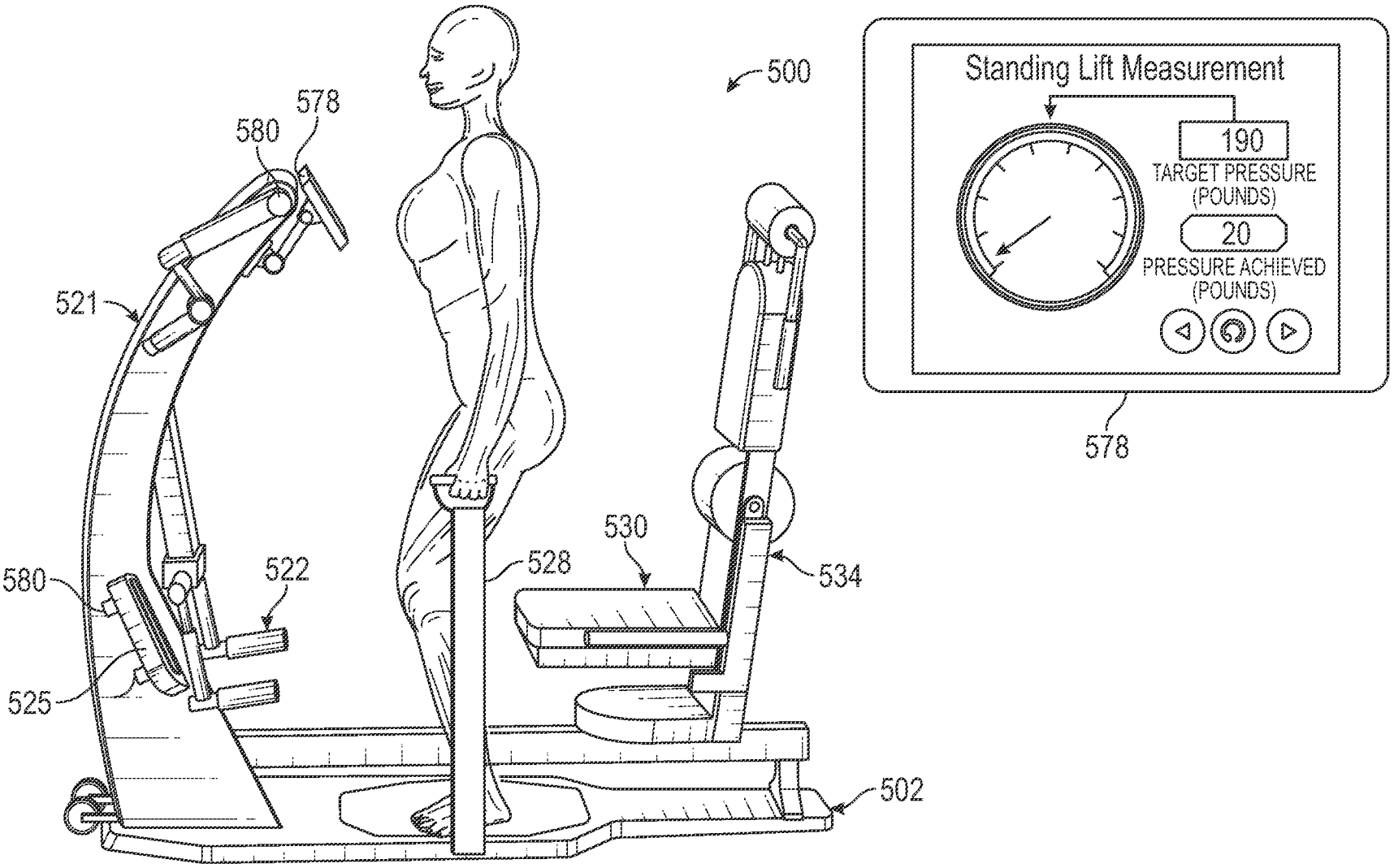
Figure 25:
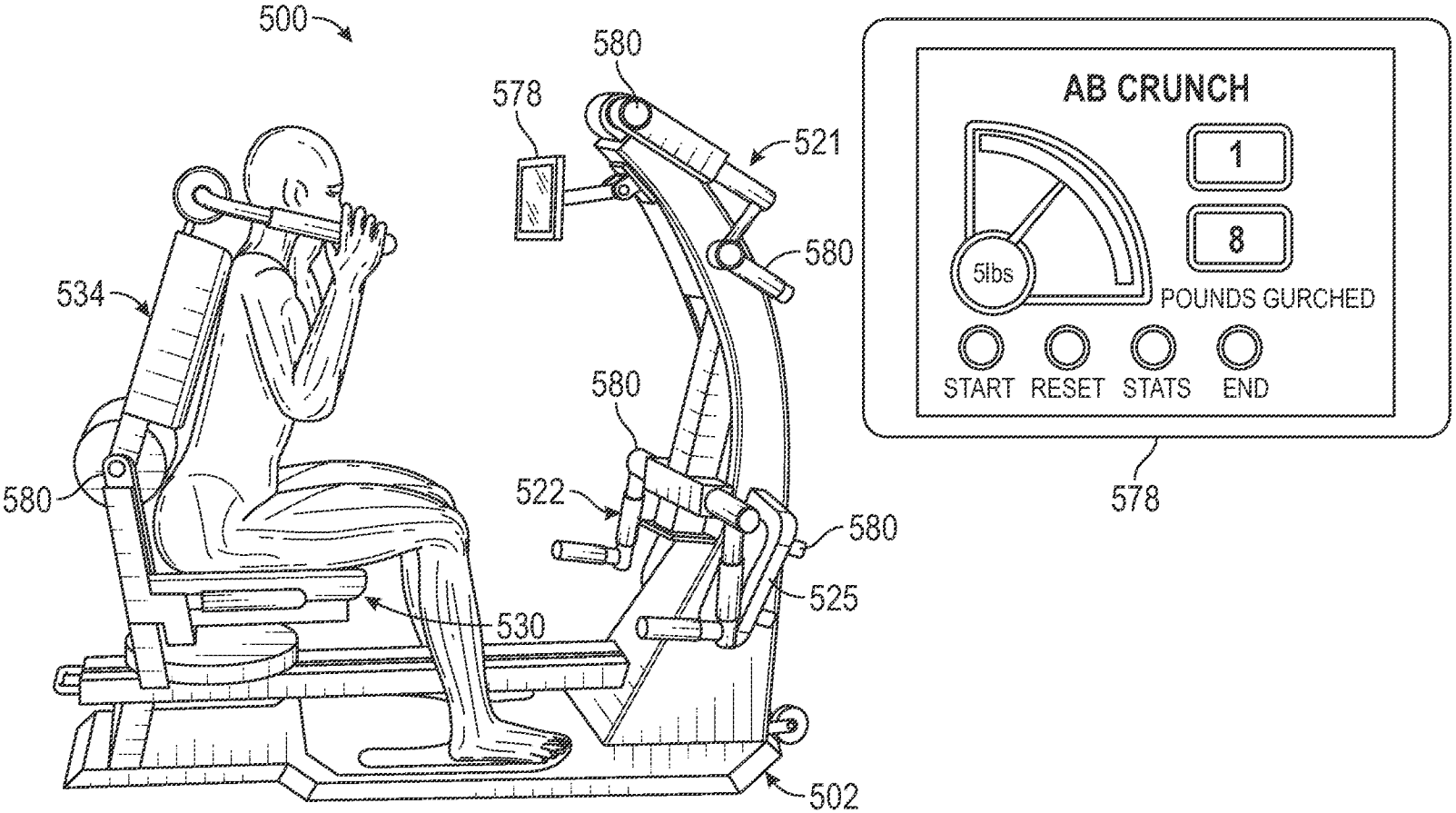
Figure 26:
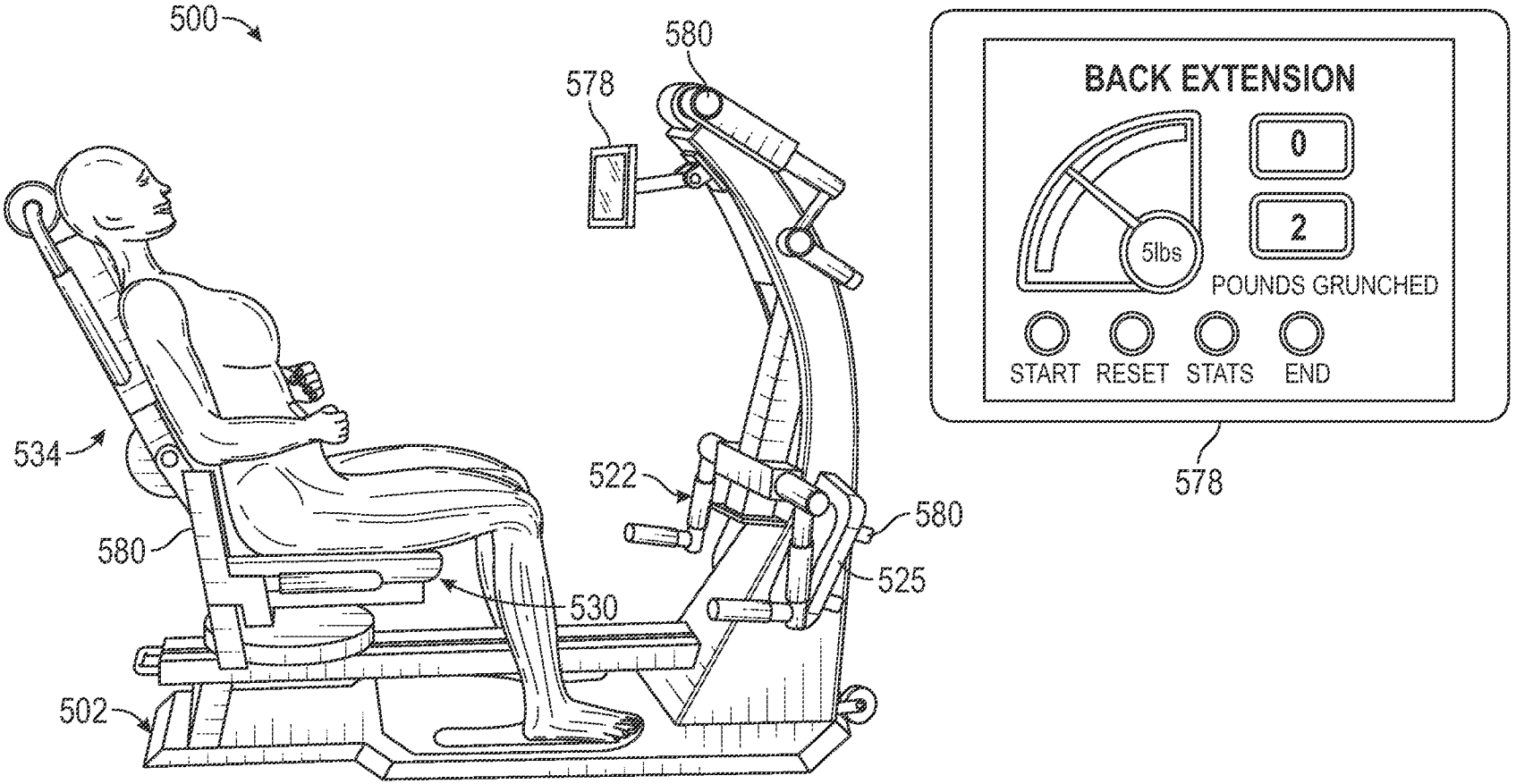

FIGS. 21-26 show a fifth exemplary embodiment of an exercise machine 500 for exercising at least one body part of a user. The exercise machine 500 can include at least one dynamic device 528 (see, FIG. 22) and at least one isometric device 521, 525. As with some of the embodiments described above, the exercise machine 500 can include the pair of upper load handles 521 and the pair of middle load handles 522. The upper load handles 521 and middle load handles 522 may not only be used for isometric exercises enabling bone osteogenesis, but may also be employed for various dynamic exercises enabling muscle hypertrophy. As best shown in FIG. 22, the at least one flexible band 528 can engage the pair of upper load handles 521 to provide a dynamic pull-down-type exercise. As best shown in FIG. 24, the at least one flexible band 528 can engage the base 502 to be used in a dynamic standing-lift-type exercise. FIGS. 25 and 26 show the at least one flexible band 528 can be attached between the seat 530 and the back portion 534 to provide resistance for dynamic crunch-type and back-extension-type exercises. In each exercise, based on one or more signals from the plurality of load cells 580, the control console 578 can provide feedback to the user such as a target pressure and pressure achieved.

Figure 27:
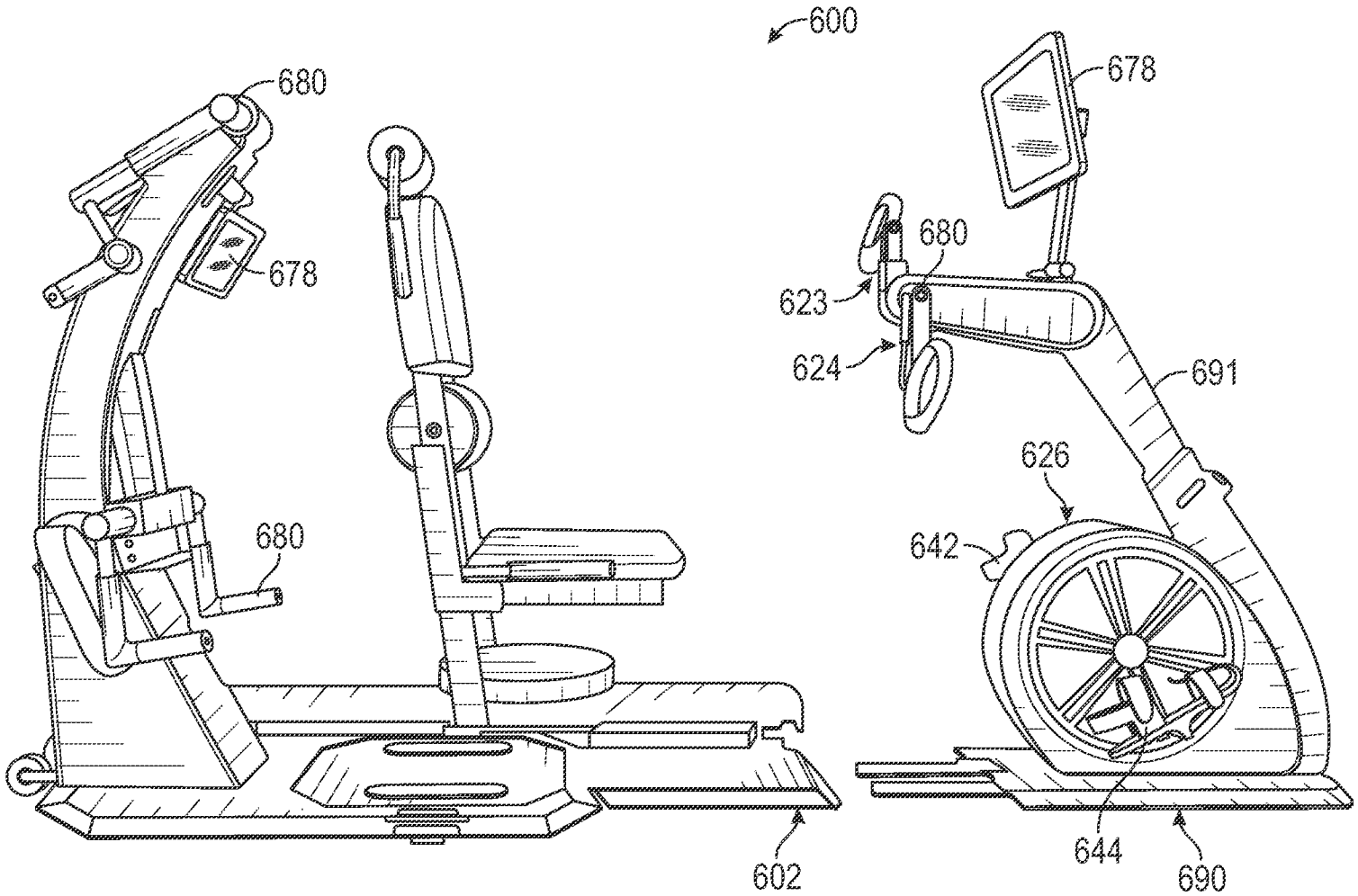
FIGS. 27-28 illustrate a sixth exemplary embodiment of an exercise machine, according to aspects of the disclosure.
Figure 28:
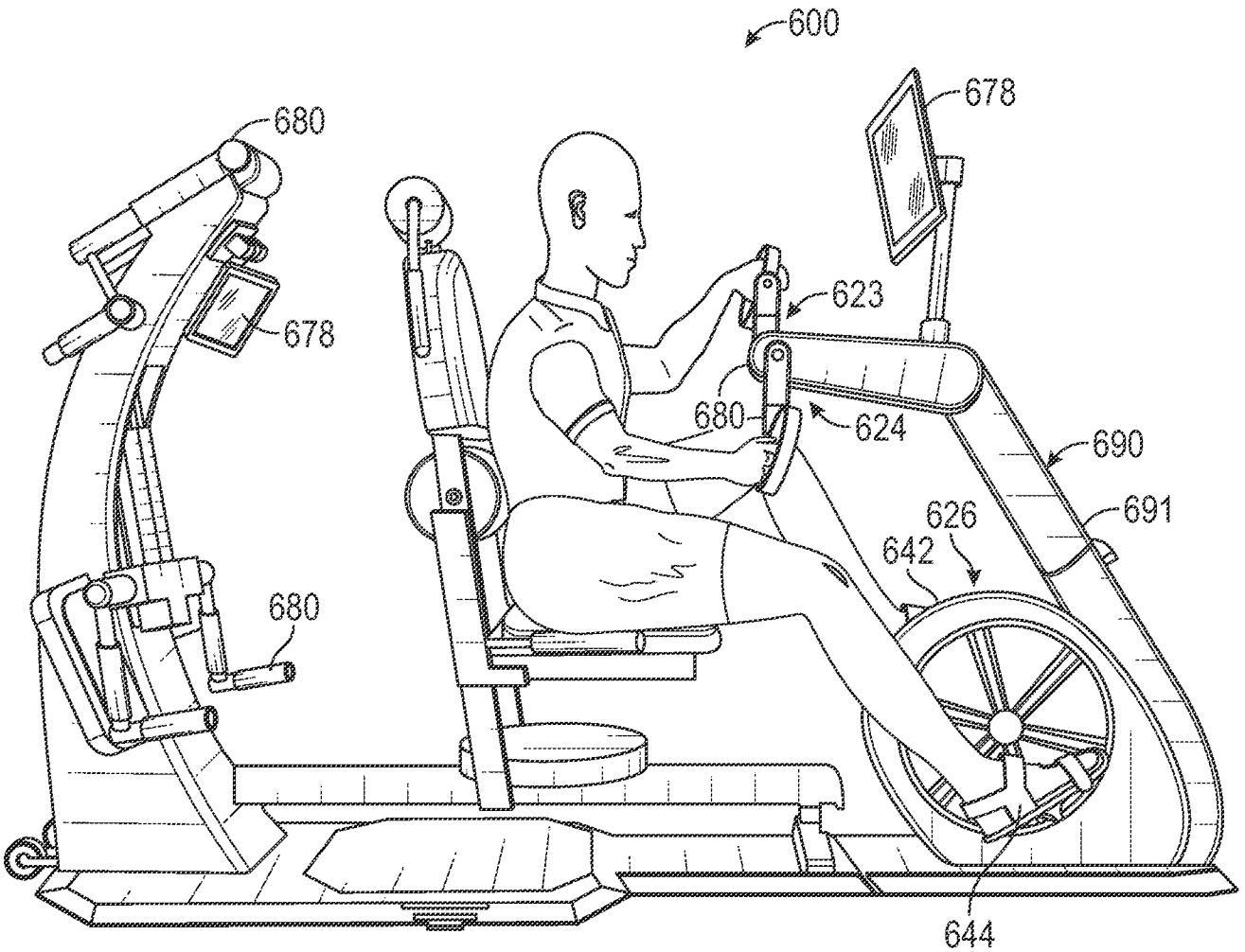
Figure 29:
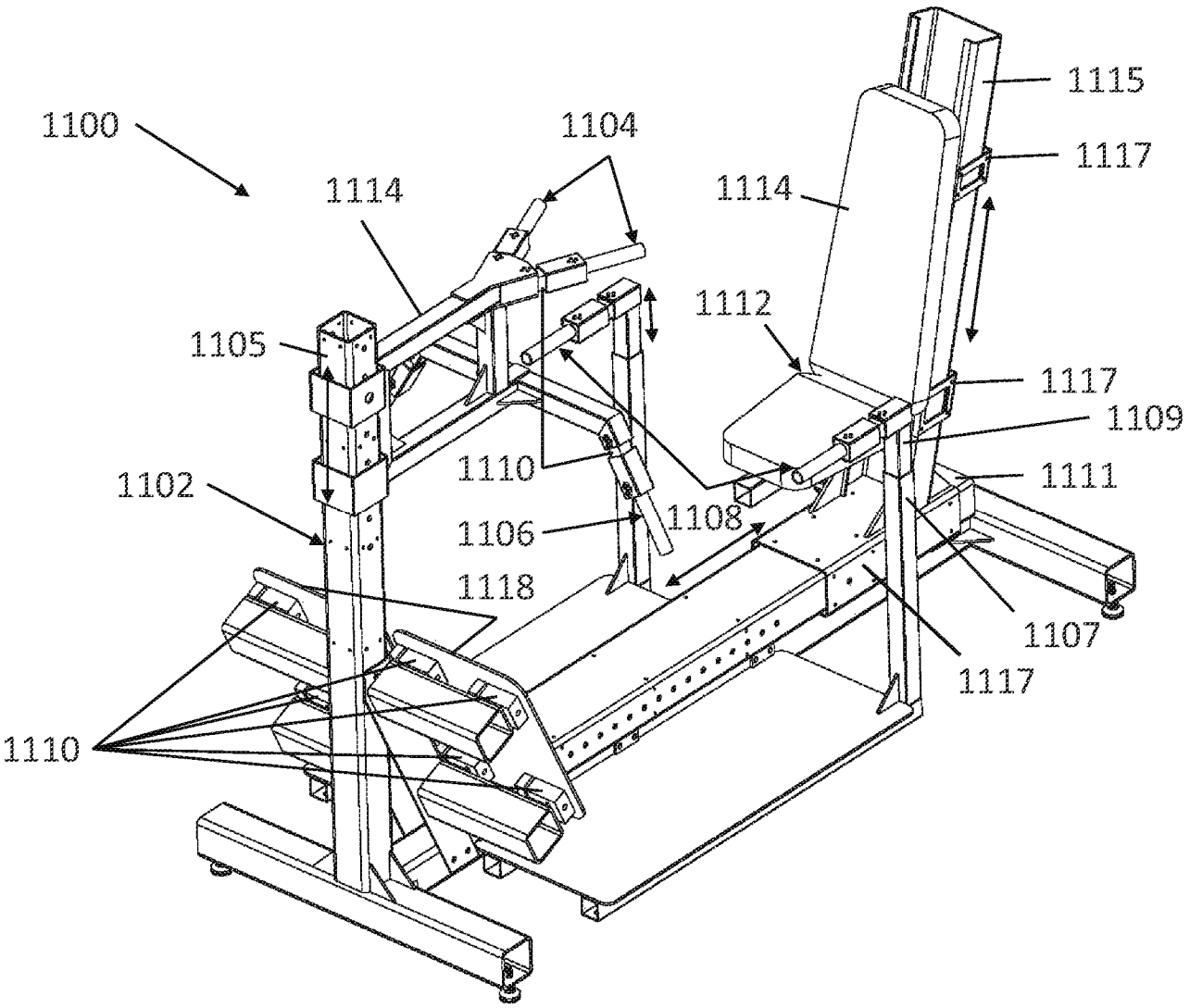
FIG. 29 is a perspective view of one embodiment of a system for isometric exercise and rehabilitation.
Figure 30:
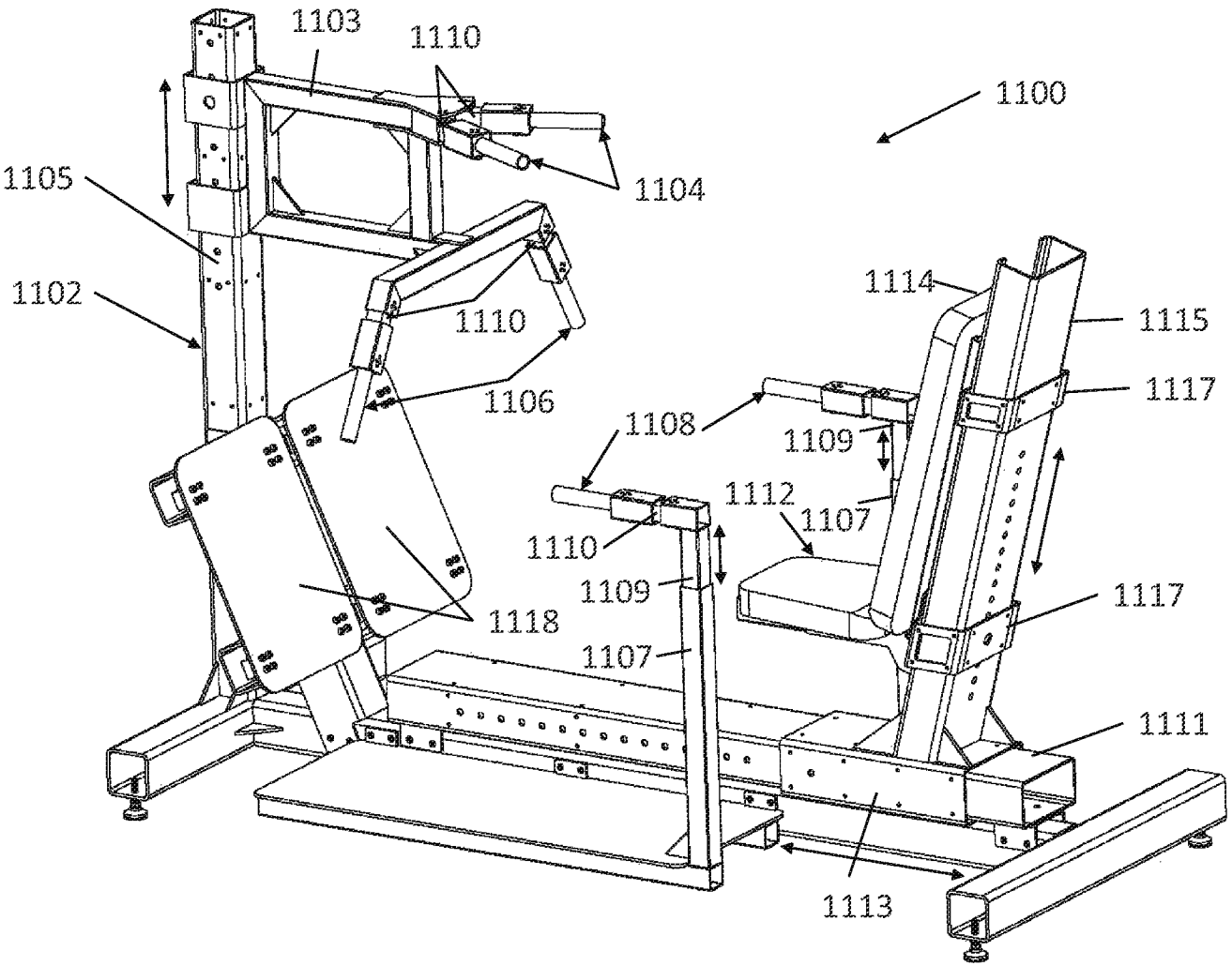
FIG. 30 is a reverse perspective view of the system of FIG. 29.
Figure 31:
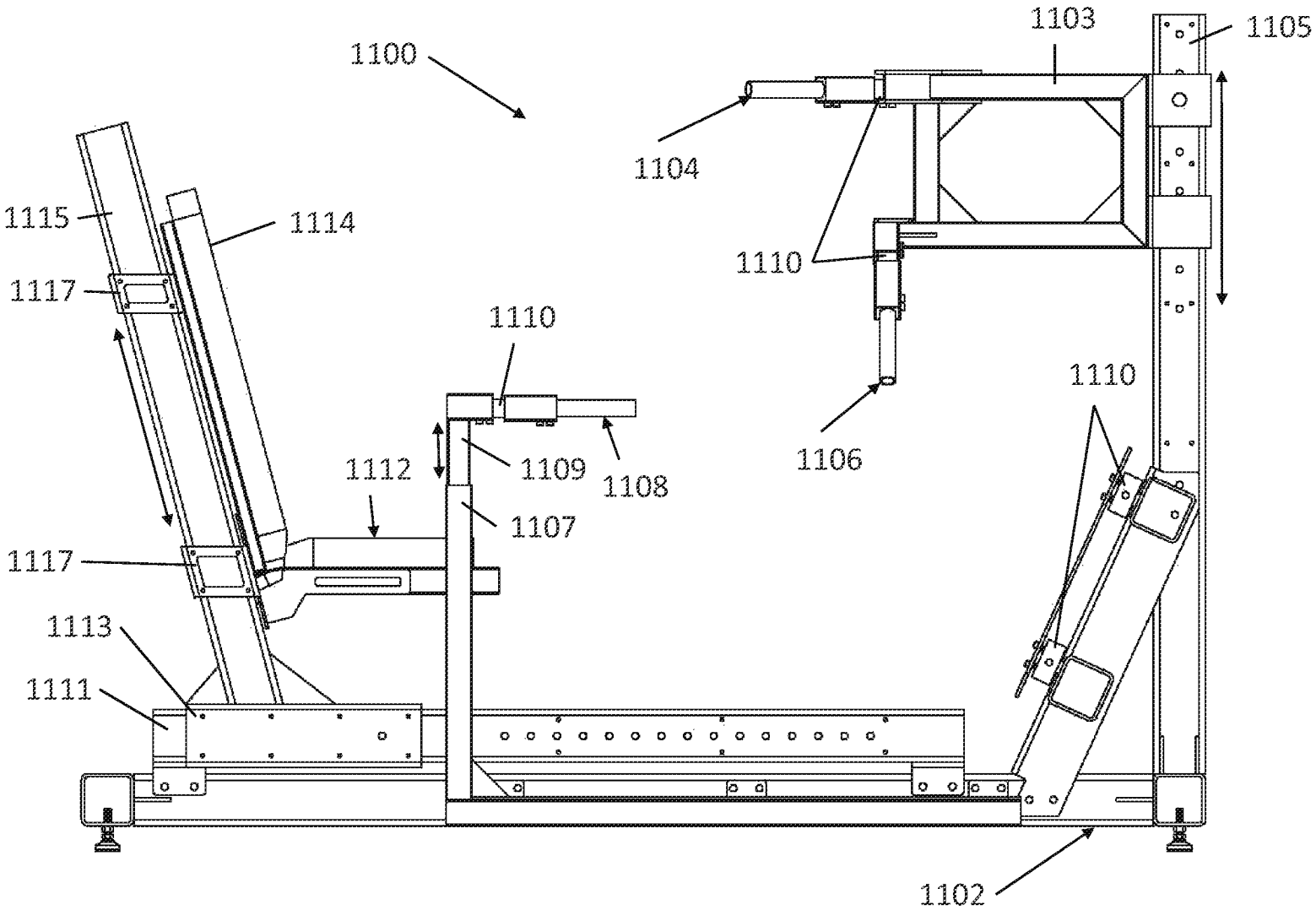
FIG. 31 is a side view of the system of FIG. 29.
Figure 32:
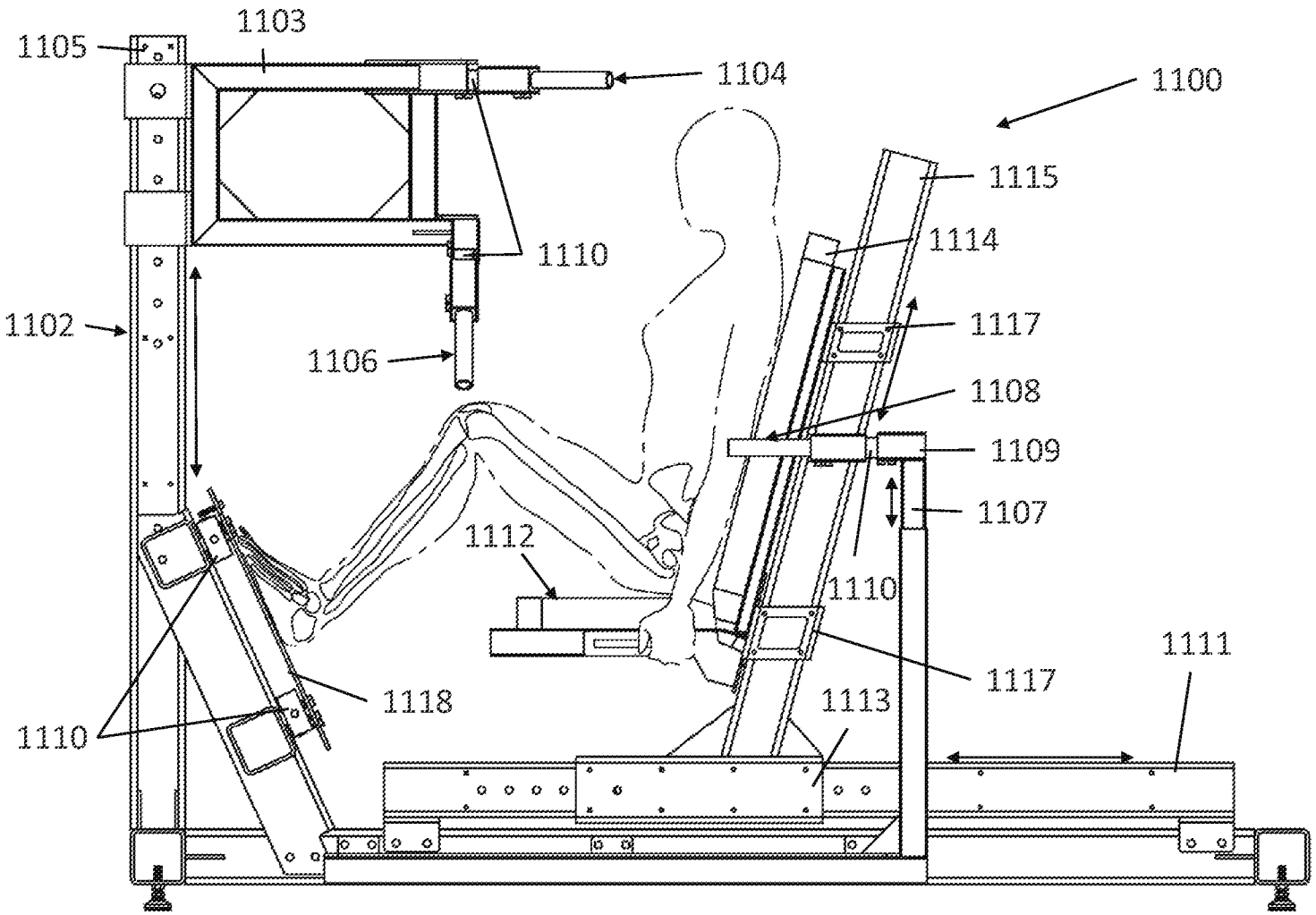
FIG. 32 is a side view of the system of FIG. 29 with a user performing a leg-press-style exercise.
Figure 33:
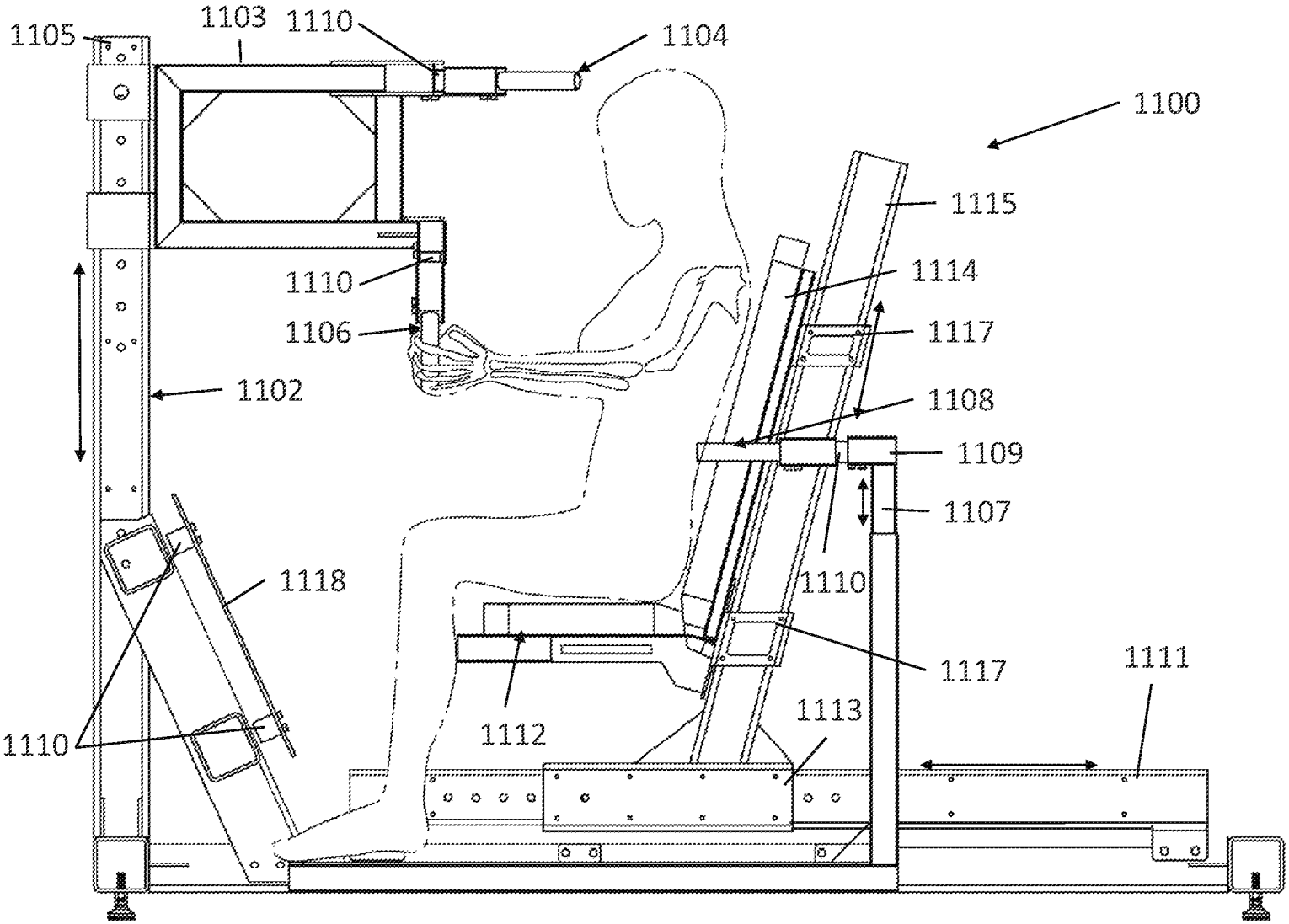
FIG. 33 is a side view of the system of FIG. 29 with a user performing a chest-press-style exercise.
Figure 34:
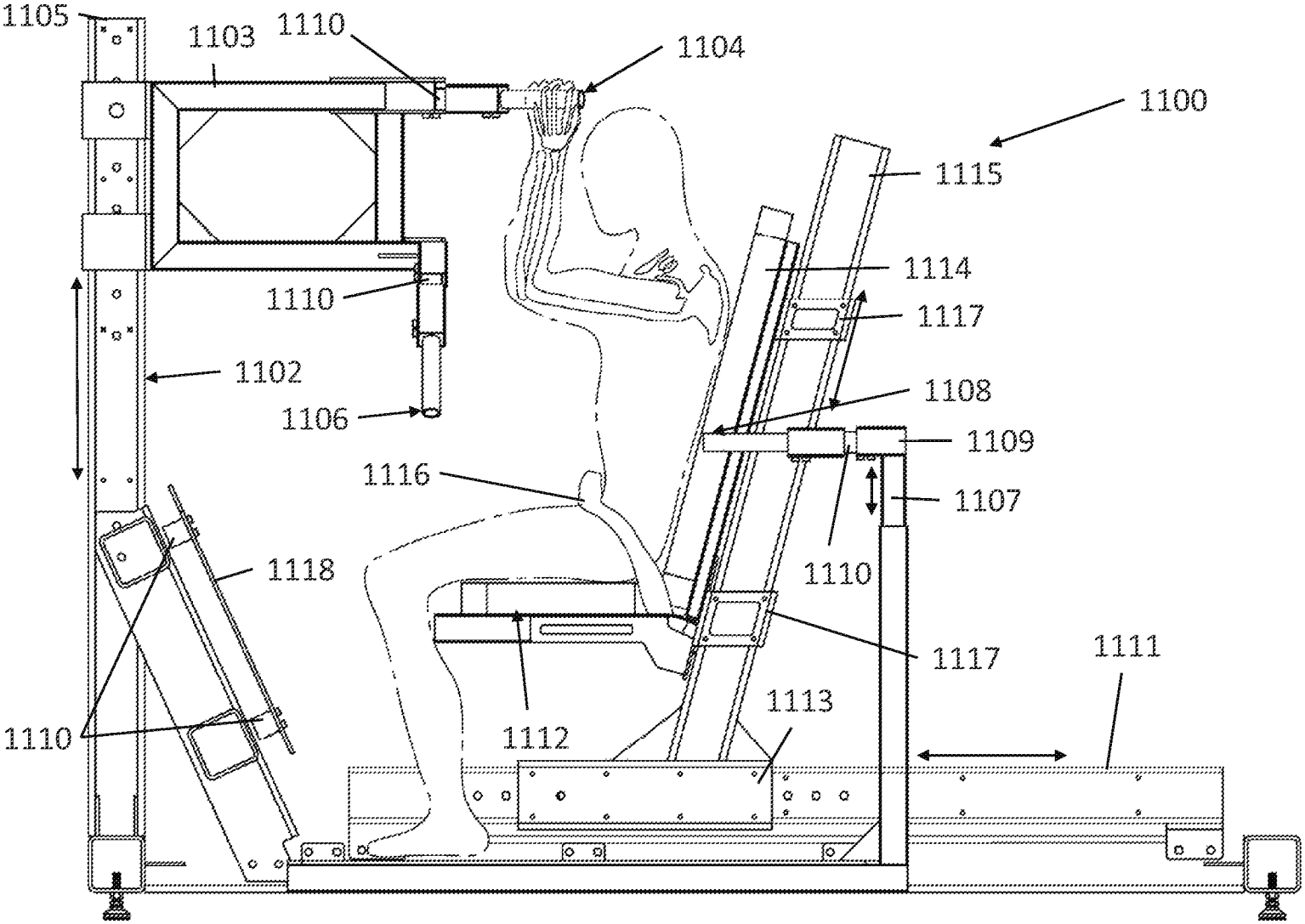
FIG. 34 is a side view of the system of FIG. 29 with a user performing a core-pull-style exercise.
Figure 35:
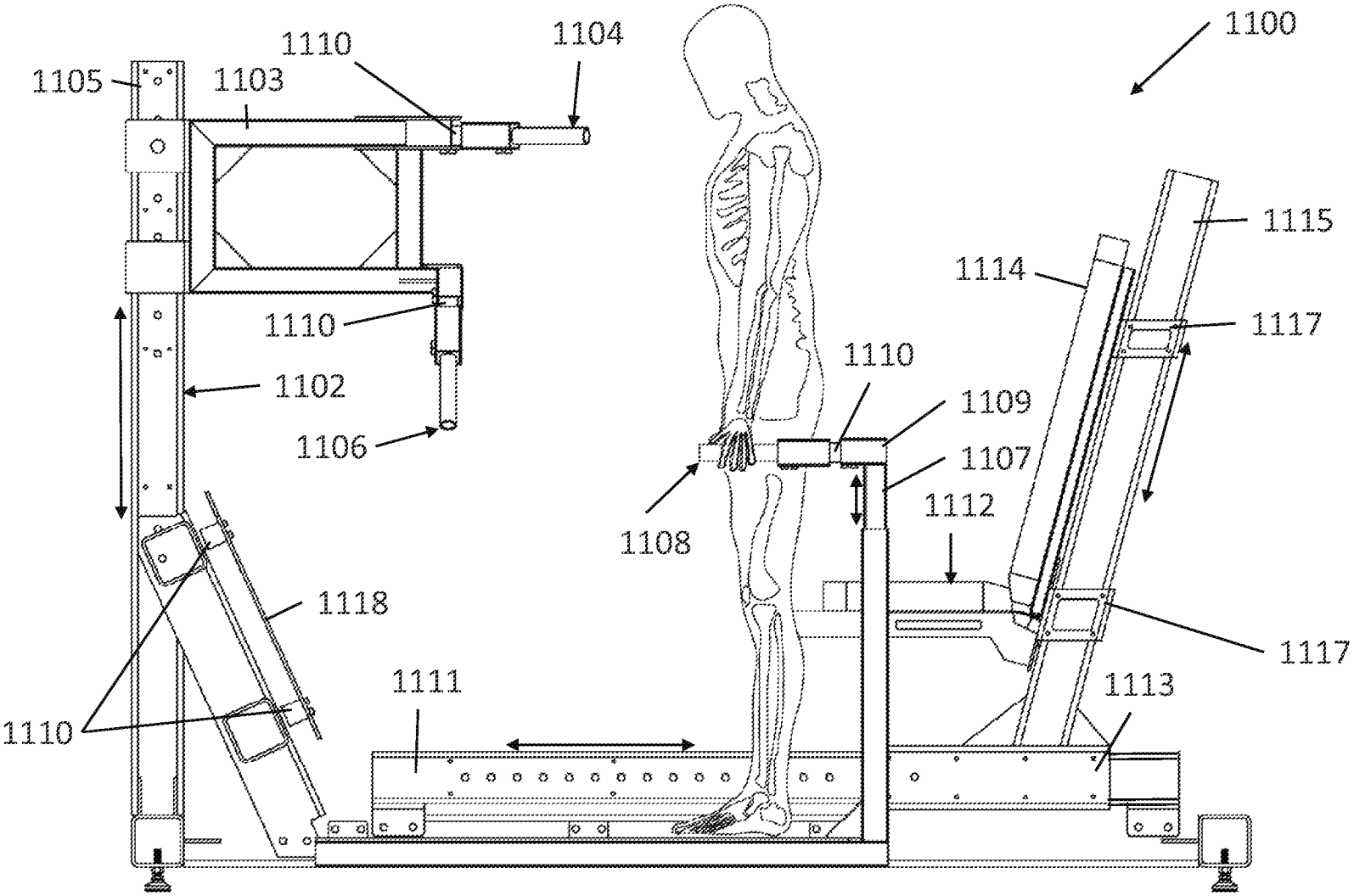
FIG. 35 is a side view of the system of FIG. 29 with a user performing a suitcase lift-style exercise.
Figure 36:
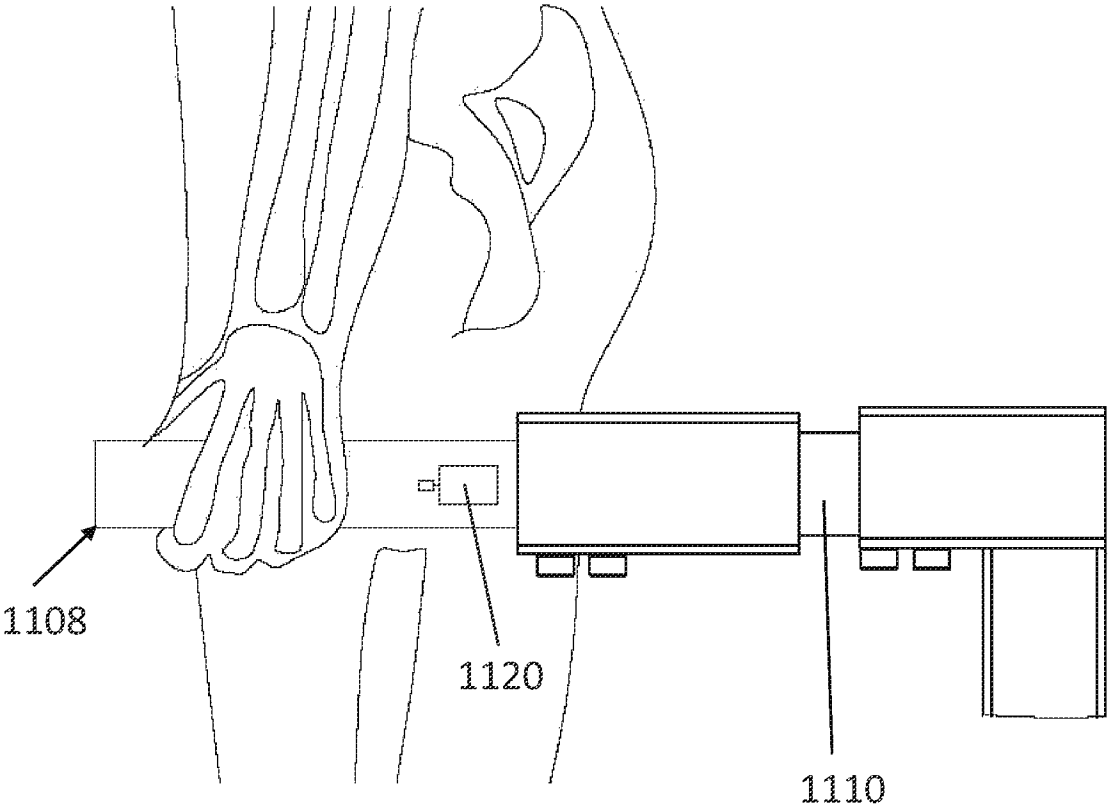
FIG. 36 is an enlarged view of an embodiment of a handle portion of the system of FIG. 29 with a user performing a suitcase lift-style exercise.

FIGS. 27-28 show a sixth exemplary embodiment of an exercise machine 600 for exercising at least one body part of a user. The exercise machine 600 is separable into a machine representative of the exercise machine 500. In addition, a separable portion 690 may be selectively coupled to the exercise machine 500. The separable portion 690 can include a second main post 691 and may also include the cycle mechanism 626 adjacent to the second main post 691. In more detail, the cycle mechanism 626 may include at least one pedal 642, 644 that can be configured to allow the user to engage and rotate the cycle mechanism 626, as described above. The additional portion 690 of exercise machine 600 can also include a first pivoting assembly 623 and a second pivoting assembly 624 coupled to a pivotable about the second main post 691. Such an arrangement is analogous to what is described above for exercise machine 300. Based on one or more signals from the plurality of load cells 680, the control console 678 can provide feedback to the user, such as a target pressure and pressure achieved.

The present disclosure further comprises a method of using an exercise machine for enabling a user to exercise. A step of the method can be providing an exercise machine having an isometric device and a dynamic device. Such a machine can be like the machines 100-600 described above. Another step of the method can be selectively engaging at least one of the isometric device and dynamic device. Yet another step of the method can be receiving to at least one of the isometric and dynamic devices an application of force by the user sufficient to facilitate at least one of osteogenesis and muscle hypertrophy.

FIGS. 29-51 illustrate embodiments of an osteogenic, isometric exercise and rehabilitation system and assembly. An aspect of the disclosure includes an isometric exercise and rehabilitation system or assembly 1100. The assembly 1100 can include a frame 1102. The assembly 1100 can further include one or more pairs of load handles 1104, 1106, 1108 (e.g., three shown) supported by the frame 1102. Each load handle in one of the pairs of load handles 1104, 1106, 1108 can be symmetrically spaced from each other relative to a vertical plane of the assembly 1100. For example, the vertical plane can bisect the assembly 1100 in a longitudinal direction.

During exercise, a user can grip and apply force to one of the pairs of load handles 1104, 1106, 1108. The term "apply force" can include a single force, more than one force, a range of forces, etc. Each load handle in the pairs of load handles 1104, 1106, 1108 can include at least one load cell 1110 for separately and independently measuring a force applied to respective load handles.

The placement of a load cell 1110 in each pair of load handles 1104, 1106, 1108 can provide the ability to read variations in force applied between the left and right sides of the user. This allows a user or trainer to understand relative strength. This is also useful in understanding strength when recovering from an injury.

In some embodiments, the assembly 1100 can further include a computer (not shown). One or more of the load cells 1110 can be individually in electrical communication (or other types of communication) with the computer. In some embodiments, the assembly 1100 can further include a graphical display monitor in electrical communication with the computer for providing information to the users. The information can include how to perform exercises, how much force is being applied, a target force to be applied, historical information for the user about how much force they applied during prior sessions, comparisons to averages, etc. Other types of communication may include mechanical, electromechanical, optical, hydraulic, etc.

In some embodiments, the assembly 1100 further includes a seat 1112 supported by the frame 1102 in which a user sits while applying force to the load handles. In some embodiments, the seat 1112 can include a support such as a back rest or backboard 1114. In some embodiments, the position of the seat 1112 is adjustable in a horizontal and/or vertical dimension. In some embodiments, the angle of the seat 1112 is adjustable. In some embodiments, the angle of the backboard 1114 is adjustable. Examples of how adjustments to the seat 1112 and backboard 1112 can be implemented include, but are not limited to, using telescoping tubes and pins, hydraulic pistons, electric motors, etc. In some embodiments, the seat 1112 can further include a fastening system 1116 (FIG. 34), such as a seat belt, for securing the user to the seat 1112.

In one example, the seat 1112 can include a base 1113 that is slidably mounted to a horizontal rail 1111 of the frame 1102. The seat 1112 can be selectively repositionable and secured as indicated by the double-headed arrow. In another example, the seat 1112 can include one or more supports 1117 (e.g., two shown) that are slidably mounted to a substantially vertical rail 1115 of the frame 1102. The seat 1112 can be selectively repositionable and secured as indicated by the double-headed arrow.

In some embodiments, a first pair of load handles 1104 can be located above and in front of the seat 1112. The user can apply force to the load handles 1104 while being constrained in the seat 1112 by the fastening system 1116 in a core-pull-style exercise. The core-pull-style exercise can provide or enable osteogenesis, bone growth or bone density improvement for a portion of the skeletal system of the user. In a core-pull-style exercise, while the lower body of the user is restrained from upward movement by the fastening system 1116, the user can sit in the seat 1112, apply the fastening system 1116, hold the first pair of load handles 1104, and pull on the first pair of load handles 1104 with their arms.

In some embodiments, adjustments can be made to the position of the first pair of load handles 1104. For example, these adjustments can include the height of the first pair of load handles 1104, the distance between the first pair of load handles 1104 and the seat 1112, the distance between each handle of the first pair of load handles 1104, the angle of the first load handles 1104 relative to the user, etc. In some embodiments, to account for natural differences in limb length or injuries, each handle of the first pair of load handles 1104 can be adjusted separately.

In one example, the first pair of load handles 1104 can include a sub-frame 1103 that is slidably mounted to a vertical rail 1105 of the frame 1102. The first pair of load handles 1104 can be selectively repositionable and secured as indicated by the double-headed arrow.

In some embodiments, a second pair of load handles 1106 can be spaced apart from and in the front of the seat 1112. While seated (FIGS. 33 and 43), the user can apply force to the second pair of load handles 1106 in a chest-press-style exercise. The chest-press-style exercise can provide or enable osteogenesis, bone growth or bone density improvement for another portion of the skeletal system of the user. In a chest-press-style exercise, the user can sit in the seat 1112, hold the second pair of load handles 1106, and push against the second pair of load handles 1106 with their arms.

In some embodiments, adjustments can be made to the position of the second pair of load handles 1106. These adjustments can include the height of the second pair of load handles 1106, the distance between the second pair of load handles 1106 and the seat 1112, the distance between each handle of the second pair of load handles 1106, the angle of the second load handles 1106 relative to the user, etc. In some embodiments, to account for natural differences in limb length or injuries, each handle of the second pair of load handles 1106 can be adjusted separately.

In one example, the second pair of load handles 1106 can include the sub-frame 1103 that is slidably mounted to the vertical rail 1105 of the frame 1102. The sub-frame 1103 can be the same sub-frame 1103 provided for the first pair of load handles 1104, or a different, independent sub-frame. The second pair of load handles 1106 can be selectively repositionable and secured as indicated by the double-headed arrow.

In some embodiments (FIGS. 35, 36 and 45), a third pair of load handles 1108 can be located immediately adjacent the seat 1112, such that the user can stand and apply force in a suitcase-lift-style exercise. The suitcase-lift-style exercise can provide or enable osteogenesis, bone growth or bone density improvement for still another portion of the skeletal system of the user. Examples of the third pair of load handles 1108 can extend horizontally along a pair of respective axes that are parallel to the vertical plane. The third pair of load handles 1108 can be horizontally co-planar, such that a user can apply force to them in a suitcase-lift-style exercise. In the suitcase-lift-style exercise, the user can stand on the floor or a horizontal portion of the frame 1102, bend their knees, grip the third pair of load handles 1108, and extend their legs to apply an upward force to the third pair of load handles 1108.

In some embodiments, adjustments can be made to the position of the third pair of load handles 1108. These adjustments can include the height of the third pair of load handles 1108, the distance between the third pair of load handles 1108 and the seat 1112, the distance between each handle of the third pair of load handles 1108, the angle of the third load handles 1108 relative to the user, etc. In some embodiments, to account for natural differences in limb length or injuries, each handle of the third pair of load handles 1108 can be adjusted separately.

In one example, each load handle 1108 of the third pair of load handles 1108 can include a sub-frame 1109 that is slidably mounted in or to a vertical tube 1107 of the frame 1102. Each load handle 1108 of the third pair of load handles 1108 can be selectively repositionable and secured as indicated by the double-headed arrows.

In other embodiments (not shown), the third pair of load handles 1108 can be reconfigured to be coaxial and located horizontally in front of the user along an axis that is perpendicular to the vertical plane. The user can apply force to the third pair of load handles 1108 in a deadlift-style exercise. Like the suitcase-lift-style exercise, the deadlift-style exercise can provide or enable osteogenesis, bone growth or bone density improvement for a portion of the skeletal system of the user. In the deadlift-style exercise, the user can stand on the floor or a horizontal portion of the frame 1102, bend their knees, hold the third pair of load handles 1108 in front of them, and extend their legs to apply an upward force to the third pair of load handles 1108. In some embodiments, the third pair of load handles 1108 can be adjusted (e.g., rotated) from the described coaxial position used for the deadlift-style exercise, to the parallel position (FIGS. 35, 36 and 51) used for the suitcase lift-style exercise. The third pair of load handles 1108, or others, can be used in a grip strengthening-style exercise to improve strength in the muscles of the hand and forearm.

The isometric exercise and rehabilitation equipment of the disclosure may separately measure forces exerted by both the left and right sides of the user to enhance osteogenesis, thereby enabling bone growth. Moreover, one or more haptic devices may be used in the isometric exercise and rehabilitation equipment to provide haptic feedback to the user during an exercise. In some embodiments, the haptic feedback may be provided by the haptic device based on a force measured by a load cell.

"Haptic feedback" may include, but is not limited to, any movement or activity that is electrically, mechanically, and/or electromechanically generated and capable of being perceived sensorially by a user.

In some embodiments, the assembly 1100 may further include at least one haptic device 1120 (FIGS. 36-39) configured to provide haptic feedback based on the force measured by at least one of the load cells 1110. In some embodiments, the haptic device 1120 is an eccentric rotating mass vibration motor (as shown in FIGS. 36-39), such as a Precision Microdrives™ Model No. 304-108 4 mm Vibration Motor. In some embodiments, the haptic device 1120 is a piezoelectric actuator or a linear resonant actuator, such as a Precision Microdrives™ Model No. C10-100 10 mm Linear Resonant Actuator. The haptic feedback may refer to a vibration, force, and/or motion generated by the haptic device 1120 that is experienced by the user during the exercise.

In some embodiments, the haptic device 1120 is located in load handles 1104, 1106, 1108. In some embodiments, the haptic device 1120 is located in the foot plates 1118. In some embodiments, where there is a single load handle, the haptic device 1120 is located in the single load handle. In some embodiments where there is a single foot plate 1118, the haptic device 1120 is located in the single foot plate. In some embodiments, the haptic device 1120 is located in the seat 1112. In some embodiments, the haptic device 1120 is located in the backrest 1114. In some embodiments, the haptic device 1120 is in communication with the computer.

In some embodiments, the haptic device 1120 is configured to provide haptic feedback in response to the force measured by one or more of the load cells 1110 exceeding a threshold force. In some embodiments, the threshold force is determined by the computer. In some embodiments, a threshold force is input, such as by a supervisor, a user, an autonomous device, etc. In some embodiments, the haptic device 1120 is configured to provide haptic feedback. In some embodiments, the haptic feedback occurs when the force measured exceeds the threshold force. In some embodiments, the haptic feedback occurs exclusively while the force measured exceeds the threshold force. In some embodiments, the haptic device 1120 provides haptic feedback for a predetermined amount of time. In some embodiments, the amount of time is determined by the computer. In some embodiments, a supervising user (e.g., a trainer) inputs the amount of time. In a preferred embodiment, the haptic device 1120 provides haptic feedback once the force measured exceeds the threshold force and stops providing the haptic feedback once a predetermined amount of time has passed or once the force measured drops below the threshold force.

In some embodiments, the assembly 1100 has pairs of load handles 1104, 1106, 1108 or pairs of foot plates 1118, with each respective load handle 1104, 1106, 1108 or foot plate 1118 of each pair 1104, 1106, 1108, 1118 having its own respective load cell 1110 or set of load cells 1110 and respective haptic device 1120 or set of haptic devices 1120. In a preferred embodiment, the respective haptic device 1120 provides haptic feedback when the force measured by its respective load cell 1110 or set of load cells 1110 exceeds the threshold force. For instance, when the user is performing a leg press on the assembly 1100 with two foot plates 1118 (a right foot plate and a left foot plate), each having its own respective set of load cells 1110 (a right load cell set and a left load cell set) and respective haptic device 1120 (a right haptic device and a left haptic device), each respective haptic device 1120 may provide haptic feedback when that set of load cells measures a force that exceeds the threshold force. For example, if a threshold force of 200 pounds is set for each foot, the haptic feedback may be provided by the right haptic device 1120 on the right foot plate when the measured by the right load cell set exceeds 200 pounds, independent of how much force was measured by the left load cell set. In yet another embodiment, a seat haptic device 1120 may be located in the frame-supported seat 1112 and provide haptic feedback when both sets of load cells 1110 measure forces exceeding the threshold force and for a pre-determined amount of time.

Figure 37:
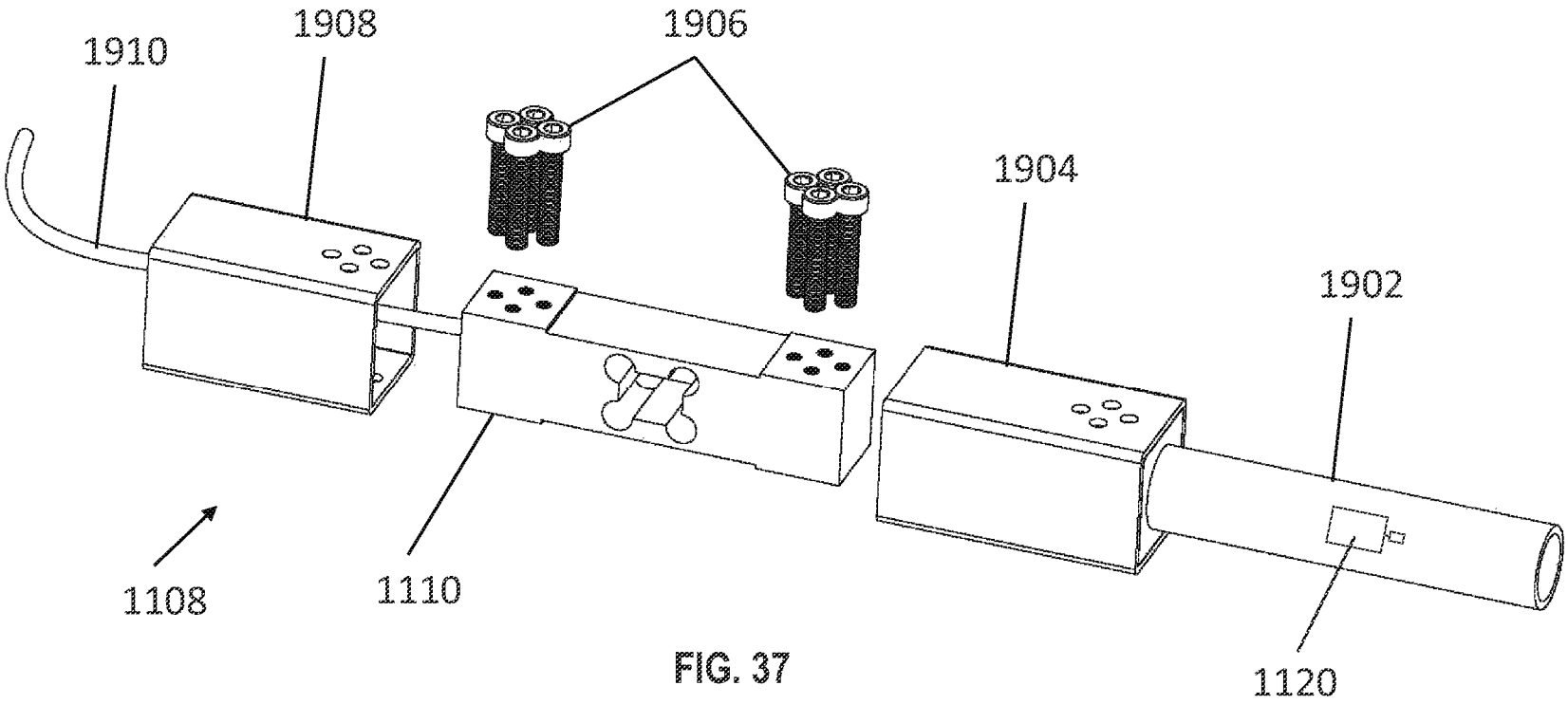
FIG. 37 is an exploded perspective view of an embodiment of a handle for the system of FIG. 29.
Figure 38:
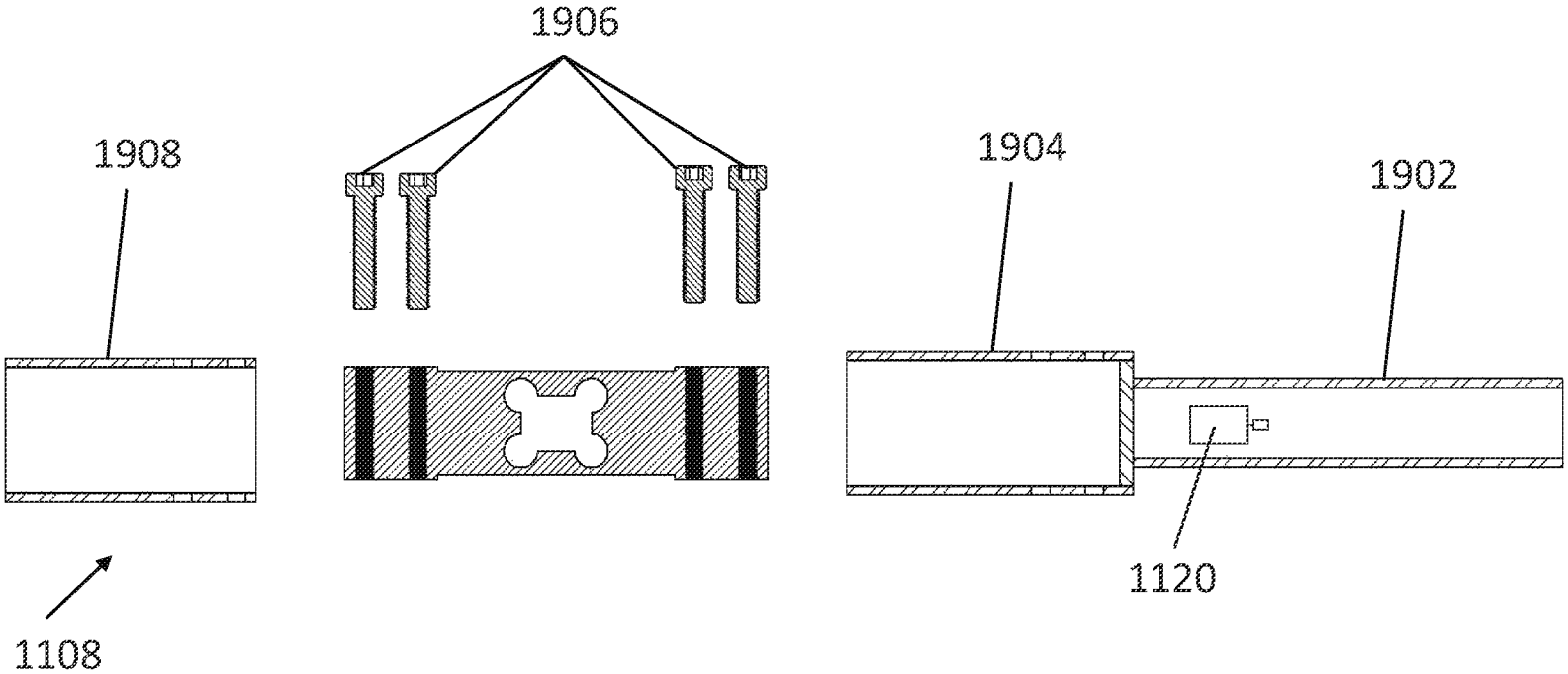
FIG. 38 is an exploded side view of the handle of FIG. 37.
Figure 39:
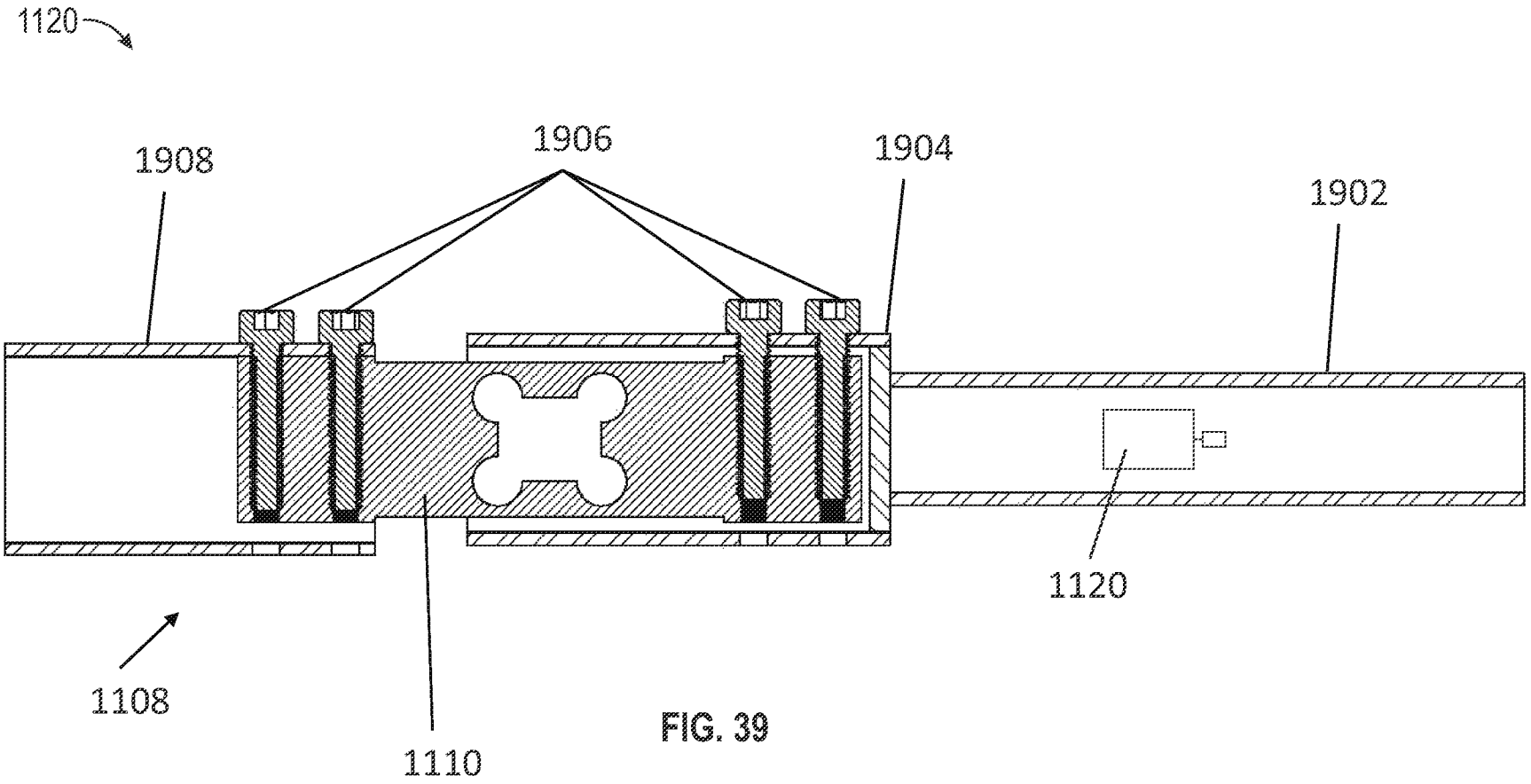
FIG. 39 is a sectional side view of an embodiment of the handle of FIG. 37.

FIGS. 37-39 show another example of the third pair of load handles 1108. In this version, a grip 1902 can be coupled to a first rectangular tube 1904. The first rectangular tube 1904 can be coupled with fasteners 1906 to one of the load cells 1110. An opposite end of the load cell 1110 can be coupled with additional fasteners 1906 to a second rectangular tube 1908. A cable 1910 can be coupled to the load cell 1110 and can carry a signal from the load cell 1110 to the computer. In some embodiments, each of the load cells 1110 can be in wireless electrical communication with the computer.

Embodiments of the isometric exercise and rehabilitation assembly 1100 can further include one or more foot plates 1118 (e.g., two shown) coupled to the frame 1102. Each foot plate 1118 can be coupled to at least one load cell 1110 (e.g., four shown per foot plate 1118) for separately and independently measuring left and right leg forces applied to the foot plate 1118 by the user in a leg-press-style exercise. The leg-press-style exercise can provide or enable osteogenesis, bone growth or bone density improvement for a different portion of the skeletal system of the user.

In some embodiments, adjustments can be made to the positions of the foot plates 1118. In some embodiments, the position of the footplates 1118 is adjustable in a horizontal and/or vertical dimension. In some embodiments, the angle of the footplates 1118 relative to the seat 1112 or backboard 1114 is adjustable. Examples of how adjustments to the footplates 1118 can be implemented include, but are not limited to, using telescoping tubes and pins, hydraulic pistons, and electric motors. In some embodiments, the foot plates 1118 are retractable. In some embodiments, the foot plates 1118 can fold from an engaged position to a stored position.

Figure 40:
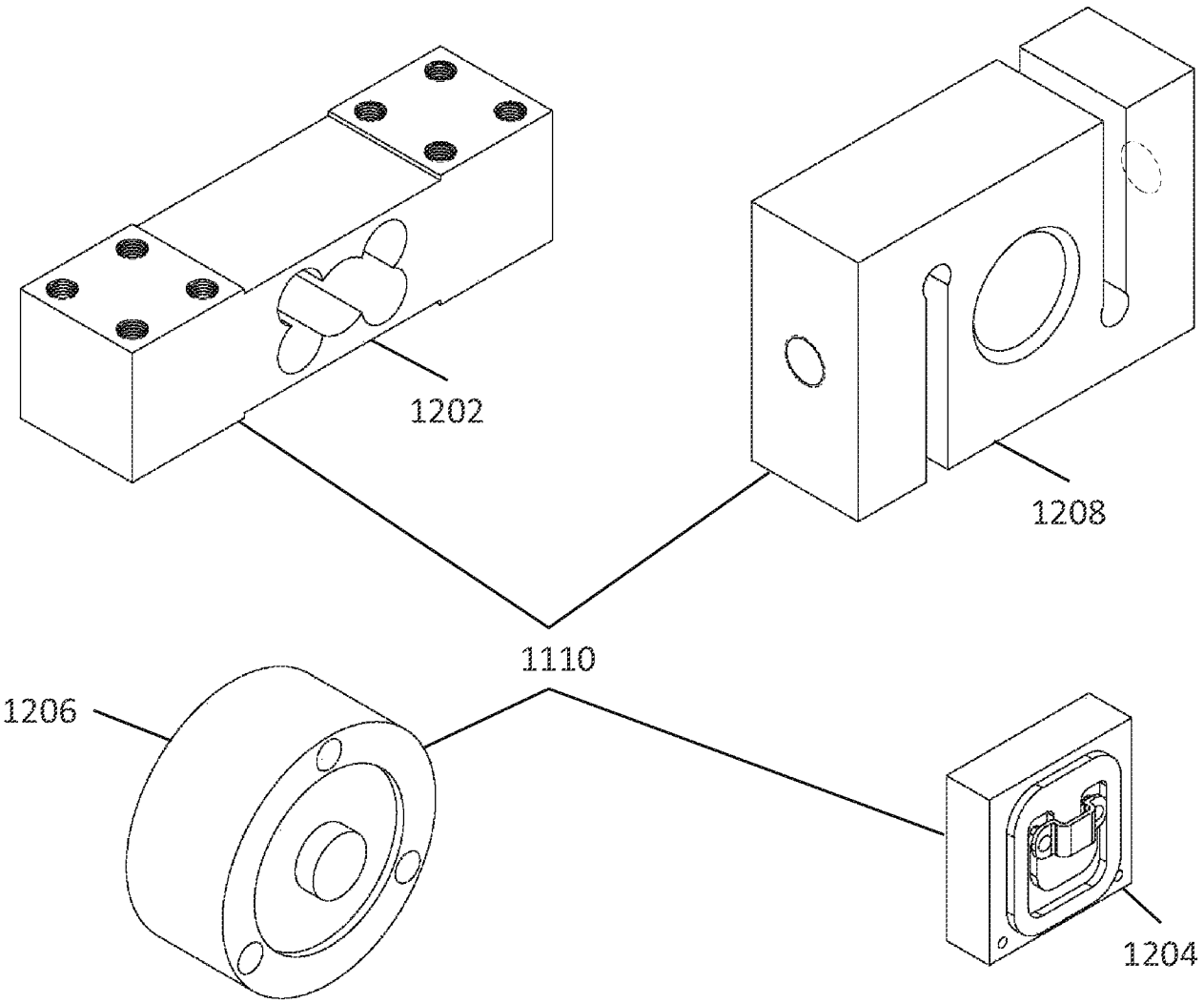
FIG. 40 illustrates four examples of load cells that can be used in the system.
Figure 41:
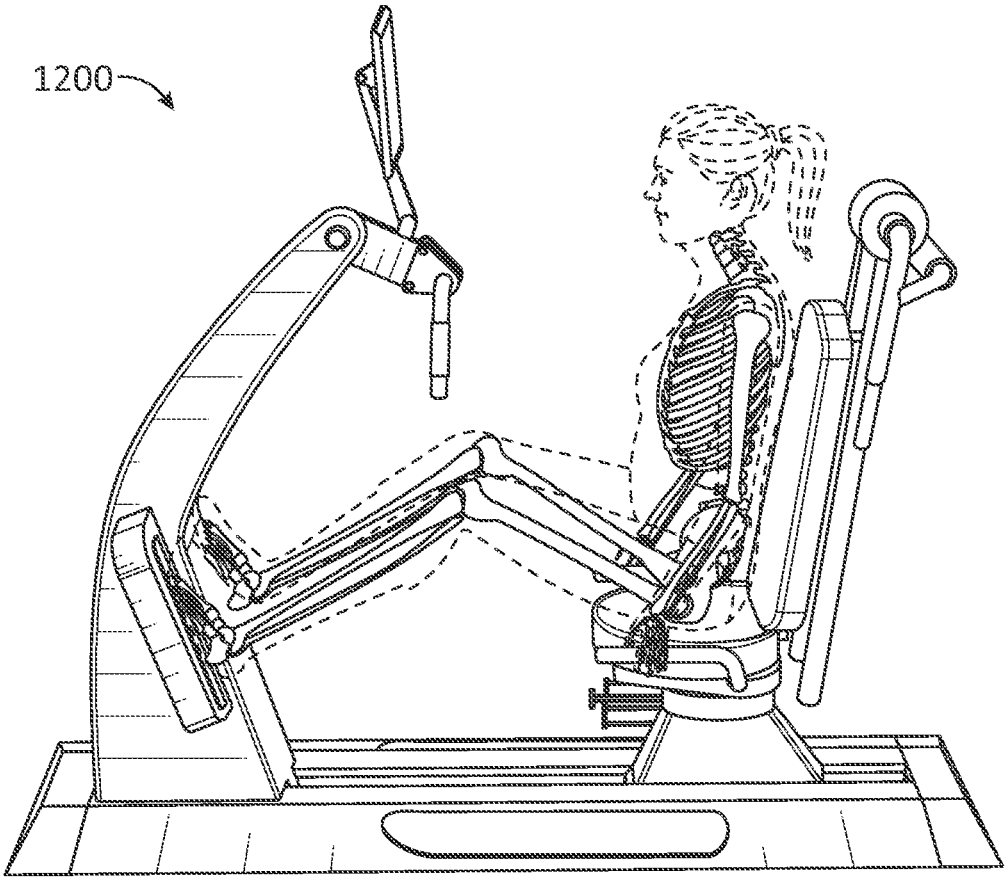
FIG. 41 is a side view of an alternative embodiment of a system for isometric exercise and rehabilitation with a user performing a leg-press-style exercise.
Figure 42:
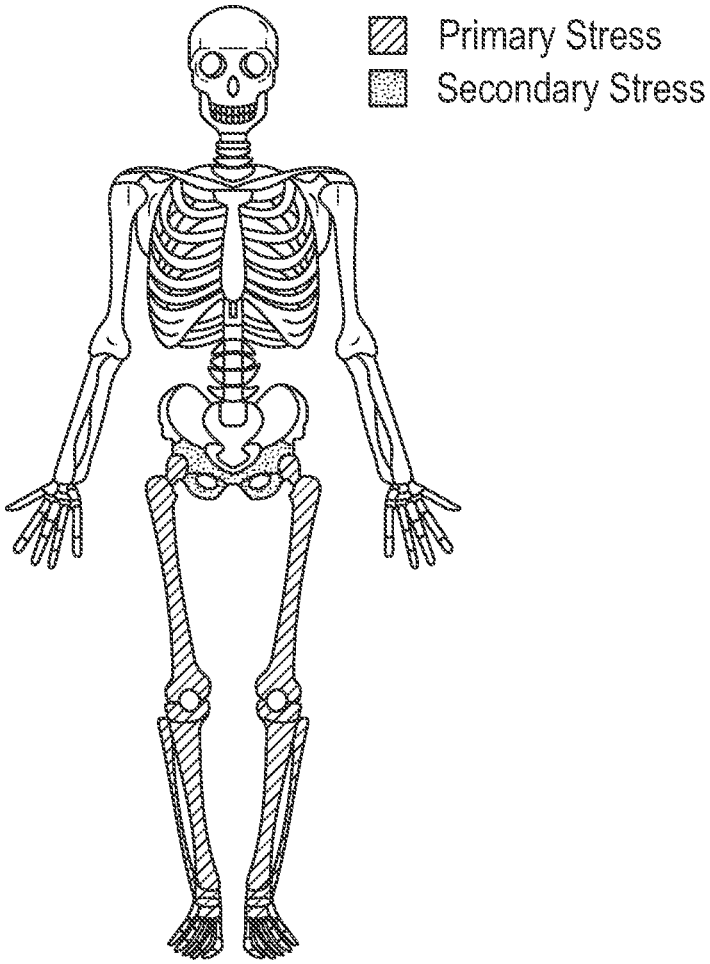
FIG. 42 illustrates skeletal stress regions of a user during the leg-press-style exercise of FIG. 41.
Figure 43:
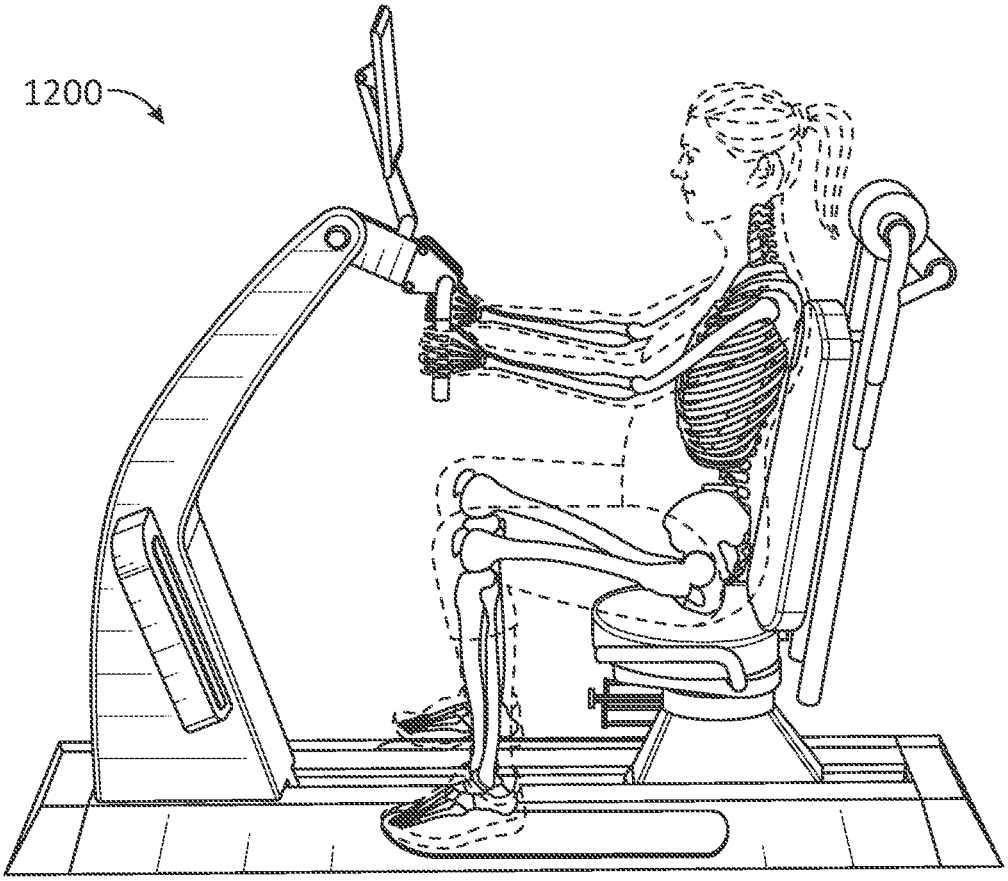
FIG. 43 is a side view of system of FIG. 41 with the user performing a chest-press-style exercise.
Figure 44:
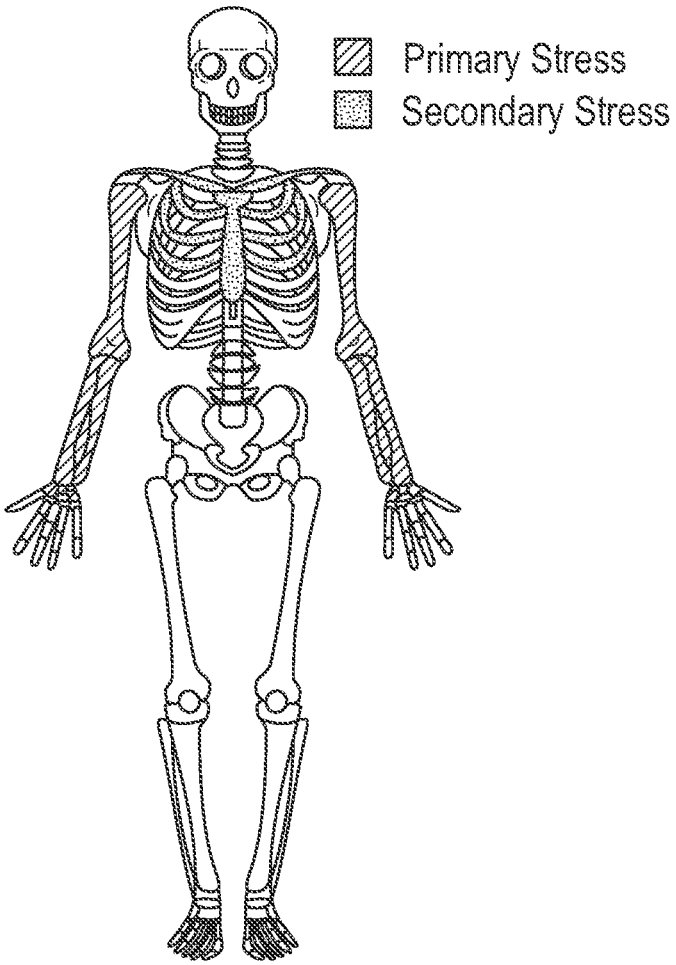
FIG. 44 depicts skeletal stress regions of the user during the chest-press-style exercise of FIG. 43.
Figure 45:
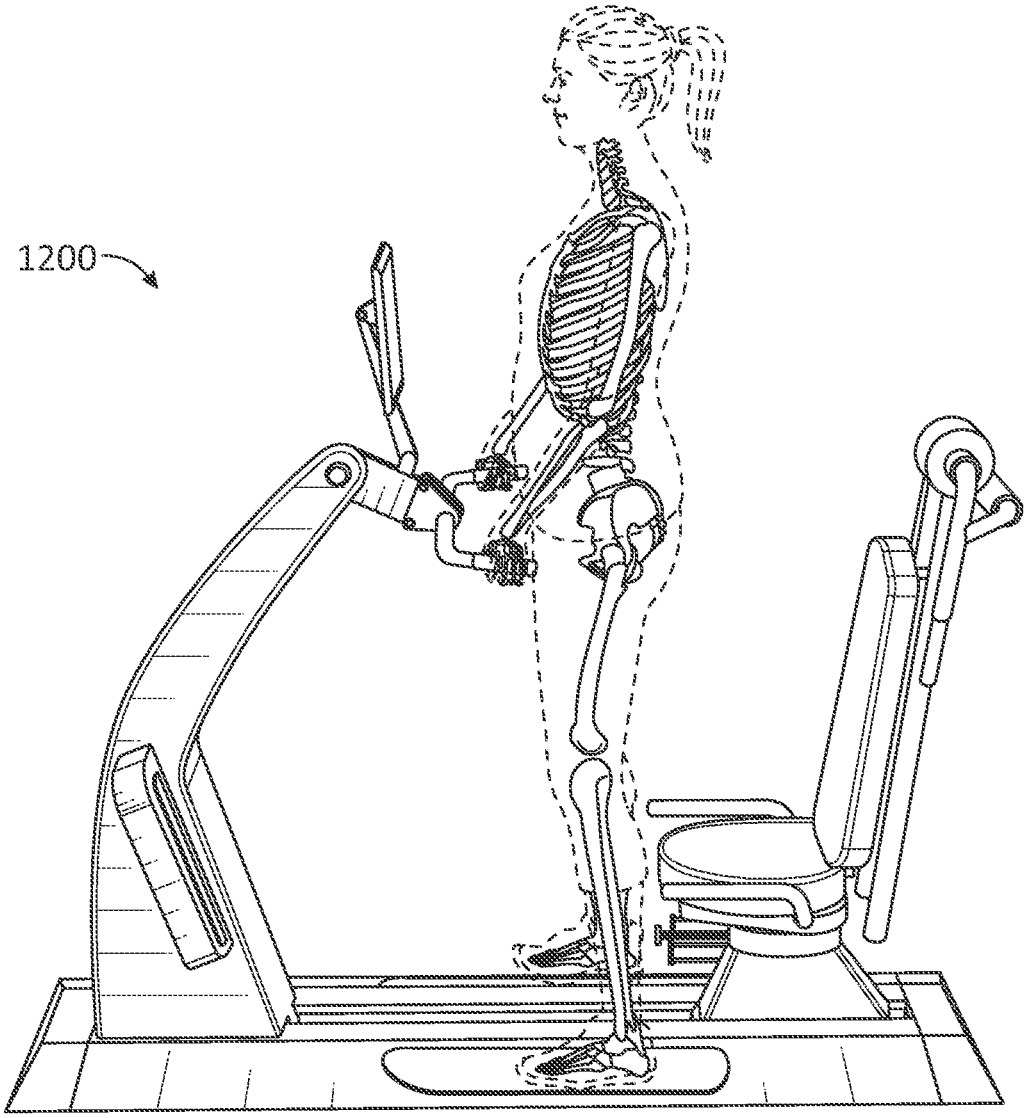
FIG. 45 is a side view of the system of FIG. 41 with the user performing a suitcase-lift-style exercise.
Figure 46:
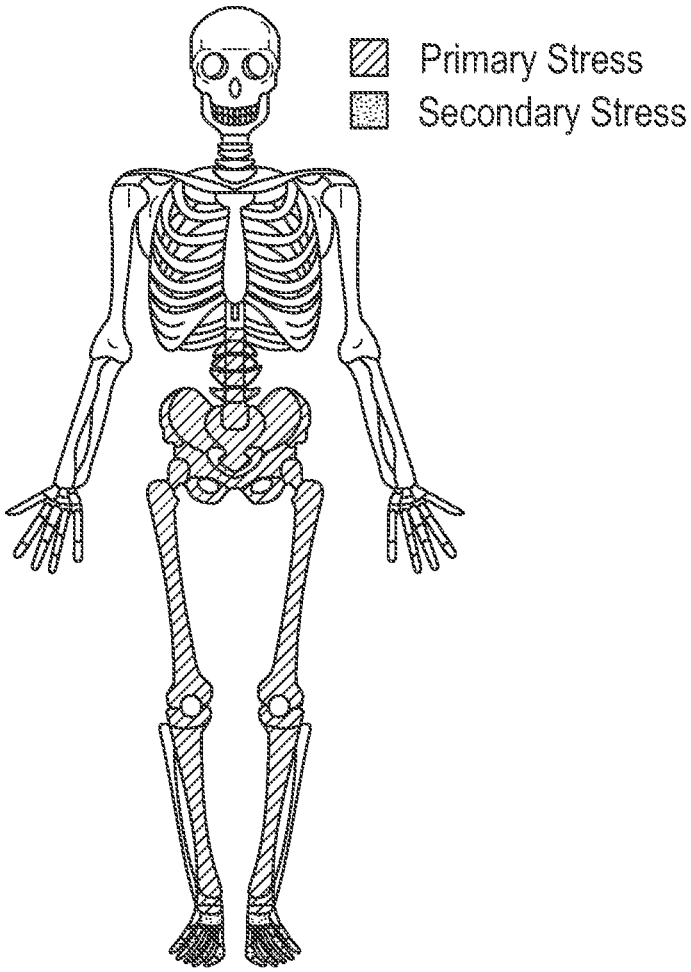
FIG. 46 illustrates skeletal stress regions during the suitcase-lift-style exercise of FIG. 45.
Figure 47:
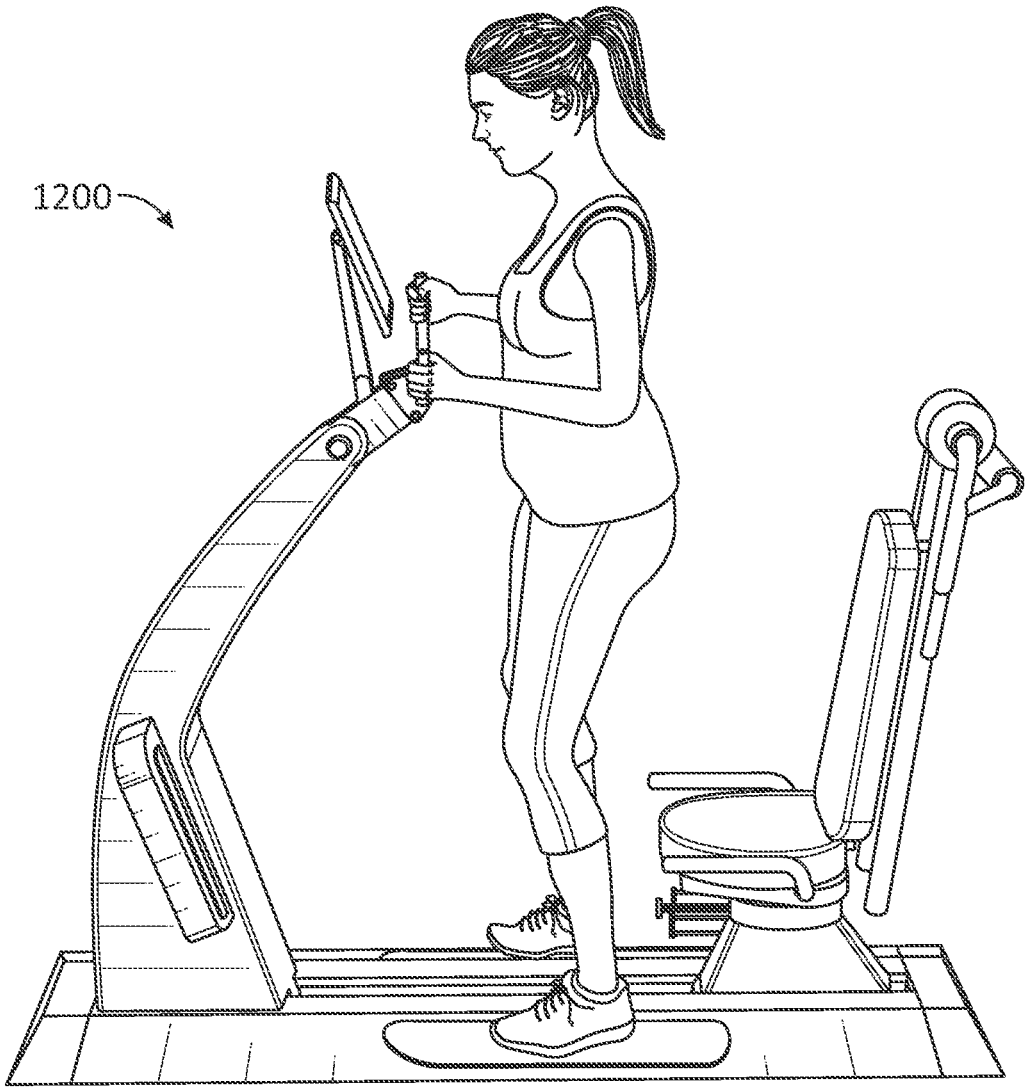
FIG. 47 is a side view of the system of FIG. 41 with the user performing an arm-curl-style exercise.
Figure 48:
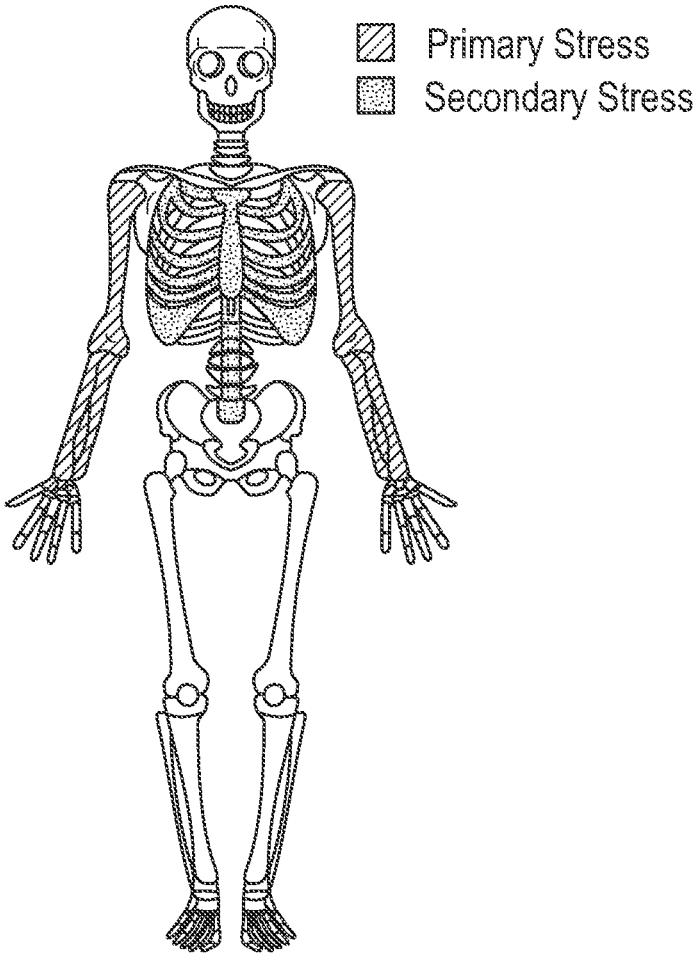
FIG. 48 depicts skeletal stress regions during the arm-curl-style exercise of FIG. 47.
Figure 49:
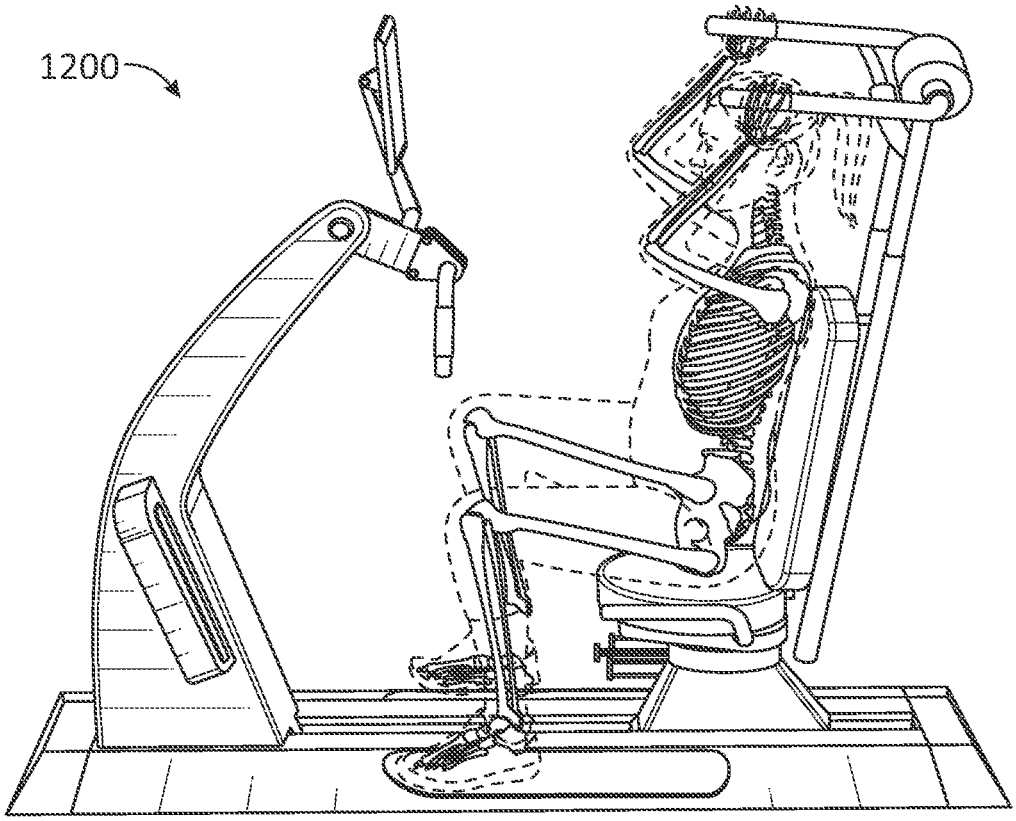
FIG. 49 is a side view of the system of FIG. 41 with the user performing a core-pull-style exercise.
Figure 50:
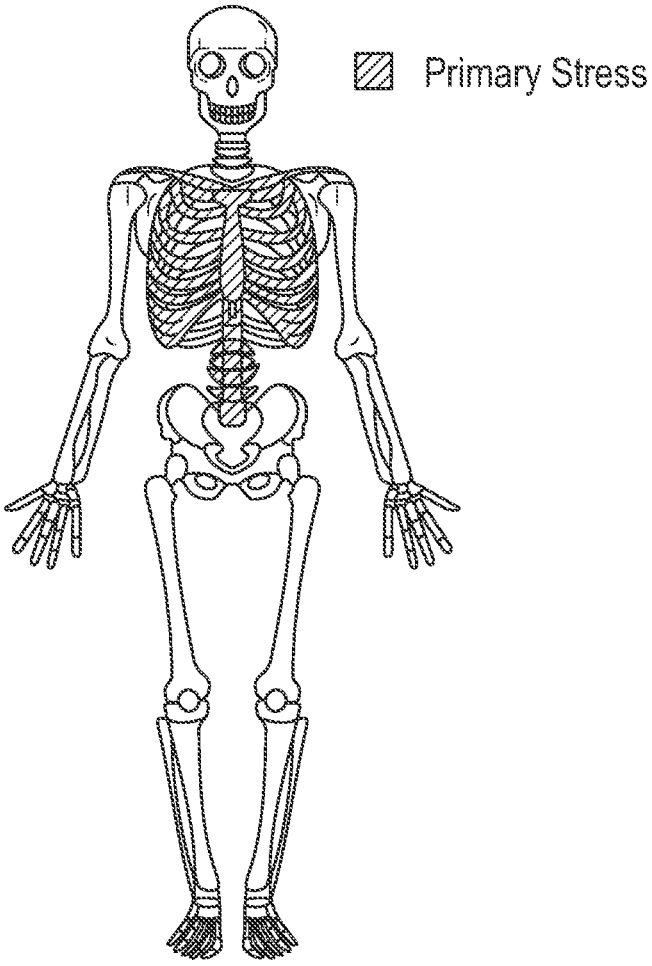
FIG. 50 illustrates a skeletal stress region during the core-pull-style exercise of FIG. 49.
Figure 51:
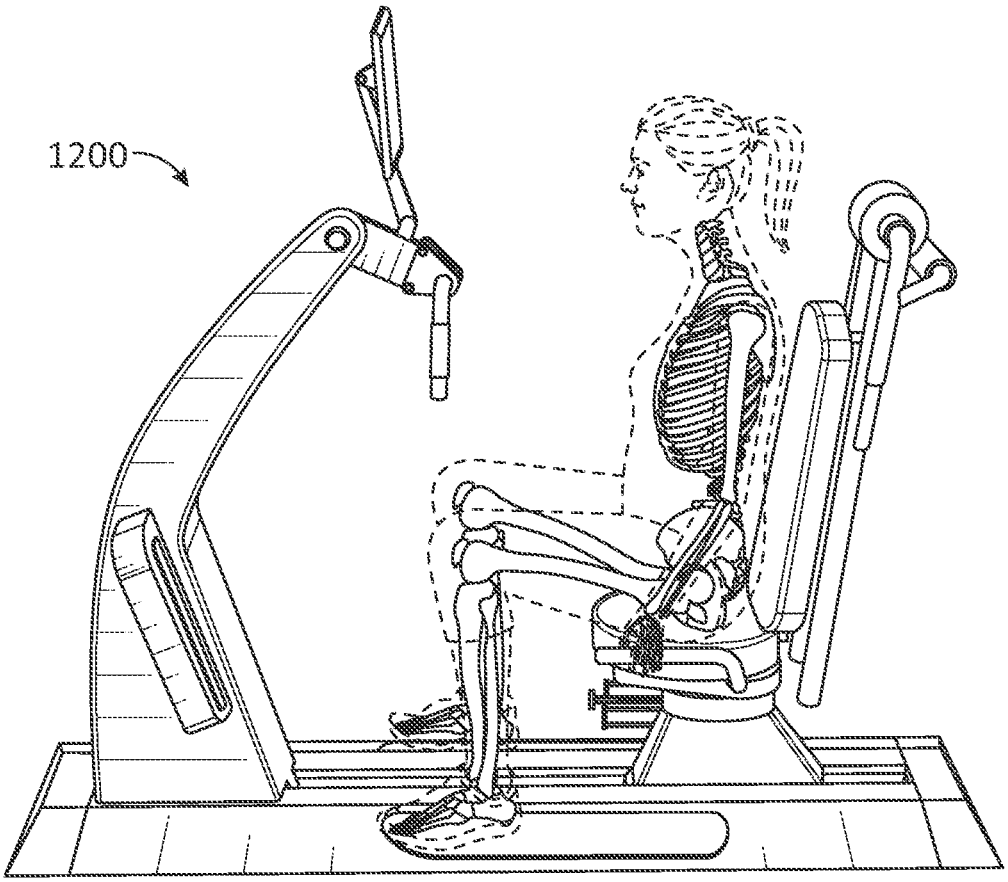
FIG. 51 is a side view of the system of FIG. 41 with the user performing a grip-strength exercise.

FIG. 40 depicts several options for the load cells 1110. In some embodiments, the load cells 1110 can be piezoelectric load cells, such as PACEline CLP Piezoelectric Subminiature Load Washers. In other embodiments, the load cells 1110 can be hydraulic load cells, such as NOSHOK hydraulic load cells. In some versions, the load cells 1110 can include strain gauges. Embodiments of the strain gauges can be bending-type strain gauges, such as Omega SGN-4/20-PN 4 mm grid, 20 ohm nickel foil resistors. Other examples of the strain gauges can be double-bending-type strain gauges 1202, such as Rudera Sensor RSL 642 strain gauges. Still other embodiments of the strain gauges can be half-bridge-type strain gauges 1204, such as Onyehn 4pcs 50 kg Human Scale Load Cell Resistance Half-bridge/Amplifier Strain Weight Sensors with 1pcs HX711 AD Weight Modules for Arduino DIY Electronic Scale strain gauges. In some embodiments, the strain gauges can be S-type strain gauges 1206, such as Sensortronics S-type load cell 60001 strain gauges. Additionally, the strain gauges can be button-type strain gauges 1208, such as Omega LCGB-250 250 lb Capacity Load Cells. Naturally, the load cells 1110 can comprise combinations of these various examples. The embodiments described herein are not limited to these examples.

FIGS. 41-51 include an alternate embodiment of an isometric exercise and rehabilitation system or assembly 1200. This version and its components can be similar or even identical to the other embodiments disclosed herein. Alternatively, the isometric exercise and rehabilitation system or assembly 1200 can have additional features and components, as shown. Some of these drawings include renderings of primary and secondary stresses induced on the human skeletal system by each type of associated exercise.

Other examples can include one or more of the following items.

1. An isometric exercise and rehabilitation system, comprising:
   a frame;
   a pair of load handles configured to be supported by the frame and configured to be gripped and have force applied thereto by a user during an osteogenic exercise, wherein the load handles are symmetrically spaced apart from each other relative to a vertical plane that longitudinally bisects the frame; and
   each load handle comprises a load cell configured to measure the force applied to the respective load handle.

2. The isometric exercise and rehabilitation system, further comprising a computer and a graphical display monitor, each load cell is configured to individually communicate with the computer, and the graphical display monitor is configured to communicate with the computer to display information to the user about the osteogenic exercise or performance of the user.

3. The isometric exercise and rehabilitation system, further comprising a seat configured to couple to the frame to support the user while applying force to the load handles, a position of the seat relative to the frame is adjustable, and the seat comprises a fastening system configured to secure the user in the seat.

4. The isometric exercise and rehabilitation system, wherein the pair of load handles is configured to be located above and in front of the seat, such that the user can apply force to the load handles in conjunction with a restraining force on the user by the fastening system in a core-pull-style exercise.

5. The isometric exercise and rehabilitation system, wherein a position of the load handles is adjustable in a vertical dimension relative to the seat.

6. The isometric exercise and rehabilitation system, further comprising a second pair of load handles configured to be spaced apart from a front of the seat, such that the user can apply force in a chest-press-style exercise.

7. The isometric exercise and rehabilitation system, wherein a position of the second pair of load handles is adjustable in a vertical dimension.

8. The isometric exercise and rehabilitation system, further comprising a third pair of load handles configured to be located horizontally along a first axis that is perpendicular to the vertical plane, such that the user can apply force in a deadlift-style exercise to the third pair of load handles.

9. The isometric exercise and rehabilitation system, wherein a position of the third pair of load handles is adjustable in a vertical dimension.

10. The isometric exercise and rehabilitation system, further comprising a fourth pair of load handles configured to be located horizontally along a pair of axes that are parallel to the vertical plane, and the fourth pair of load handles are configured to be horizontally co-planar such that a user can apply force in a suitcase lift-style exercise.

11. The isometric exercise and rehabilitation system, wherein a position of the fourth pair of load handles is adjustable in a vertical dimension.

12. The isometric exercise and rehabilitation system, further comprising a fifth pair of load handles configured to be horizontally co-planar with each other, and configured to be relocated along a vertical axis between a first position wherein the user can apply force in a suitcase lift-style exercise, and a second position wherein the user can apply force in a deadlift-style exercise.

13. The isometric exercise and rehabilitation system, wherein the load cells comprise at least one of bending-type strain gauges, double-bending-type strain gauges, half-bridge-type strain gauges, S-type strain gauges, button-type strain gauges, piezoelectric load cells or hydraulic load cells.

14. An isometric exercise and rehabilitation assembly, comprising:

a frame;

a pair of load handles supported by the frame and configured to be gripped and have force applied thereto by a user during an osteogenic exercise, wherein the load handles are spaced apart from each other relative to a vertical plane that longitudinally bisects the frame;

each load handle comprises a load cell configured to measure the force applied to the respective load handle;

a seat coupled to the frame and configured to support the user while applying force to the load handles, a position of the seat relative to the frame is adjustable, and the seat comprises a fastening system configured to secure the user in the seat;

a computer and a graphical display monitor coupled to the frame, each load cell is configured to individually communicate with the computer, and the graphical display monitor is configured to communicate with the computer to display information to the user about the osteogenic exercise or performance of the user.

15. The isometric exercise and rehabilitation system, wherein the pair of load handles are located above and in front of the seat, such that the user can apply force to the load handles in conjunction with a restraining force on the user by the fastening system in a core-pull-style exercise, and a position of the load handles is adjustable in a vertical dimension relative to the seat.

16. The isometric exercise and rehabilitation system, further comprising a second pair of load handles spaced apart from a front of the seat, such that the user can apply force in a chest-press-style exercise; and a position of the second pair of load handles is adjustable in a vertical dimension.

17. The isometric exercise and rehabilitation system 6, further comprising a third pair of load handles located horizontally along a first axis that is perpendicular to the vertical plane, such that the user can apply force in a deadlift-style exercise to the third pair of load handles; and a position of the third pair of load handles is adjustable in a vertical dimension.

18. The isometric exercise and rehabilitation system, further comprising a fourth pair of load handles located horizontally along a pair of axes that are parallel to the vertical plane, and the fourth pair of load handles are horizontally co-planar such that a user can apply force in a suitcase lift-style exercise; and a position of the fourth pair of load handles is adjustable in a vertical dimension.

19. The isometric exercise and rehabilitation system, further comprising a fifth pair of load handles that are horizontally co-planar with each other, and configured to be relocated along a vertical axis between a first position wherein the user can apply force in a suitcase lift-style exercise, and a second position wherein the user can apply force in a deadlift-style exercise.

20. The isometric exercise and rehabilitation system, wherein the load cells comprise at least one of bending-type strain gauges, double-bending-type strain gauges, half-bridge-type strain gauges, S-type strain gauges, button-type strain gauges, piezoelectric load cells or hydraulic load cells.

1. An isometric exercise and rehabilitation system, comprising:

a frame;

foot plates configured to be mounted to the frame and configured to be engaged and have force applied thereto by a user performing an osteogenic exercise; and each foot plate is configured to be coupled to at least one respective load cell and configured to separately and independently measure the force applied to the respective foot plate in a leg press-style exercise by the user.

2. The isometric exercise and rehabilitation system, further comprising a computer, and the load cells are configured individually communicate with the computer.

3. The isometric exercise and rehabilitation system, further comprising a graphic display monitor configured to communicate with the computer and configured to display graphical information to the user about at least one of the osteogenic exercise or a performance of the user.

4. The isometric exercise and rehabilitation system, further comprising a seat configured to be coupled to the frame and configured to support the user when the user applies force to the foot plates.

5. The isometric exercise and rehabilitation system, wherein a position of the seat relative to the frame is adjustable.

6. The isometric exercise and rehabilitation system, wherein the position of the seat is adjustable in at least one of a vertical dimension, a horizontal dimension or an angle of the seat relative to the frame.

7. The isometric exercise and rehabilitation system, wherein the seat further comprises a fastening system configured to secure the user to the seat.

8. The isometric exercise and rehabilitation system, further comprising a back rest configured to be coupled to the frame adjacent to the seat, and the back rest is configured to engage a back of the user to push against while applying force to the foot plates.

9. The isometric exercise and rehabilitation system, wherein a position of the back rest is adjustable in at least one of a vertical dimension, a horizontal dimension or an angle of the back rest relative to the frame.

10. The isometric exercise and rehabilitation system, wherein each foot plate is coupled to at least four respective load cells.

11. The isometric exercise and rehabilitation system, wherein the load cells comprise strain gauges.

12. The isometric exercise and rehabilitation system, wherein the strain gauges comprise bending-type strain gauges.

13. The isometric exercise and rehabilitation system, wherein the strain gauges comprise double-bending-type strain gauges.

14. The isometric exercise and rehabilitation system, wherein the strain gauges comprise half-bridge-type strain gauges.

15. The isometric exercise and rehabilitation system, wherein the strain gauges comprise S-type strain gauges.

16. The isometric exercise and rehabilitation system, wherein the strain gauges comprise button-type strain gauges.

17. The isometric exercise and rehabilitation system, wherein the load cells comprise piezoelectric load cells.

18. The isometric exercise and rehabilitation system, wherein the load cells comprise hydraulic load cells.

19. An isometric exercise and rehabilitation assembly, comprising:

a frame;

foot plates mounted to the frame and configured to be engaged and have force applied thereto by a user performing an osteogenic exercise;

a seat coupled to the frame and configured to support the user while applying force to the foot plates, and a position of the seat is adjustable;

each foot plate is coupled to a respective load cell for separately and independently measuring the force applied to the respective foot plate in a leg press-style exercise by the user;

a computer operably and individually coupled to each of the load cells; and a graphic display monitor operably coupled to the computer such that the graphic display monitor displays information to the user about the osteogenic exercise or a performance of the user.

20. An isometric exercise and rehabilitation assembly, comprising:

a frame;

a single foot plate mounted to the frame and configured to be engaged and have force applied thereto in an osteogenic exercise by both legs of a user;

a seat coupled to the frame and configured to support the user while seated and applying force to the single foot plate, and a position of the seat is adjustable;

the foot plate is coupled to load cells for separately and independently measuring the force applied by respective legs of the user in a leg press-style exercise by the user;

a computer operably and individually coupled to the load cells; and a graphical display monitor operably coupled to the computer and configured to display information to the user about the osteogenic exercise or a performance of the user.

1. An isometric exercise and rehabilitation assembly, comprising:

a frame;

at least one load handle supported by the frame, wherein:

during an osteogenic exercise by a use:

the at least one load handle is configured to be gripped and have force applied thereto, and the at least one load handle comprising at least one load cell configured to measure the force applied to the at least one load handle, and at least one haptic device configured to provide, during the osteogenic exercise, haptic feedback based on the force measured by the at least one load cell.

2. The isometric exercise and rehabilitation assembly, wherein the at least one haptic device is disposed within the at least one load handle.

3. The isometric exercise and rehabilitation assembly, further comprising a computer, and wherein the at least one load cell and the at least one haptic device are in communication with the computer.

4. The isometric exercise and rehabilitation assembly, further comprising a monitor that is in electrical communication with the computer, wherein the monitor is configured to display, during the osteogenic exercise, at least one of information pertaining to the osteogenic exercise, or a performance of the user determined based at least partially on the force measured by the at least one load cell.

5. The isometric exercise and rehabilitation assembly, wherein the at least one haptic device is further configured to provide the haptic feedback in response to the force exceeding a threshold force.

6. The isometric exercise and rehabilitation assembly, wherein the threshold force is determined by the computer.

7. The isometric exercise and rehabilitation assembly, wherein the at least one haptic device is further configured to provide the haptic feedback while the force measured by the at least one load cell exceeds the threshold force.

8. The isometric exercise and rehabilitation assembly, wherein the at least one haptic device is further configured to provide the haptic feedback for a predetermined duration of time for the haptic feedback.

9. The isometric exercise and rehabilitation assembly, wherein the predetermined duration of time for the haptic feedback is determined by the computer.

10. The isometric exercise and rehabilitation assembly, further comprising a frame-supported seat on which the user sits while applying, during the osteogenic exercise, the force to the at least one load handle.

11. The isometric exercise and rehabilitation assembly, wherein another haptic device is disposed within the frame-supported seat.

12. The isometric exercise and rehabilitation assembly, wherein the at least one haptic device is an eccentric rotating mass vibration motor, a linear resonant actuator, or a piezoelectric actuator.

13. An isometric exercise and rehabilitation assembly, comprising:

a frame;

at least one pair of load handles supported by the frame, wherein:

during an osteogenic exercise by a user:

the at least one pair of load handles are configured to be gripped and have force applied thereto, load handles in the at least one pair of load handles are symmetrically spaced apart from each other relative to a vertical plane that longitudinally bisects the frame of the isometric exercise and rehabilitation assembly, each respective load handle of the at least one pair of load handles comprising at least one load cell configured to measure the force applied to the respective load handle, and at least one haptic device configured to provide, during the osteogenic exercise, haptic feedback based on the force measured by the at least one load cell included in the respective load handle.

14. The isometric exercise and rehabilitation assembly, wherein the at least one haptic device is disposed within the at least one pair of load handles.

15. The isometric exercise and rehabilitation assembly, further comprising a computer, and wherein the at least one load cell included in each respective load handle of the at least one pair of load handles is in communication with the computer.

16. The isometric exercise and rehabilitation assembly, further comprising a monitor in electrical communication with the computer, wherein the monitor is configured to display, during the osteogenic exercise, at least one of information pertaining to the osteogenic exercise, or a performance of the user determined based at least partially on the force measured by the at least one load cell included in each respective load handle of the at least one pair of load handles.

17. The isometric exercise and rehabilitation assembly, wherein each of the at least one haptic device included in the respective load handle of the at least one pair of load handles is further configured to provide the haptic feedback in response to the force exceeding a threshold force.

18. The isometric exercise and rehabilitation assembly, wherein the threshold force is determined by the computer.

19. The isometric exercise and rehabilitation assembly, wherein each of the at least one haptic device included in the respective load handle of the at least one pair of load handles is further configured to provide the haptic feedback while the force exceeds the threshold force.

20. The isometric exercise and rehabilitation assembly, wherein each of the at least one haptic device included in the respective load handle of the at least one pair of load handles is further configured to provide the haptic feedback for a predetermined duration of time for the haptic feedback.

21. The isometric exercise and rehabilitation assembly, wherein the predetermined time is determined by the computer.

22. The isometric exercise and rehabilitation assembly, further comprising a frame-supported seat on which the user sits while applying, during the osteogenic exercise, the force to the at least one pair of load handles.

23. The isometric exercise and rehabilitation assembly, wherein the at least one haptic device is an eccentric rotating mass vibration motor, a linear resonant actuator, or a piezoelectric actuator.

24. An isometric exercise and rehabilitation assembly, comprising:

a frame;

foot plates mounted to the frame and coupled to load cells, wherein:

during an osteogenic exercise by a user:

the foot plates are configured to be engaged and have force applied thereto, each respective foot plate of the foot plates being coupled to at least one respective load cell of the load cells for separately and independently measuring the force applied to the respective foot plate; and at least one haptic device configured to provide, during the osteogenic exercise, haptic feedback based on the force measured by the load cells.

25. The isometric exercise and rehabilitation assembly, wherein the at least one haptic device is disposed within at least one of the foot plates.

26. The isometric exercise and rehabilitation assembly, further comprising a computer, and wherein the load cells and the at least one haptic device are in communication with the computer.

27. The isometric exercise and rehabilitation assembly, further comprising a monitor that is in electrical communication with the computer, wherein the monitor is configured to display, during the osteogenic exercise, at least one of information pertaining to the osteogenic exercise, or a performance of the user determined based at least partially on the force measured by the load cells.

28. The isometric exercise and rehabilitation assembly, wherein the at least one haptic device is further configured to provide the haptic feedback in response to the force exceeding a threshold force.

29. The isometric exercise and rehabilitation assembly, wherein the threshold force is determined by the computer.

30. The isometric exercise and rehabilitation assembly, wherein the at least one haptic device is further configured to provide the haptic feedback while the force exceeds the threshold force.

31. The isometric exercise and rehabilitation assembly, wherein the at least one haptic device is further configured to provide the haptic feedback for a predetermined duration of time for the haptic feedback.

32. The isometric exercise and rehabilitation assembly, wherein the predetermined duration of time for the haptic feedback is determined by the computer.

33. The isometric exercise and rehabilitation assembly, further comprising a frame-supported seat on which the user sits while applying, during the osteogenic exercise, the force to the foot plates.

34. The isometric exercise and rehabilitation assembly, wherein the at least one haptic device is disposed within the frame-supported seat.

35. The isometric exercise and rehabilitation assembly, wherein the at least one haptic device is an eccentric rotating mass vibration motor, a linear resonant actuator, or a piezoelectric actuator.

36. An isometric exercise and rehabilitation assembly, comprising:

a frame;

a single foot plate mounted to the frame, wherein the single foot plate is configured to be engaged and have force applied thereto during an osteogenic exercise by a user;

a frame-supported seat on which the user sits while applying the force to the single foot plate, wherein a position of the frame-supported seat is configured to be adjustable, wherein the single foot plate is coupled to a load cell configured to measure the force applied by a leg of the user during the osteogenic exercise;

a computer operably coupled to the load cell;

a monitor operably coupled to the computer, wherein the monitor is configured to display at least one of information pertaining to the osteogenic exercise, or a performance of the user based at least partially on the force measured by the load cell; and at least one haptic device configured to provide, during the osteogenic exercise, haptic feedback based on the force measured by the load cell.

37. The isometric exercise and rehabilitation assembly, wherein the at least one haptic device is disposed within the single foot plate.

38. The isometric exercise and rehabilitation assembly, wherein the at least one haptic device is further configured to provide the haptic feedback in response to the force exceeding a threshold force.

39. The isometric exercise and rehabilitation assembly, wherein the threshold force is determined by the computer.

40. The isometric exercise and rehabilitation assembly, wherein the at least one haptic device is further configured to provide the haptic feedback while the force measured by the load cell exceeds the threshold force.

41. The isometric exercise and rehabilitation assembly, wherein the at least one haptic device is further configured to provide the haptic feedback for a predetermined duration of time for the haptic feedback.

42. The isometric exercise and rehabilitation assembly, wherein the predetermined duration of time for the haptic feedback is determined by the computer.

43. The isometric exercise and rehabilitation assembly, wherein the at least one haptic device is disposed within the frame-supported seat.

44. The isometric exercise and rehabilitation assembly, wherein the at least one haptic device is an eccentric rotating mass vibration motor, a linear resonant actuator, or a piezoelectric actuator.

The various aspects, embodiments, implementations or features of the described embodiments can be used separately or in any combination. The embodiments disclosed herein are modular in nature and can be used in conjunction with or coupled to other embodiments, including both statically-based and dynamically-based equipment. In addition, the embodiments disclosed herein can employ selected equipment such that they can identify individual users and auto-calibrate threshold multiple-of-body-weight targets, as well as other individualized parameters, for individual users.

This disclosure is meant to be illustrative of the principles and various embodiments. Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims. Numerous variations and modifications will become apparent to those skilled in the art once the above disclosure is fully appreciated. It is intended that the following claims be interpreted to embrace all such variations and modifications.

What is claimed is:

1. A rehabilitation and exercise system, comprising:

a base;

a seat;

a static device configured to be coupled to the base and configured to provide isometric exercise for a user by receiving static force from the user to facilitate at least one of osteogenesis or muscle hypertrophy for the user, the static device comprising pivoting assemblies each comprising a pivoting arm and a pivoting handle, wherein the base comprises a longitudinal base length and a lateral base width;

a dynamic device configured to be coupled to the base and configured to provide a dynamic exercise for the user by being moved by the user to facilitate the at least one of osteogenesis and muscle hypertrophy for the user, the dynamic device comprising a cycling mechanism having pedals configured to be selectively engaged by the user; and a main post coupled to the base at a first base end, wherein the main post extends from the base, wherein the main post has a distal post end opposite the first base end, the pivoting assemblies are coupled to the main post at the distal post end of the main post, the pivoting assemblies are each pivotable about a lateral pivoting axis at the distal post end, each of the pivoting arms has a distal arm end, and the pivoting handles are pivotally attached to the distal arm ends, respectively, to be engaged by the user, and wherein lengths of the pivoting arms are less than a length of the main post such that, when the pivoting arms extend in a lateral direction from the distal post end of the main post toward the seat, the pivoting assemblies are positioned in the lateral direction between the cycling mechanism and the seat.

2. The rehabilitation and exercise system of claim 1, wherein the dynamic device is configured to be attached to the base adjacent the main post.

3. The system of claim 2, wherein the cycling mechanism comprises:

discs rotatably coupled to a cycle axis, each of the discs having a respective pedal axle coupled to a respective disc and offset from the cycle axis;

the pedals are rotatably coupled to respective ones of the pedal axles.

4. The system of claim 3, wherein each of the pedals comprises a semicircular panel that extends from a respective disc, and the semicircular panels are configured to be selectively engaged by the user.

5. The rehabilitation and exercise system of claim 2, wherein the pedals are offset from and rotatable about a cycle axis of the cycling mechanism, and the cycle axis extends laterally relative to the base.

6. The rehabilitation and exercise system of claim 1, further comprising a control console configured to provide information to and instruct the user regarding use of the rehabilitation and exercise system prior to or during use of the rehabilitation and exercise system.

7. The rehabilitation and exercise system of claim 6, further comprising load cells configured to sense at loads during use of the rehabilitation and exercise system, the load cells are electrically coupled to the control console and mechanically coupled to the static and dynamic devices.

8. The rehabilitation and exercise system of claim 7, wherein the load cells comprise at least one of strain gauges, bending-type load cells, double-beam-type load cells, half-bridge-type load cells, S-type load cells, button-type load cells, piezoelectric load cells or hydraulic load cells.

9. The system of claim 1, further comprising upper seat handles configured to be coupled to and extend laterally from the base, the upper seat handles are configured to be rotated by the user.

10. The system of claim 9, wherein a position of an assembly of the upper seat handles is configured to be adjusted and repositionable relative to the base.

11. The rehabilitation and exercise system of claim 1, wherein the base defines at least one base foot area disposed centrally to the base on which the user is configured to stand during at least one of the isometric exercise and the dynamic exercise.

12. The system of claim 11, wherein the at least one base foot area comprises a pair of base foot areas, each of which extends longitudinally , and the pair of base foot areas each extends laterally toward an opposite one of a first base side and a second base side of the base.

13. A rehabilitation and exercise system, comprising:

a base;

a seat a static device configured to be coupled to the base and configured to provide isometric exercise for a user by receiving static force from the user to facilitate at least one of osteogenesis or muscle hypertrophy for the user, the static device comprising pivoting assemblies each comprising a pivoting arm and a pivoting handle;

a dynamic device configured to be coupled to the base and configured to provide a dynamic exercise for the user by being moved by the user to facilitate the at least one of osteogenesis and muscle hypertrophy for the user, wherein the base comprises a longitudinal base length and a lateral base width, a main post is coupled to the base at a first base end, the main post extends from the base, the dynamic device is attached to the base adjacent the main post, and the dynamic device comprises a cycling mechanism having pedals configured to be selectively engaged by the user, and the main post has a distal post end opposite the first base end, the pivoting assemblies are coupled to the main post at the distal post end of the main post, the pivoting assemblies are each pivotable about a lateral pivoting axis at the distal post end, each of the pivoting arms has a distal arm end, and the pivoting handles are pivotally attached to the distal arm ends, respectively, to be engaged by the user; and a control console configured to provide information to and instruct the user regarding use of the rehabilitation and exercise system prior to or during use of the system, wherein lengths of the pivoting arms are less than a length of the main post such that, when the pivoting arms extend in a lateral direction from the distal post end of the main post toward the seat, the pivoting assemblies are positioned in the lateral direction between the cycling mechanism and the seat.

14. The rehabilitation and exercise system of claim 13, further comprising load cells configured to sense at loads during use of the rehabilitation and exercise system, the load cells are electrically coupled to the control console and mechanically coupled to the static and dynamic devices;

the load cells comprise at least one of strain gauges, bending-type load cells, double-beam-type load cells, half-bridge-type load cells, S-type load cells, button-type load cells, piezoelectric load cells or hydraulic load cells.

15. The system of claim 13, wherein the base defines at least one base foot area disposed centrally to the base on which the user is capable of standing during at least one of the isometric exercise and the dynamic exercise; and the at least one base foot area comprises a pair of base foot areas, and the pair of base foot areas each extends laterally toward an opposite one of a first base side and a second base side of the base.

16. A method of using an exercise machine for exercising a user, the method comprising:

providing the exercise machine having a static device, a dynamic device, and a seat positioned to allow the user to engage both the static device and the dynamic device, the static device comprising pivoting assemblies each comprising a pivoting arm and a pivoting handle, wherein the base comprises a longitudinal base length and a lateral base width, and the dynamic device comprising a cycling mechanism having pedals configured to be selectively engaged by the user, wherein a main post is coupled to the base at a first base end, the main post extends from the base, the main post has a distal post end opposite the first base end, the pivoting assemblies are coupled to the main post at the distal post end of the main post, the pivoting assemblies are each pivotable about a lateral pivoting axis at the distal post end, each of the pivoting arms has a distal arm end, and the pivoting handles are pivotally attached to the distal arm ends, respectively, to be engaged by the user;

selectively and sequentially engaging the static and dynamic devices by the user; and receiving by the static and dynamic devices applications of force by the user sufficient to facilitate osteogenesis and muscle hypertrophy for the user, wherein lengths of the pivoting arms are less than a length of the main post such that, when the pivoting arms extend in a lateral direction from the distal post end of the main post toward the seat, the pivoting assemblies are positioned in the lateral direction between the cycling mechanism and the seat.

* * * * *